US011480018B2

(12) United States Patent
Gooneratne et al.

(10) Patent No.: US 11,480,018 B2
(45) Date of Patent: Oct. 25, 2022

(54) SELF-POWERED ACTIVE VIBRATION AND ROTATIONAL SPEED SENSORS

(71) Applicants: Saudi Arabian Oil Company, Dhahran (SA); Macquarie University, Macquarie Park (AU)

(72) Inventors: Chinthaka Pasan Gooneratne, Dhahran (SA); Subhas Mukhopadhyay, Beecroft (AU); Bodong Li, Dhahran (SA); Guodong Zhan, Dhahran (SA); Arturo Magana-Mora, Dhahran (SA); Timothy Eric Moellendick, Dhahran (SA)

(73) Assignees: Saudi Arabian Oil Company, Dhahran (SA); MACQUARIE UNIVERSITY, Macquarie Park (AU)

( * ) Notice: Subject to any disclaimer, the term of this patent is extended or adjusted under 35 U.S.C. 154(b) by 260 days.

(21) Appl. No.: 16/944,455

(22) Filed: Jul. 31, 2020

(65) Prior Publication Data

US 2022/0034174 A1 Feb. 3, 2022

(51) Int. Cl.
*E21B 47/01* (2012.01)
*E21B 17/10* (2006.01)
(Continued)

(52) U.S. Cl.
CPC ..... *E21B 17/1057* (2013.01); *E21B 7/24* (2013.01); *E21B 41/0085* (2013.01);
(Continued)

(58) Field of Classification Search
CPC ..... E21B 47/017; E21B 47/01; E21B 41/0085
See application file for complete search history.

(56) References Cited

U.S. PATENT DOCUMENTS 5,226,332 A 7/1993 Wassell
6,065,332 A 5/2000 Dominick
(Continued)

FOREIGN PATENT DOCUMENTS

CN 202749854 U 2/2013
CN 110518826 A 11/2019
(Continued)

OTHER PUBLICATIONS

Extended European Search Report for corresponding European Application No. 21185565.5 dated Jan. 11, 2022.
(Continued)

*Primary Examiner* — Giovanna Wright
(74) *Attorney, Agent, or Firm* — Leason Ellis LLP

(57) ABSTRACT

Self-powered active sensing systems (SASS) for use in downhole drilling environments are disclosed. Sensor devices of the SASS can include a self-powered rotational speed sensor including a ring structure attached around a drill string. The ring rotates within a groove formed in an outer housing. Bearings on the ring are arranged to contact moveable members extending from the housing into the groove thereby causing the moveable member to generate an electrical signal representing rotational speed. The SASS can include a vibration sensor having a ring spring mounted within a housing. Spherical bearings on the outer surface of the ring are configured to contact screens that are mounted to the housing and that generate a signal representing movement of the bearing/ring from vibration. Multiple SASS units configured to wirelessly transmit sensor data can be placed along a drill string providing a distributed self-powered system for measuring downhole parameters.

23 Claims, 34 Drawing Sheets

(51) Int. Cl.

| | |
|---|---|
| ***E21B 47/017*** | (2012.01) |
| ***E21B 47/13*** | (2012.01) |
| ***E21B 47/26*** | (2012.01) |
| ***E21B 7/24*** | (2006.01) |
| ***E21B 41/00*** | (2006.01) |

(52) U.S. Cl.

CPC ..... *E21B 47/01* (2013.01); *E21B 47/017* (2020.05); *E21B 47/13* (2020.05); *E21B 47/26* (2020.05)

(56) References Cited

U.S. PATENT DOCUMENTS

| | | | | |
|---|---|---|---|---|
| 6,830,379 | B2 | 12/2004 | Morita et al. | |
| 8,284,075 | B2 | 10/2012 | Fincher et al. | |
| 10,066,474 | B2 | 9/2018 | Rodney et al. | |
| 2005/0024231 | A1 | 2/2005 | Fincher et al. | |
| 2005/0051323 | A1 | 3/2005 | Fripp et al. | |
| 2006/0016606 | A1 | 1/2006 | Tubel et al. | |
| 2006/0086498 | A1 | 4/2006 | Wetzel et al. | |
| 2008/0247273 | A1 | 10/2008 | Chemali et al. | |
| 2010/0133006 | A1 | 6/2010 | Shakra et al. | |
| 2010/0219646 | A1 | 9/2010 | Hay | |
| 2011/0210645 | A1 | 9/2011 | Mason | |
| 2012/0222900 | A1 | 9/2012 | Rodney et al. | |
| 2013/0026766 | A1 | 1/2013 | Ocalan et al. | |
| 2013/0307278 | A1* | 11/2013 | Coonrod | E21B 17/028 290/1 R |
| 2013/0328442 | A1* | 12/2013 | Hay | H01L 41/06 310/300 |
| 2014/0069720 | A1 | 3/2014 | Gray | |
| 2015/0096744 | A1 | 4/2015 | Signorelli et al. | |
| 2015/0176344 | A1 | 6/2015 | McLoughlin et al. | |
| 2016/0090821 | A1 | 3/2016 | Kim | |
| 2016/0164437 | A1 | 6/2016 | Kim et al. | |
| 2017/0067333 | A1 | 3/2017 | Peters et al. | |
| 2018/0066513 | A1 | 3/2018 | Sugiura et al. | |
| 2018/0347319 | A1 | 12/2018 | Feluch et al. | |
| 2019/0361139 | A1 | 11/2019 | Palmer et al. | |
| 2020/0165905 | A1* | 5/2020 | Gooneratne | E21B 49/00 |
| 2022/0034173 | A1* | 2/2022 | Gooneratne | E21B 47/0025 |
| 2022/0034198 | A1* | 2/2022 | Gooneratne | E21B 47/26 |
| 2022/0038031 | A1* | 2/2022 | Gooneratne | H02N 1/04 |
| 2022/0038034 | A1* | 2/2022 | Gooneratne | E21B 17/028 |

FOREIGN PATENT DOCUMENTS

| | | | | |
|---|---|---|---|---|
| CN | 113279742 | A | * | 8/2021 |
| JP | 2004212347 | A | | 7/2004 |
| NL | 7907085 | A | | 3/1981 |
| SU | 1434088 | A1 | | 10/1988 |

OTHER PUBLICATIONS

Wei, Chongfeng and Xingjian Jing, "A comprehensive review on vibration energy harvesting: Modelling and realization", Renewable and Sustainable Energy Reviews, ScienceDirect, Elsevier Ltd., vol. 74, Feb. 2017, pp. 1-18 (18 pages).

Xie, Yuedong et al., "A self-powered radio frequency (RF) transmission system based on the combination of triboelectric nanogenerator (TENG) and piezoelectric element for disaster rescue/relief", Nano Energy, Author's Accepted Manuscript, Elsevier Ltd., Oct. 2018 (24 pages).

Yang, Zhengbao et al., "High-Performance Piezoelectric Energy Harvesters and Their Applications", Joule, CellPress, Elsevier Inc., vol. 2, Apr. 2018. pp. 642-697 (56 pages).

Zhang, Xingtian et al., "A portable high-efficiency electromagnetic energy harvesting system using supercapacitors for renewable energy applications in railroads", Energy Conversion and Management, ScienceDirect, Elsevier Ltd., vol. 118, Apr. 2016, pp. 287-294 (8 pages).

Zhao, Shulin et al., "Advances in Sn-Based Catalysts for Electrochemical CO2 Reduction", Nano-Micro Letters, Shanghai Jiao Tong University Press, Springer, vol. 11, No. 62, Jul. 2019 (19 pages).

Zou, Hong-Xiang et al., "Mechanical modulations for enhancing energy harvesting: Principles, methods and applications", Applied Energy, ScienceDirect, Elsevier Ltd., vol. 255, No. 113871, Sep. 2019 (18 pages).

"Wireless environmental sensor: Wireless environmental sensor system integrated circuits and reference designs", Texas Instruments Incorporated, Access Date: Oct. 27, 2020, URL:<https://www.ti.com/solution/wireless-environmental-sensor> (3 pages).

"MEMS and Sensors", ST Life.Augmented, STMicroelectronics, Access Date: Oct. 27, 2020, URL: https://www.st.com/en/mems-and-sensors.html> (2 pages).

"SQ-MIN-200: Tilt & Vibration Sensor, Ultra Low Power, Omnidirectional", SignalQuest: Precision Microsensors, SignalQuest, LLC, Access Date: Oct. 27, 2020, URL:<https://signalquest.com/product/components/sq-min-200/> (3 pages).

"Solutions for sensor networks for the Internet of Things", IMEC, Access Date: Oct. 27, 2020, URL:<https://www.imec-int.com/en/sensor-networks-for-IoT> (11 pages).

"Ultrasocic Time of Flight Sensing: Introducing the CH201 Long-Range Ultrasonic Time-of-Flight Sensor", TDK Chirp Microsystems, Chirp Microsystems, Inc., Access Date: Oct. 27, 2020, URL:<https://www.chirpmicro.com/> (10 pages).

"URM07-UART Low-Power Consumption Ultrasonic Sensor (20~750cm)", DFROBOT: Drive the Future, DFRobot, Date Accessed: Oct. 27, 2020, URL:<https://www.dfrobot.com/product-1057.html> (4 pages).

"PTC2202UK: Ultra-low-power, 1.8V, 1 deg. C accuracy, digital temperature sensor with I2C bus interface", NXP, NXP Semiconductors, Access Date: Oct. 27, 2020, URL:<https://www.nxp.com/products/sensors/ic-digital-temperature-sensors/ultra-low-power-1-8-v-1-deg-c-accuracy-digital-temperature-sensor-with-ic-bus-interface:PCT2202UK> (2 pages).

"STMicroelectronics Outlines Always-On 6-Axis Ultra-Performance Accelerometer/Gyroscope Combo that Drops the Power/Space Bar", ST Life.Augmented, STMicroelectronics, Sep. 2014, URL:<https://www.st.com/content/st_com/en/about/media-center/press-item.html/p3610d.html> (2 pages).

"Ultra-low Power Management", EnOcean Self-powered IoT, EnOcean GmbH, Access Date: Oct. 27, 2020, URL: <https://www.enocean.com/en/technology/energy-harvesting-wireless/> (2 pages).

"Self-Powered Industrial IoT", Everactive, Access Date: Oct. 27, 2020, URL:<https://everactive.com/#tech-page> (7 pages).

"Ultra-Low Power Management for IoT Devices", Article Library, Digi-Key Electronics, Jan. 2018, URL:<https://www.digikey.com/en/articles/ultra-low-power-management-for-iot-devices> (8 pages).

"Smaller, Smarter, Ultra-Low-Power Sensors Raise Potential for Energy Harvesting in Medical Implants", Article Library, Digi-Key Electronics, Sep. 2013, URL:<https://www.digikey.com/en/articles/smaller-smarter-ultralowpower-sensors-raise-potential-for-energy-harvesting-in-medical-implants> (7 pages).

"No Dilemma: Realtime Data, immediate Alerting and longest Battery Endurance", Technologies: Ultra Low Power Sensors, Pikkerton; Ein Unternehmen der Thelen-Gruppe, Pikkerton GmbH, Access Date: Oct. 27, 2020, URL: (https://www.pikkerton.com/Technologies/UltraLowPowerSensors/UltraLowPowerSensors.htm> (2 pages).

Kanegaonkar, Hari B., "Smart Technology Applications in Offshore Structural Systems: Status and Needs", Proceedings of the Ninth (1999) International Offshore and Polar Engineering Conference, The International Society of Offshore and Polar Engineers, May 1999, pp. 231-236 (6 pages).

Gilbertson, Eric et al., "A Thermally Actuated Gas-Lift Safety Valve", SPE 161930, SPE Production & Operations, Society of Petroleum Engineers, Feb. 2013, pp. 77-84 (8 pages).

Wang, Lei and F G Yuan, "Vibration energy harvesting by magnetostrictive material", Smart Materials and Structures, IOP Publishing, vol. 17, No. 045009, Jun. 2008 (14 pages).

Beidaghi, Majid and Yury Gogotsi, "Capacitive energy storage in micro-scale devices: recent advances in design and fabrication of

(56) References Cited

OTHER PUBLICATIONS micro-supercapacitors", Energy & Environmental Science, Royal Society of Chemistry, vol. 7, Jan. 2014, pp. 867-884 (18 pages).
Liu, Wei et al., "Flexible and Stretchable Energy Storage: Recent Advances and Future Perspectives", Materials Views, Advanced Materials, Wiley-VCH Verlag GmbH & Co. KGaA, 2016 (34 pages).
Wang, Peihong et al., "Complementary Electromagnetic-Triboelectric Active Sensor for Detecting Multiple Mechanical Triggering", Advanced Functional Materials, Wiley-Verlag GbmH & Co. KGaA, vol. 28, No. 1705808, 2018 (9 pages).
Wang, Faxing et al., "Latest advances in supercapacitors: from new electrode materials to novel device designs", Chemical Society Reviews, Royal Society of Chemistry, vol. 46, Sep. 2017, pp. 6816-6854 (39 pages).
Zhai, Shengli et al., "1D Supercapacitors for Emerging Electronics: Current Status and Future Directions", Author Manuscript, doi: 10.1002/adma.201902387 (36 pages).
Zhang, Xu et al., "MXene-based materials for electrochemical energy storage", Journal of Energy Chemistry, ScienceDirect, Elsevier B.V., vol. 27, Aug. 2017, pp. 73-85 (13 pages).
Zhang, Panpan et al., "Two-dimensional materials for miniaturized energy storage devices: from individual devices to smart integrated systems", Chemical Society Reviews, Royal Society of Chemistry, vol. 47, Sep. 2018, pp. 7426-7451 (26 pages).
Lin, Zong-Hong et al., "Triboelectric Nanogenerator as an Active UV Photodetector", Material Views, Advanced Functional Materials, Wiley-VCH Verlag GmbH & Co. KGaA, vol. 24, 2014, pp. 2810-2816 (7 pages).
Hu, Youfan and Zhong Lin Wang, "Recent Progress in Piezoelectric Nanogenerators as Sustainable Power Source in Self-powered Systems and Active Sensors", Nano Energy, ScienceDirect, Elsevier Ltd., vol. 14, May 2015 (26 pages).
Wen, Xiaonan et al., "Development and progress in piezoelectronics", Nano Energy, ScienceDirect, Elsevier Ltd., 2015 (20 pages).
Zhang, Xiao-Sheng et al., "High performance triboelectric nanogenerators based on large-scale mass-fabrication technologies", Nano Energy, ScienceDirect, Elsevier Ltd , vol. 11, Nov. 2014, pp. 304-322.
Kim, Dong Hyun et al., "In Vito Self-Powered Wireless Transmission Using Biocompatible Flexible Energy Harvesters", Energy Harvesting, Advanced Functional Materials, Wiley-VCH Verlag GmbH & Co. KGaA, vol. 27, No. 1700341, 2017 (8 pages).
Zhu, Dibin et al., "A credit card sized self powered smart sensor node", Sensors and Actuators A: Physical, ScienceDirect, Elsevier B.V., 2011, doi:10.1016/j.sna.2011.01.015 (9 pages).
Zhu, Guang et al., "Self-Powered, Ultrasensitive, Flexible Tactile Sensors Based on Contact Electrification", Nano Letters, ACS Publications, American Chemical Society, vol. 14, May 2014, pp. 3208-3213 (6 pages).
Chen, Yandong et al., "Energy Harvesting and Wireless Power Transmission by a Hybridized Electromagnetic-triboelectric Nanogenerator", Energy & Environmental Science, 2019, doi:10.1039-C9EE01245A, (8 pages).
Yang, Hongmei et al., "A full-packaged rolling triboelectric-electromagnetic hybrid nanogenerator for energy harvesting and building up self-powered wireless systems", Nano Energy, Nov. 2018, https://doi.org/10.1016/j.nanoen.2018.11.043 (26 pages).
Zhang, Shuo et al., "Strain-controlled power devices as inspired by human reflex", Nature Communications, 2020, https://doi.org/10.1038/s41467-019-14234-7 (9 pages).
Liu, Guanlin et al., "Wireless Electric Energy Transmission through Various Isolated Solid Media Based on Triboelectric Nanogenerator", Triboelectric Nanogenerators, Advanced Energy Materials, Wiley-VCH Verlag GmbH & Co. KGaA, No. 1703086, 2018 (7 pages).
Cao, Shengli et al., "Wireless Power Transmission Enabled by a Triboelectric Nanogenerator via a Magnetic Interaction", Energy Technology, Wiley-VCH Verlag GmbH & Co. KGaA, vol. 7, No. 1900503, 2019 (6 pages).
"STMicroelectronics LIS2D MEMS Digital Output Motion Sensors", ST life.augmented, Sep. 2018, URL: <https://www.mouser.com/new/sensors/motion-position-sensors/stm-lis2dh/n-6g7q6Z28tvc4> (3 pages).
Arms, S.W. et al., "Power Management for Energy Harvesting Wireless Sensors", SPIE Int'l Symposium on Smart Structures & Materials, Society of Photo-Optical Instrumentation Engineers, Mar. 2005 (9 pages).
Mallineni, Sai Sunil Kumar et al., "A Wireless Triboelectric Nanogenerator", 1702736, Communication: Triboelectric Nanogenerators, Advanced Energy Materials, Wiley-VCH Verlag GmbH & Co. KGaA, 2017 (7 pages).
Babayo, Aliyu Aliyu et al., "A Review on energy management schemes in energy harvesting wireless sensor networks", Renewable and Sustainable Energy Reviews, ScienceDirect, Elsevier Ltd., vol. 76, Mar. 2017, pp. 1176-1184 (9 pages).
Beeby, S P et al., "Energy harvesting vibration sources for microsystems applications", Review Article, Measurement Science and Technology, Institute of Physics Publishing, vol. 17, Oct. 2006, pp. R175-R195 (21 pages).
Briscoe, Joe and Steve Dunn, "Piezoelectric nanogenerators—a review of nanostructured piezoelectric energy harvesters", Nano Energy, ScienceDirect, Elsevier Ltd., vol. 14, Jan. 2015, pp. 15-29 (15 pages).
Lethien, Christophe et al., "Challenges and prospects of 3D micro-supercapacitors for powering the internet of things", Energy & Environmental Science, Royal Society of Chemistry, Oct. 2018 (20 pages).
Cheng, Gang et al., "Managing and maximizing the output power of a triboelectric nanogenerator by controlled tip-electrode air-discharging and application for UV sensing", Nano Energy, ScienceDirect, Elsevier Ltd., vol. 44, Dec. 2017, pp. 208-216 (9 pages).
Cook-Chennault, K A et al., "Topical Review: Powering MEMS portable devices—a review of non-regenerative and regenerative power supply systems with special emphasis on piezoelectric energy harvesting systems", Smart Materials and Structures, IOP Publishing, vol. 17, No. 043001, Jun. 2008 (33 pages).
Dong, Lin et al., "Vibration-Energy-Harvesting System: Transduction Mechanisms, Frequency Tuning Techniques, and Biomechanical Applications", Review: Energy Harvesting, Advanced Materials Technologies, Wiley-VCH Verlag GmbH & Co. KGaA, Aug. 2019 (28 pages).
Elvin, N et al., "A self-powered damage detection sensor", S07401, J. Strain Analysis, IMechE, vol. 38, No. 2, 2003, pp. 115-124 (10 pages).
Wang, Xianfu et al., "Flexible Energy-Storage Devices: Design Consideration and Recent Progress", Material Views, Advanced Materials, Wiley-VCH Verlag GmbH & Co. KGaA, vol. 26, 2014, pp. 4763-4782 (20 pages).
Guan, Mingjie and Wei-Hsin Liao, "Design and analysis of a piezoelectric energy harvester for rotational motion system", Envery Conversion and Management, ScienceDirect, Elsevier Ltd., vol. 111, Jan. 2016, pp. 239-244 (6 pages).
Han, Mengdi et al., "Magnetic-assisted triboelectric nanogenerators as self-powered visualized omnidirectional tilt sensing system", Scientific Reports, vol. 4, No. 4811, Apr. 2014 (7 pages).
Hester, Josiah and Jacob Sorber, "Flicker: Rapid Prototyping for the Batteryless Internet-of-Things", SenSys '17, Association for Computing Machinery, Nov. 2017 (13 pages).
Huang, Jun et al., "Wireless Power Transfer and Energy Harvesting: Current Status and Future Prospects", IEEE Wireless Communications, Aug. 2019, pp. 163-169 (7 pages).
Jeerapan, Itthipon and Sujittra Poorahong, "Review—Flexible and Stretchable Electrochemical Sensing Systems Materials, Energy Sources, and Integrations", Journal of the Electromechanical Society, The Electromechanical Society, IOP Publishing, vol. 167, No. 037573, Mar. 2020 (19 pages).
Jia, Rui et al., "Flexible on-chip micro-supercapacitors: Efficient power units for wearable electronics", Energy Storage Materials, ScienceDirect, Elsevier B.V., vol. 27, Jan. 2020, pp. 169-186 (18 pages).

(56) References Cited

OTHER PUBLICATIONS

Kang, Min-Gyu et al., "Review: Recent Progress on PZT Based Piezoelectric Energy Harvesting Technologies", Actuators, MDPI, vol. 5, No. 5, Feb. 2016 (17 pages).
Kyerematenng, Nana Amponash et al., "Microsupercapacitors as miniturized energy-storage components for on-chip electronics", Nature Nanotechnology, Macmillan Publishers Limited, vol. 12, Nov. 2016, pp. 7-15 (9 pages).
Chen, Zheng et al., "Comustion and emissions characteristics of high n-butanol/diesel ratio blend in a heavy-duty diesel engine and EGR impact", Energy Conversion and Management, ScienceDirect, Elsevier Ltd., vol. 78, Dec. 2013, pp. 787-795 (9 pages).
Lee, Jae Won et al., "Robust nanogenerators based on graft copolymers via control of dielectrics for remarkable output power enhancement", Applied Sciences and Engineering, Science Advances, American Association for the Advancement of Science, vol. 3, May 2017 (10 pages).
LaCost, Eddie, "Battery-Less NFC/RFID Temperature Sensing Patch", Application Report, SLOA212A, Texas Instruments Incorporated, Dec. 2014; Revised Feb. 2016 (12 pages).
"TI Designs: Multi-Standard CC2650 SensorTag Design Guide", TIDU862, Texas Instruments Incorporated, Mar. 2015 (40 pages).
"ADXL362 Data Shee", Analog Devices: Micropower, 3-Axis, ±2 gl±4 gl±8 g Digital Output MEMS Accelerometer, Analog Devices, Inc., Aug. 2012 (43 pages).
Frantzke, Andre, "A Low-Power Battery-Less Wireless Temperature and Humidity Sensor for the TI PALFI Device", Application Report: SWRA395, Texas Instruments Incorporated, Nov. 2011 (21 pages).
"DRV5032 Ultra-Low-Power Digital-Switch Hall Effect Sensor", SLVSDC7E, Texas Instruments Incorporated, Apr. 2017, Revised Jan. 2020 (40 pages).
"MEMS digital output motion sensor: ultra-low-power-high-performance 3-axis 'nano' accelerometer", LIS3DH, Datasheet—production data, DocID17530, Rev.2, ST: life.augmented, Dec. 2016 (54 pages).
Liu, Qi et al., "Wireless Single-Electrode Self-Powered Piezoelectric Sensor for Monitoring", ACS Applied Materials & Interfaces, American Chemical Society, vol. 12, Jan. 2020, pp. 8288-8295 (8 pages).
Najaf, K. et al., "Microsystems for Energy Harvesting", W1D.001, Transducers'11, IEEE, Jun. 2011, pp. 1845-1850 (6 pages).
Yang, Peihua and Wenjie Mai, "Flexible solid-state electrochemical supercapacitors", Nano Energy, ScienceDirect, Elsevier Ltd., vol. 8, Jun. 2014, pp. 274-290 (17 pages).
Khan, Asif Abdullah et al., "A self-powered multi-broadcasting wireless sensing system realized with an all-in-one triboelectric nanogenerator", Nano Energy, ScienceDirect, Elsevier Ltd., vol. 62, Jun. 2019, pp. 691-699 (9 pages).
Nechibvute, Action et al., "Review Article: Piezoelectric Energy Harvesting Devices: An Alternative Energy Source for Wireless Sensors", Article ID 853481, Smart Materials Research, Hindawi Publishing Corporation, 2012 (13 pages).
Park, Kwi-Il et al., "Highly-Efficient, Flexible Piezoelectric PZT Thin Film Nanogenerator on Plastic Substrates", Advanced Materials, Materials Views, Wiley-VCH Verlang GmbH & Co. KGaA, vol. 26, 2014, pp. 2514-2520 (7 pages).
Patil, Swati and Dong-Weon Lee, "Topical Review: Status review on the MEMS-based flexible supercapacitors", Journal of Micromechanics and Microengineering, IOP Publishing, vol. 29, No. 093001, Jun. 2019 (21 pages).
Selvan, Krishna Veni et al., "Micro-scale energy harvesting devices: Review of methodological performances in the last decade", Renewable and Sustainable Energy Reviews, ScienceDirect, Elsevier Ltd., vol. 54, Nov. 2015, pp. 1035-1047 (13 pages).
Shaikh, Faisal Karim and Sherali Zeadally, "Energy harvesting in wireless sensor networks: A comprehensive review", Renewable and Sustainable Energy Reviews, ScienceDirect, Elsevier Ltd., vol. 55, Dec. 2015, pp. 1041-1054 (14 pages).
Shenck, Nathan S. and Joseph A. Paradiso, "Energy Scavenging with Shoe-Mounted Piezoelectronics", IEEE Micro, IEEE, May-Jun. 2001, pp. 30-42 (13 pages).
Siddique, Abu Raihan Mohammad et al., "A comprehensive review on vibration based micro power generators using electromagnetic and piezoelectric transducer mechanisms", Energy Conversion and Management, ScienceDirect, Elsevier Ltd., vol. 106, Oct. 2015, pp. 728-747 (20 pages).
Li, Bodong et al., "Implementation of a Drilling Microchip for Downhole Data Aquisition", SPE-186330-MS, Society of Petroleum Engineers, Oct. 2017 (9 pages).
Tang, Wei et al., "A power-transformed-and-managed triboelectric nanogenerator and its applications in a self-powered wireless sensing node", Nanotechnology, IOP Publishing, vol. 25, No. 225402, May 2014 (7 pages).
Dekkers, Gert et al., "The Sins Database for Detection of Daily Activities in a Home Environment Using an Acoustic Sensor Network", Detection and Classification of Acoustic Scenes and Events, Nov. 2017 (5 pages).
Toprak, Alperen and Onur Tigli, "Piezoelectric energy harvesting: State-of-the-art and challenges", Applied Physics Reviews, AIP Publishing LLC, vol. 1, No. 031104, Sep. 2014 (14 pages).
Dubal, Deepak P. et al., "Towards flexible solid-state supercapacitors for smart and wearable electronics", Chemical Society Reviews, Royal Society of Chemistry, vol. 47, Feb. 2018, pp. 2065-2129 (65 pages).
Schaijk, R. van et al., "A MEMS vibration energy harvester for automotive applications", Smart Sensors, Actuators, and MEMS VI, Eds. Ulrich Schmid et al., SPIE, vol. 8763, No. 876305-1, 2013 (10 pages).
Vasandani, Paresh et al., "Using a synchronous switch to enhance output performance of triboelectric nanogeneratores", Nano Energy, ScienceDirect, Elsevier Ltd., vol. 43, Nov. 2017, pp. 210-218 (9 pages).
Peng, Limin et al., "Research Article: Mechanic and Acoustic Properties of the Sound-Absorbing Material Made from Natural Fiber and Polyester", Article ID 274913, Advances in Materials Science and Engineering, Hindawi Publishing Corporation, vol. 2015 (5 pages).
Wang, Zhong Lin et al., "Progress in triboelectric nanogenerators as new energy technology and self-powered sensors", Energy & Environmental Science, RSC Publishing, The Royal Society of Chemistry, Jan. 2014 (41 pages).
Wang, Zhong Lin et al., "Progress in nanogenerators for portable electronics", Materials Today, Elsevier Ltd., vol. 15, No. 12, Dec. 2012, pp. 532-543 (12 pages).
Wang, Sihong et al., "Nanoscale Triboelectric-Effect-Enabled Energy Conversion for Sustainability Powering Portable Electronics", Nano Letters, ACS Publications, American Chemical Society, vol. 12, Nov. 2012, pp. 6339-6346 (8 pages).
Wang, Zhong Lin and Wenzhou Wu, "Nanotechnolgy-Enabled Energy Harvesting for Self-Powered Micro-/Nanosystems", Angewandte Reviews, Angewandte Chemie: International Edition, Wiley-VCH Verlag GmbH & Co. KGaA, vol. 51, 2012, pp. 2-24 (23 pages).

* cited by examiner

SELF-POWERED ACTIVE VIBRATION AND ROTATIONAL SPEED SENSORS

FIELD OF THE DISCLOSURE

The present invention relates to oil and gas well drilling monitoring systems and, in particular, vibration and speed sensor systems for downhole drilling environments.

BACKGROUND OF THE DISCLOSURE

Logging-, surveying- and drilling-dynamics sensor tools are used in nearly all the onshore and offshore oil and gas wells. In onshore wells, the measurement while drilling (MWD) and logging while drilling (LWD) tools are typically used in directional drilling. In offshore wells generally only MWD tools are used. Both MWD and LWD tools utilize batteries, turbines, or both to power the sensor and electronic components. MWD and LWD systems can obtain logging data while drilling but are expensive, bulky, and lengthy tools.

Wireline logging operations are also used in both onshore and offshore drilling operations. Obtaining logging data by wireline is a costly process since the drilling assembly has to be pulled out of the wellbore first to run the wireline assembly into the wellbore to take measurements. This also means that logging data cannot be obtained while drilling. There is also a risk of the wireline assembly getting stuck inside the hole along with all its expensive sensors and instrumentation thereby significantly adding to the cost of drilling a well.

In wireline operations the power to the wireline sensors and instrumentation are provided by a wired power line that extends from the power source at the surface all the way down to the well depth. The power to MWD and LWD is provided by rechargeable lithium battery packs, a turbine, an alternator, or a combination of these. One of the major drawbacks of lithium batteries is their cost. For example, they are significantly more expensive to manufacture than nickel cadmium batteries and this is even more pronounced when they have to be mass produced for various applications. In order to meet the factory demand more fossil fuels might be required to produce batteries. Moreover, lithium batteries suffer from ageing, which depends on the number of charge-discharge cycles the battery has undergone. However, eventually batteries expire resulting in large volumes of contaminated waste. Therefore, the usage of lithium batteries not only has significant costs in their production life cycle but also has a negative impact on the environment. Mechanical failure rates of batteries are also generally high and can be expected to be higher downhole (i.e., down the wellbore) given the harsh environments they are exposed to. Turbines/alternators harness the kinetic energy of a fluid flow to generate electricity. Therefore, they can only generate electricity when there is a fluid flow inside a drill string, and the power produced depends on the speed of the fluid flow. Heavy muds and lost circulation material in a drill string for example can significantly reduce the speed of flow in a drill string and might even block the pathway through the turbines/alternators.

Data obtained by the LWD/MWD does not stay constant; rather, it changes over time due drilling and other operations performed inside a wellbore. For example, logging data measured by LWD/MWD sensors at certain depths along a wellbore change over time because they are influenced by drilling fluid characteristics such as salinity, density, solids concentrations, etc., together with temperature, pressure, size and rugosity of the wellbore, tool alignment, logging speed, as well as the lithology, pore size, type of fluid in the pores and the geologic structure and geometry of the rock formation. Therefore, it is not possible to obtain real-time information of these parameters at these depths unless the LWD/MWD sensors are run again at these depths again, which is very costly and not feasible.

It is with respect to these and other considerations that the disclosure made herein is presented.

SUMMARY OF THE DISCLOSURE

According to an aspect of the present disclosure, a self-powered active sensing system is disclosed. The self-powered active sensing system comprises a speed sensor for measuring rotational speed of a drill string. In particular, the speed sensor includes a ring shaped first structure configured to be attached around a portion of the drill string. More specifically, the first structure extends circumferentially about the drill string and rotates about a rotational axis of the drill string. Additionally, the first structure includes a bearing extending from an outer surface of the first structure.

The speed sensor further comprises a housing disposed about the first structure and the portion of the drill string. The housing includes an interior wall that defines a hollow central opening of a sufficient diameter for the drill string to extend therethrough. Additionally, the interior wall is shaped to define an annular groove extending circumferentially about the central opening. The ring is housed at least partially within the annular groove and rotatable relative to the housing.

Additionally, the speed sensor comprises a moveable member that is housed within a recess formed in the interior wall of the housing and extends into the annular groove. The moveable member opposes the bearing. The moveable member and the bearing are arranged such that, upon rotation of the first structure relative to the housing, the bearing is configured to contact the moveable member and the moveable member is configured to translate into the recess as a result of the contact with the bearing. Furthermore, the moveable member is configured to generate an analog electrical signal representative of the rotational speed of the drill string (analog speed signal) as a function of contact between the bearing and the moveable member.

According to a further aspect of the present disclosure, a self-powered active sensing system for use in a downhole drilling environment comprises a vibration sensor for measuring vibration of a drill string. More specifically, the vibration sensor includes a housing shaped to extend circumferentially about the drill string thereby allowing the drill string to rotate within a central opening of the cavity. Additionally, the housing includes an internal wall within the housing shaped to define an annular cavity extending circumferentially through the housing. A screen is also provided on a surface of the internal wall defining the annular cavity.

Furthermore, the vibration sensor includes a ring structure that is generally ring shaped. The ring structure is mounted within the annular cavity and coaxial with the annular cavity. The ring structure also includes a spherical bearing extending from an outer surface of the first structure that faces the screen, wherein the spherical bearing is configured to contact the screen. Furthermore, a plurality of springs support the ring within the annular cavity of the housing. The springs are configured to maintain the spherical bearing in contact with the screen and enable the spherical bearing to move across the screen in one or more directions as a function of vibration forces acting upon the housing. Moreover, the screen is configured to generate an analog electrical signal (analog vibration signal) as a function of the movement of the spherical bearing across the screen in one or more directions. The analog vibration signal is representative of a position of the spherical bearing on the screen and thereby representative of the vibration of the drill string.

According to a further aspect of the present disclosure, a self-powered active sensing system is disclosed. The system comprises a housing configured to house a speed sensor for measuring rotational speed of a drill string and a vibration sensor for measuring vibration of the drill string. In particular, the system comprises the housing, which is disposed circumferentially about a portion of a drill string. The housing includes an interior wall that defines a hollow central opening of a sufficient diameter for the drill string to extend therethrough. The interior wall of the housing is also shaped to define an annular groove extending circumferentially about the central opening. The housing further comprises an internal wall that is shaped to define an annular cavity within the housing and that is extending circumferentially through the housing.

The system further comprises the speed sensor for measuring rotational speed of the drill string. The speed sensor includes a ring shaped first structure configured to be attached around the portion of the drill string. The first structure extends circumferentially about the drill string and rotates about a rotational axis of the drill string. Additionally, the first structure includes a bearing extending from an outer surface of the first structure. The ring is housed at least partially within the annular groove defined by the interior wall of the housing and is rotatable relative to the housing.

The speed sensor further comprises a moveable member housed within a recess formed in the interior wall of the housing and that extends into the annular groove. The moveable member opposes the bearing and, upon rotation of the first structure relative to the housing, the bearing is configured to contact the moveable member and the moveable member is configured to translate into the recess as a result of the contact. Moreover, the moveable member is configured to generate an analog electrical signal representative of the rotational speed of the drill string (analog speed signal) as a function of contact between the bearing and the moveable member.

The system further comprises the vibration sensor for measuring vibration of a drill string. The vibration sensor includes a screen provided on a surface of the internal wall defining the annular cavity within the housing. Additionally, the vibration sensor includes a ring structure that is generally ring shaped and that is mounted within the annular cavity and coaxial with the annular cavity. More specifically, the ring structure includes a spherical bearing extending from an outer surface of the ring structure that faces the screen, wherein the spherical bearing is configured to contact the screen.

The vibration sensor also includes a plurality of springs supporting the ring within the annular cavity of the housing. In particular, the springs are configured to maintain the spherical bearing in contact with the screen and enable the spherical bearing to move across the screen in one or more directions as a function of vibration forces acting upon the housing. As a function of the movement of the spherical bearing across the screen in one or more directions, the screen is configured to generate an analog electrical signal (analog vibration signal) which is representative of a position of the spherical bearing on the screen and thereby representative of the vibration of the drill string.

According to a further aspect according to the present disclosure, a self-powered system for real-time distributed monitoring of a downhole drilling environment is disclosed. The system comprises a plurality of the foregoing self-powered active sensing systems (SASS) devices which comprise the speed sensor device and the self-powered active vibration sensor. Moreover, the plurality of self-powered active sensing systems are distributed along a length of the drill string.

These and other aspects, features, and advantages can be appreciated from the accompanying description of certain embodiments of the invention and the accompanying drawing figures and claims.

BRIEF DESCRIPTION OF THE DRAWING FIGURES

Figure 1A:
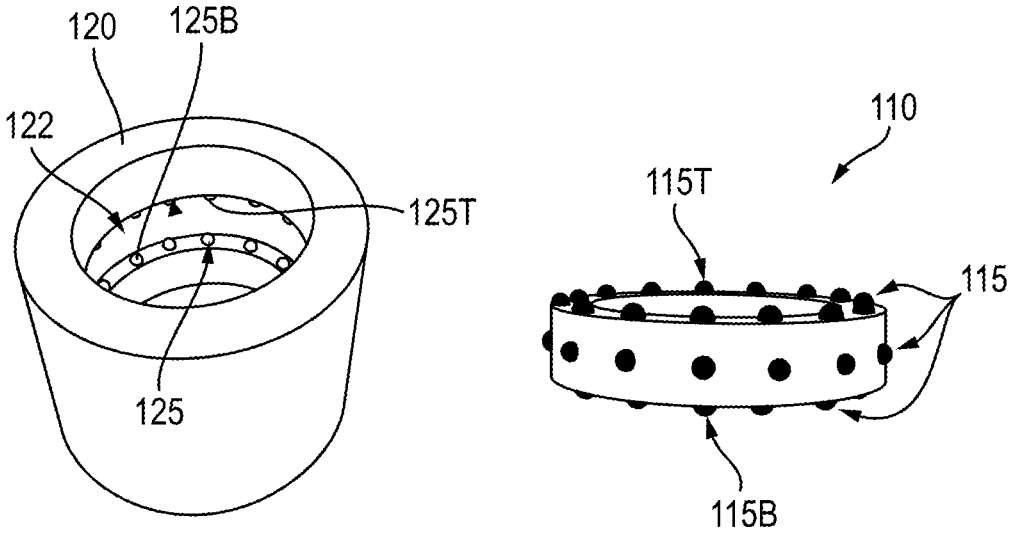
FIG. 1A is perspective view exploded diagram of an exemplary rotational speed sensor in accordance with one or more disclosed embodiments.
Figure 1B:
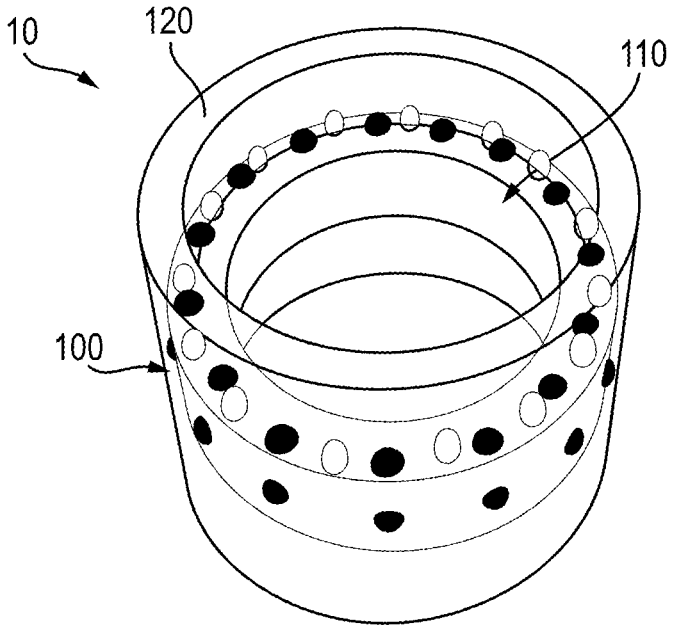
FIG. 1B is a perspective view of an assembled rotational speed sensor in accordance with one or more disclosed embodiments.
Figure 2A:
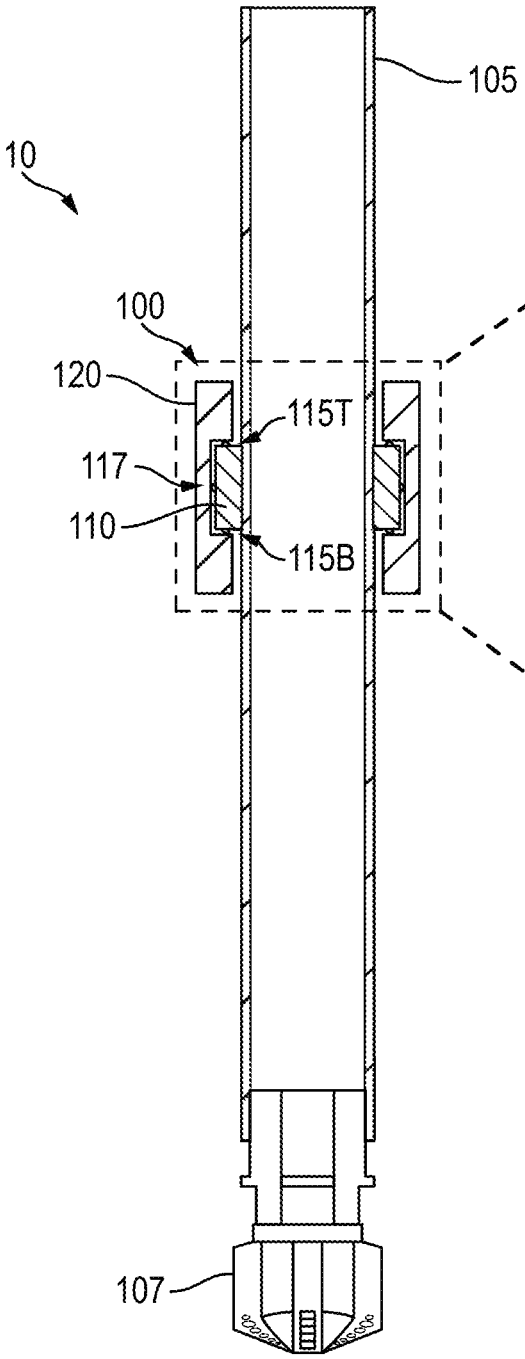

FIG. 2A includes a cross-sectional side-view of the exemplary speed sensor of FIG. 1A-1B provided on a drill string in accordance with one or more disclosed embodiments.

Figure 2B:
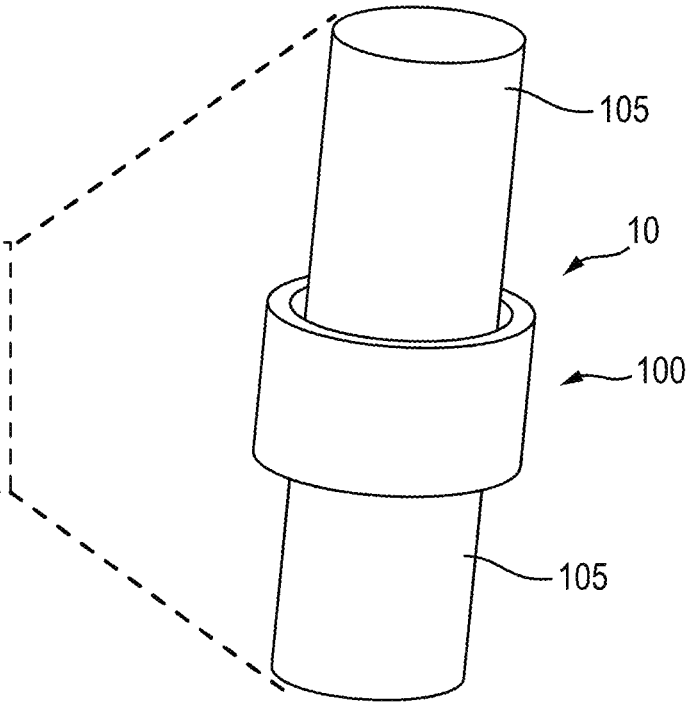
Figure 2C:
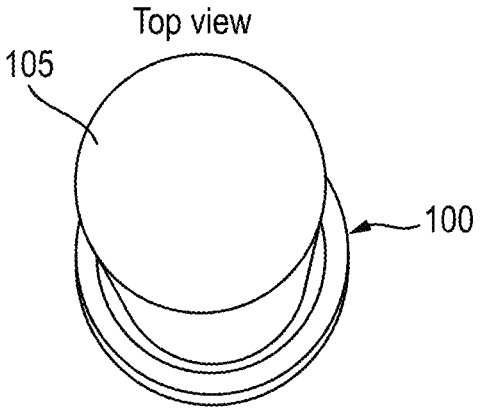
Figure 3:
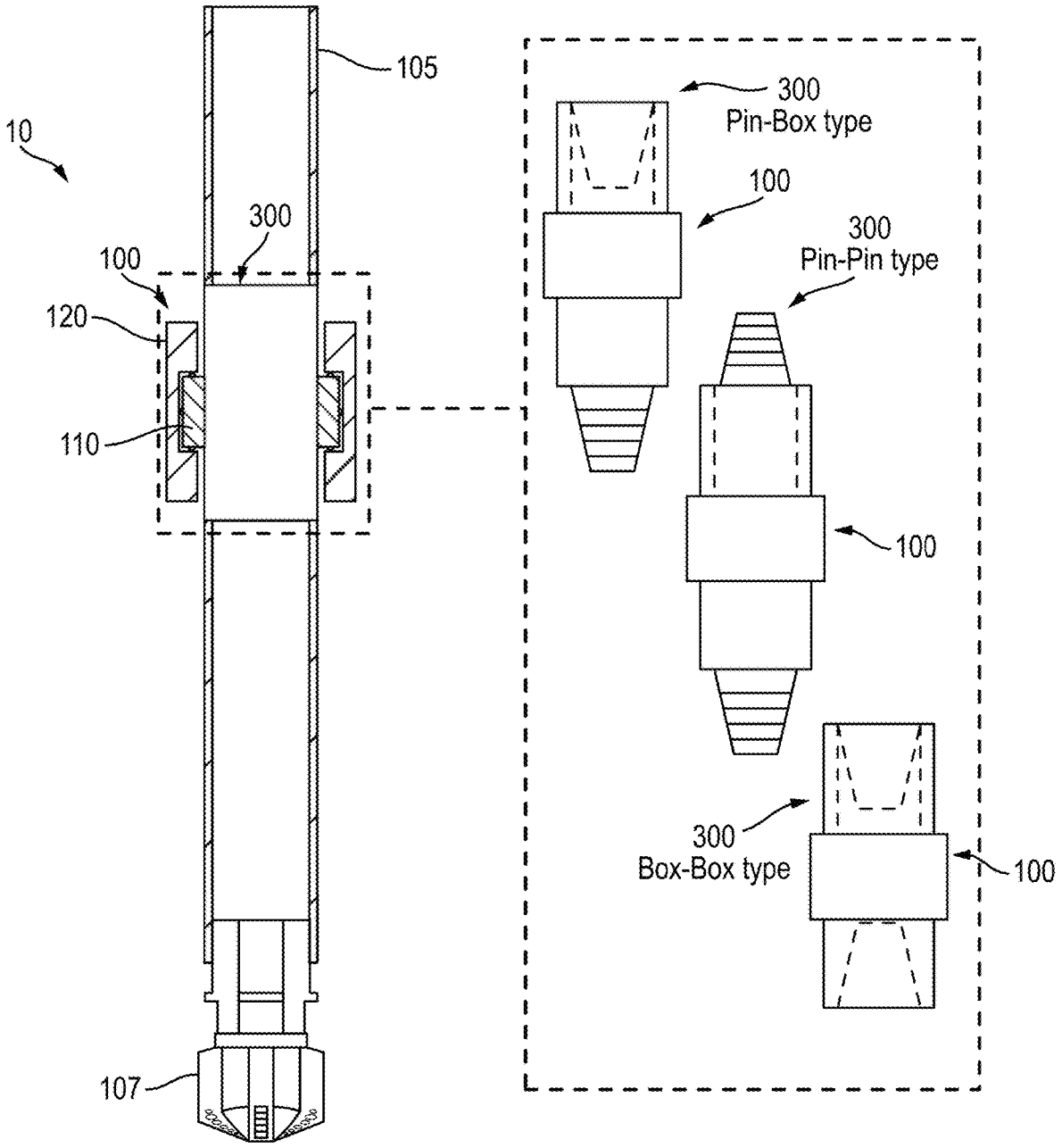
Figure 4A:
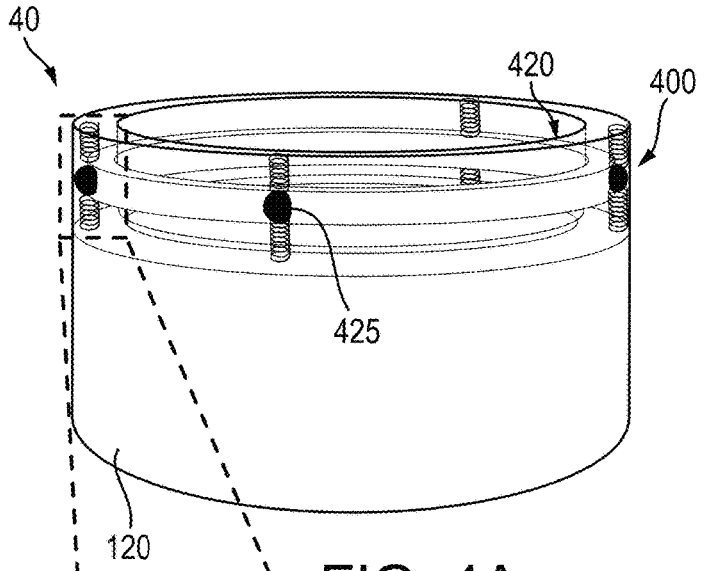
Figure 4B:
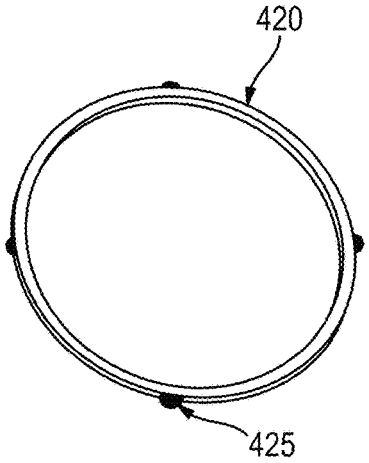
Figure 4C:
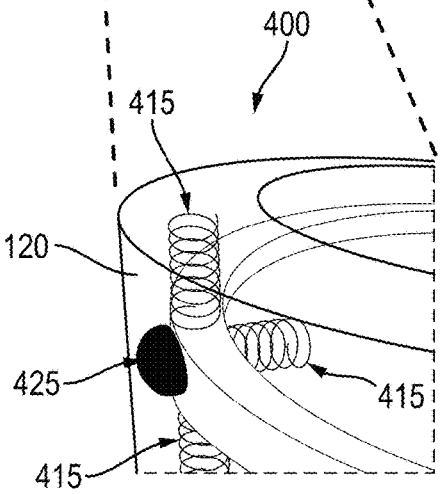
Figure 4D:
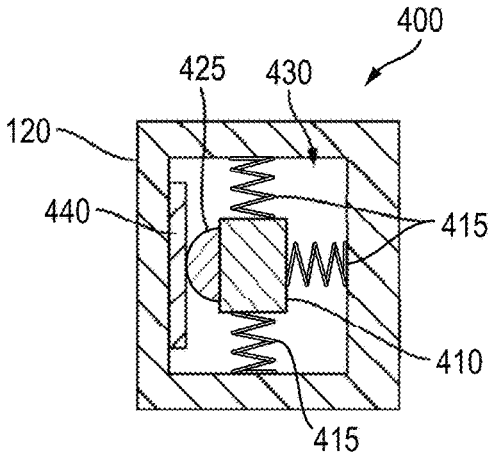
Figure 5A:
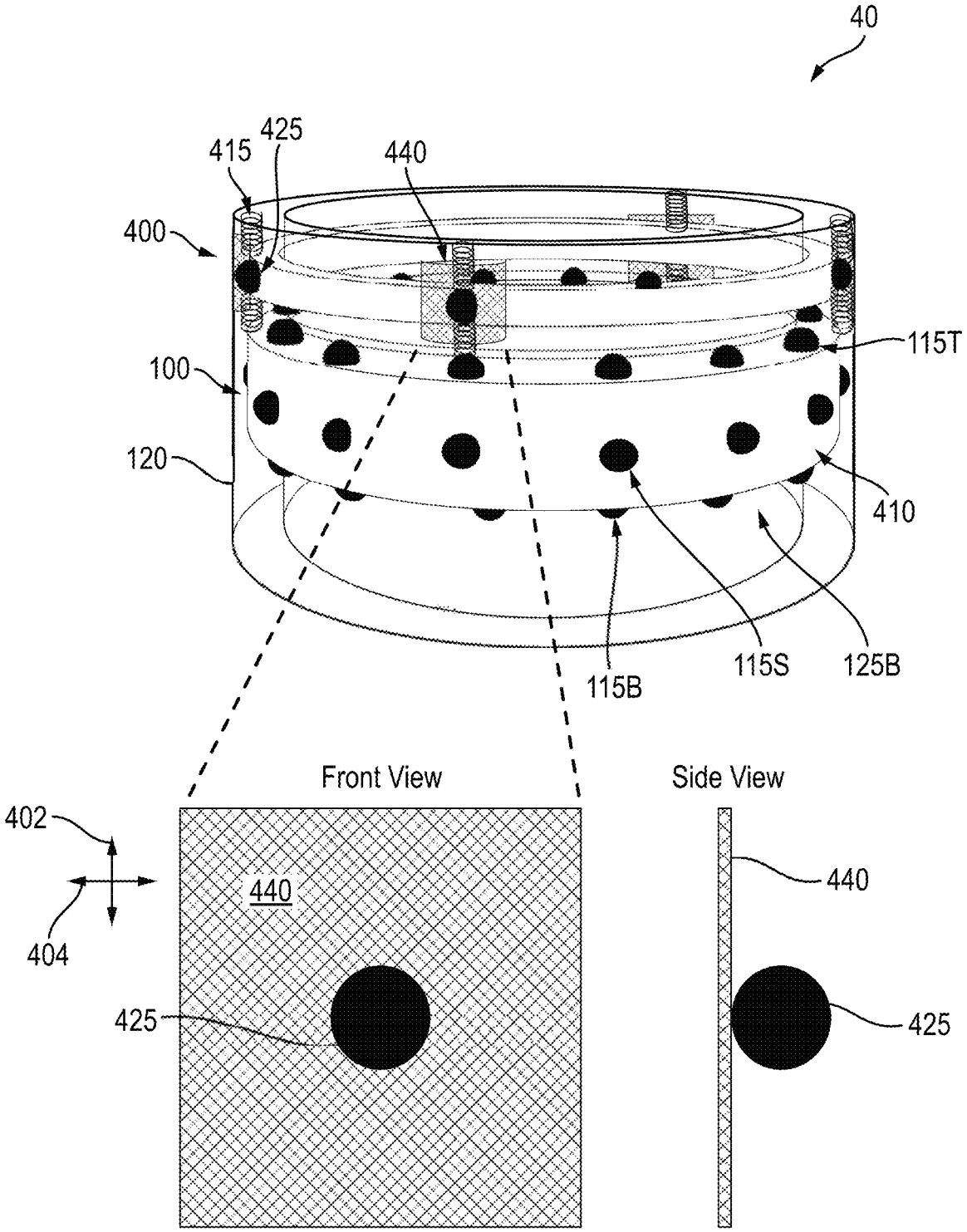
Figure 5B:
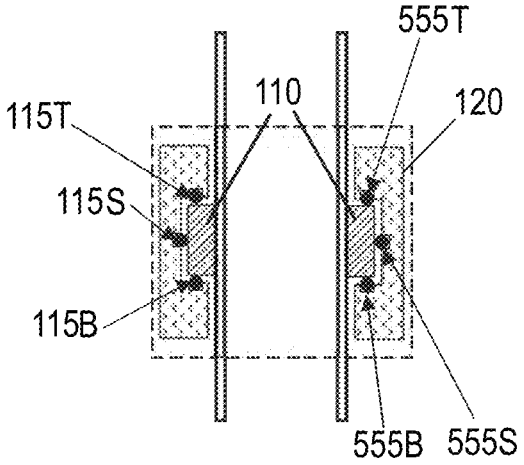
Figure 5C:
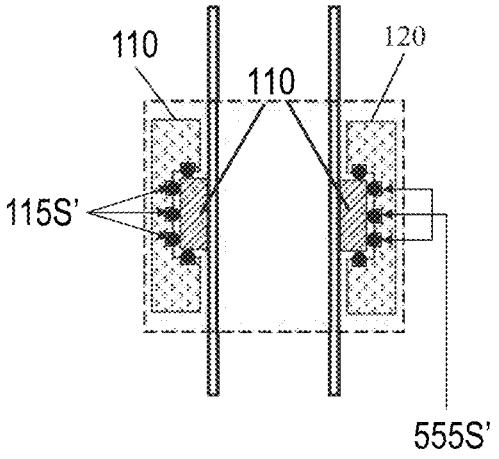
Figure 6A:
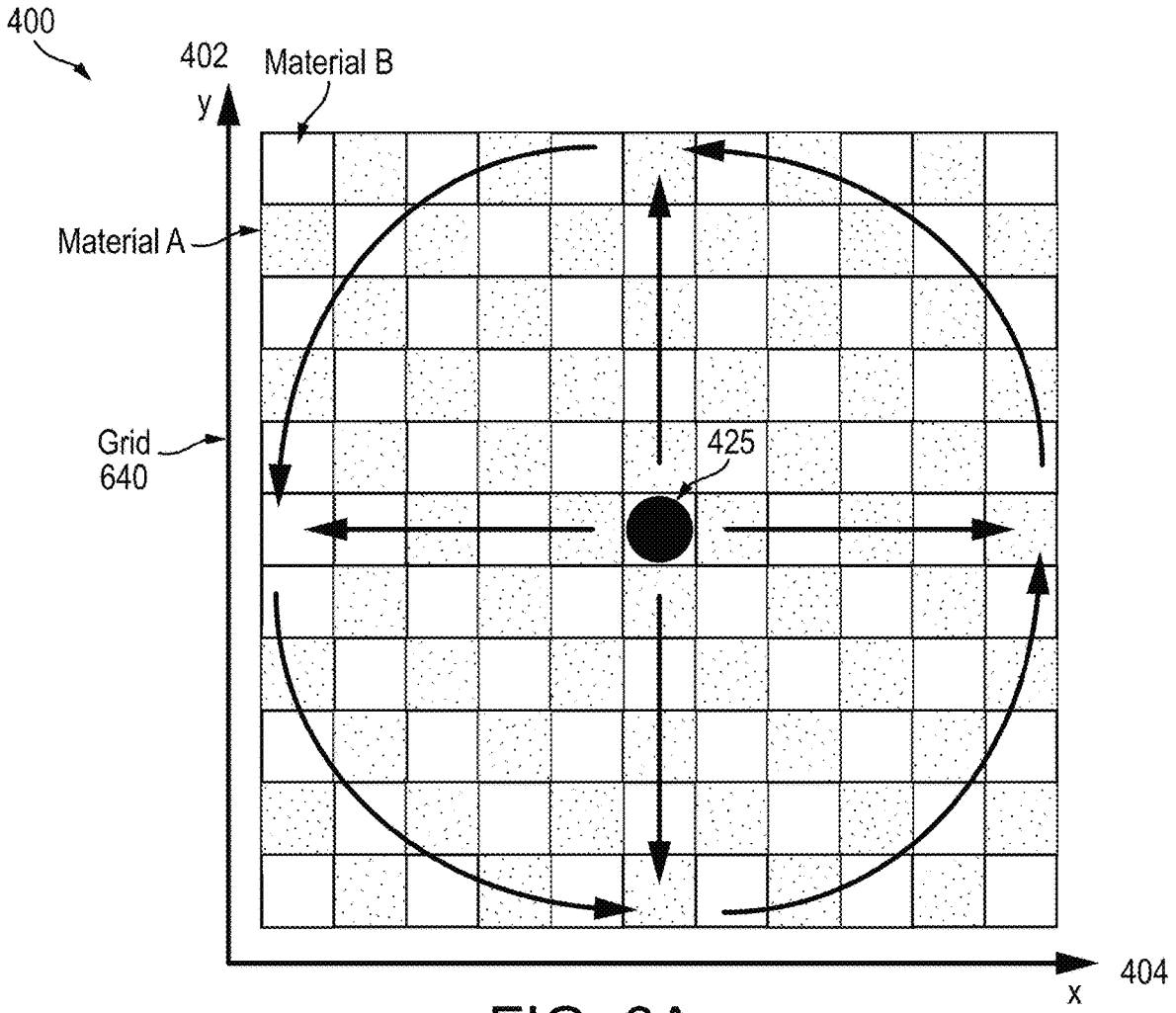
Figure 6B:
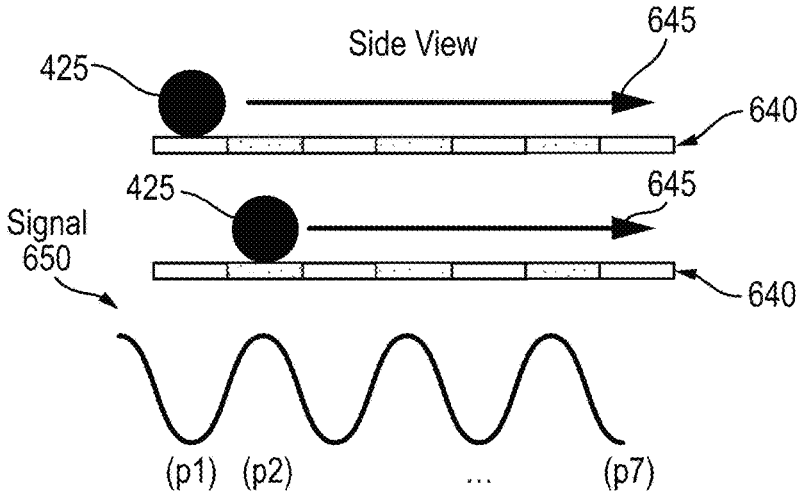
Figure 6C:
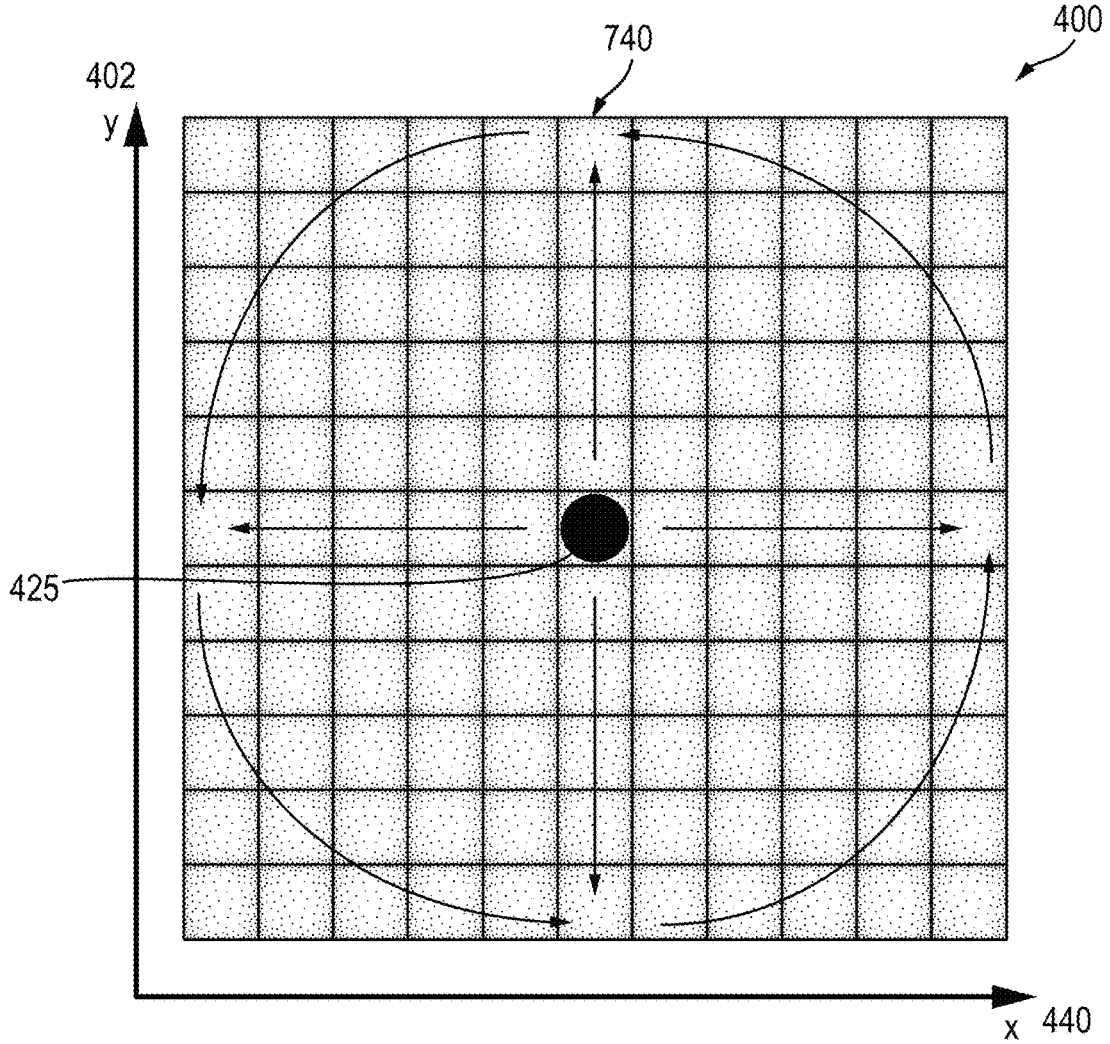
Figure 6D:
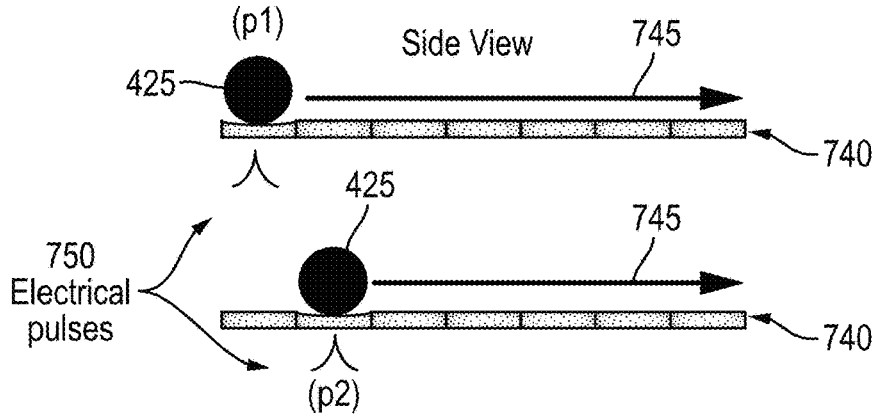
Figure 7A:
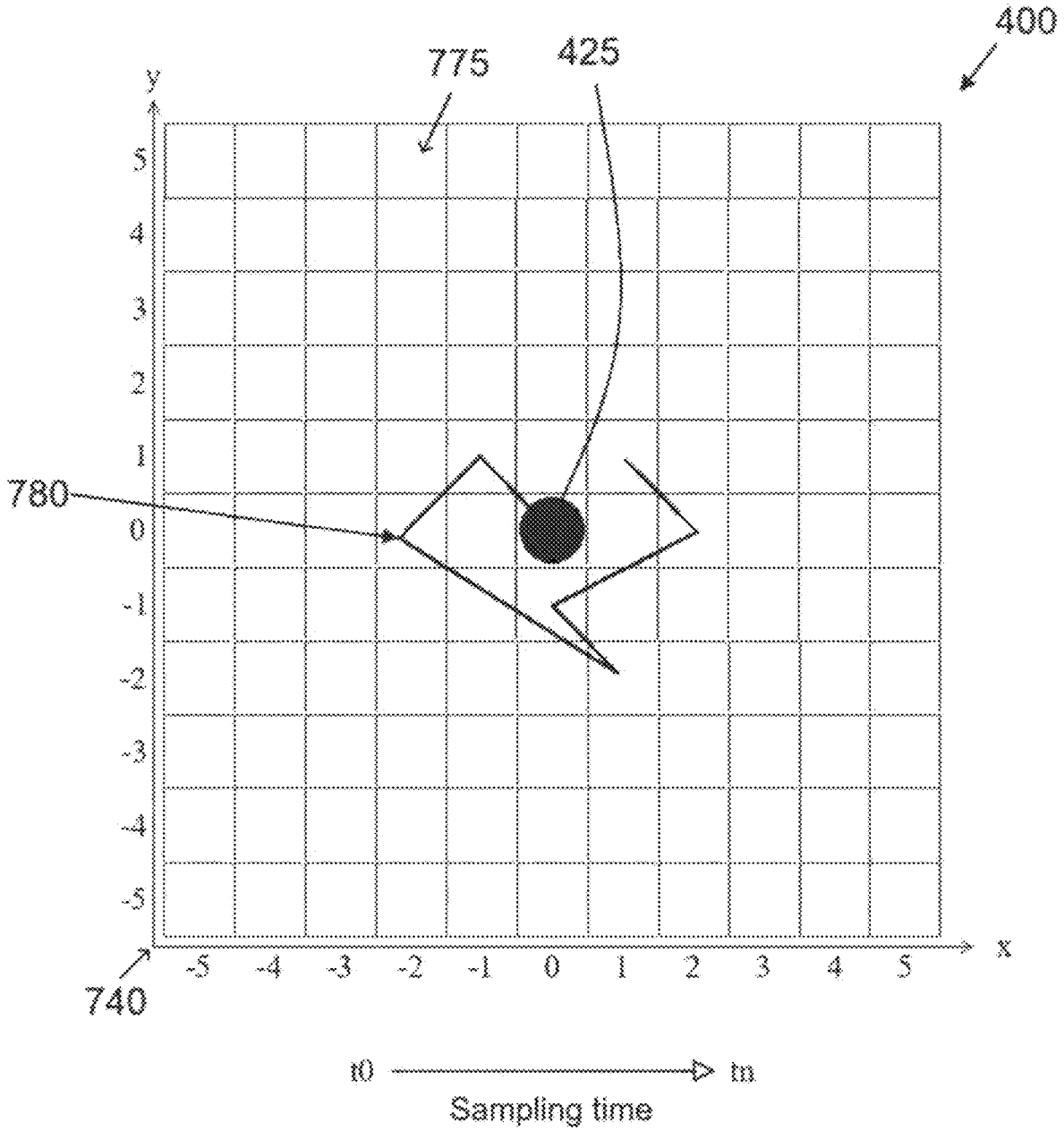
Figure 7B:
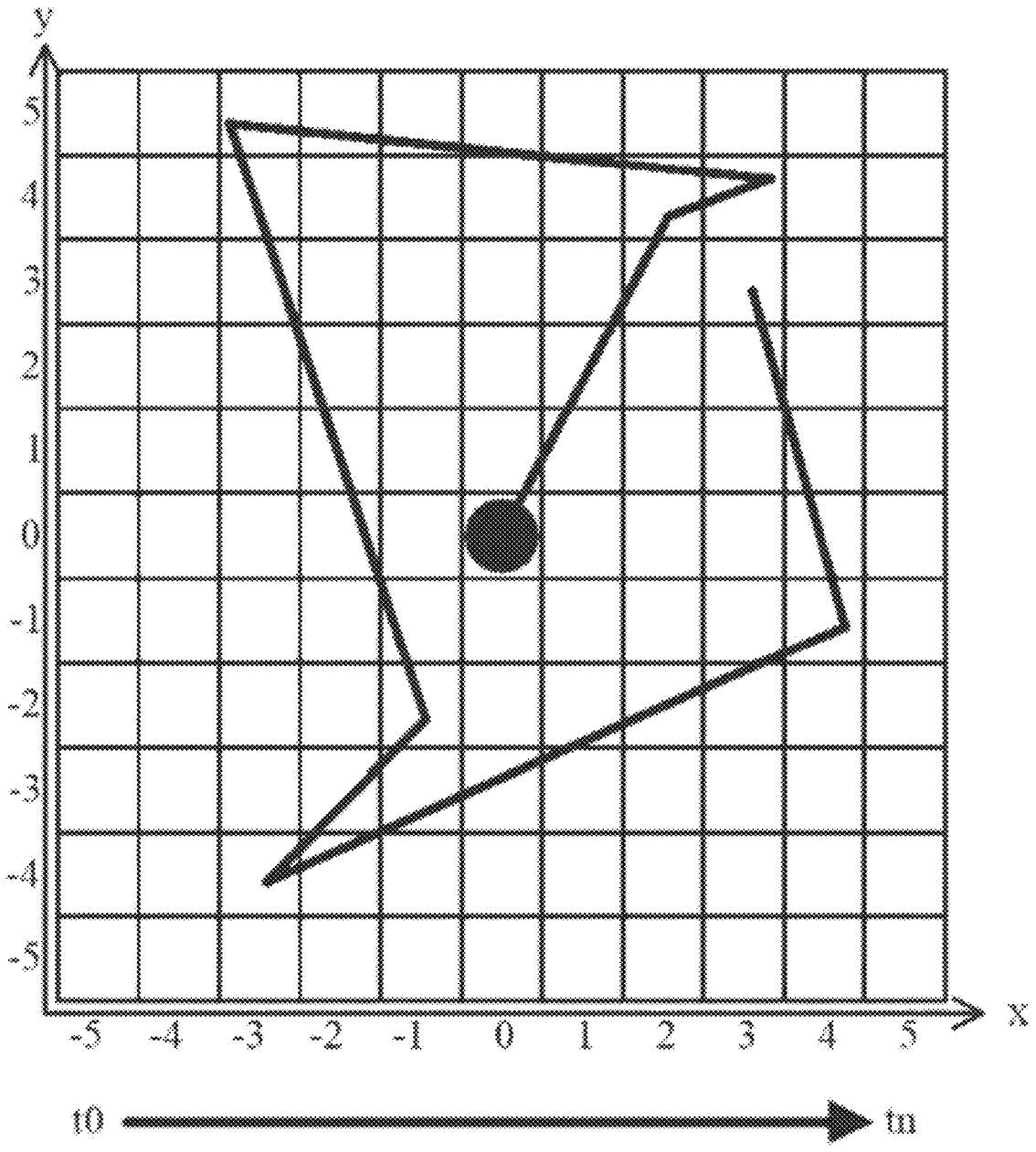
Figure 7C:
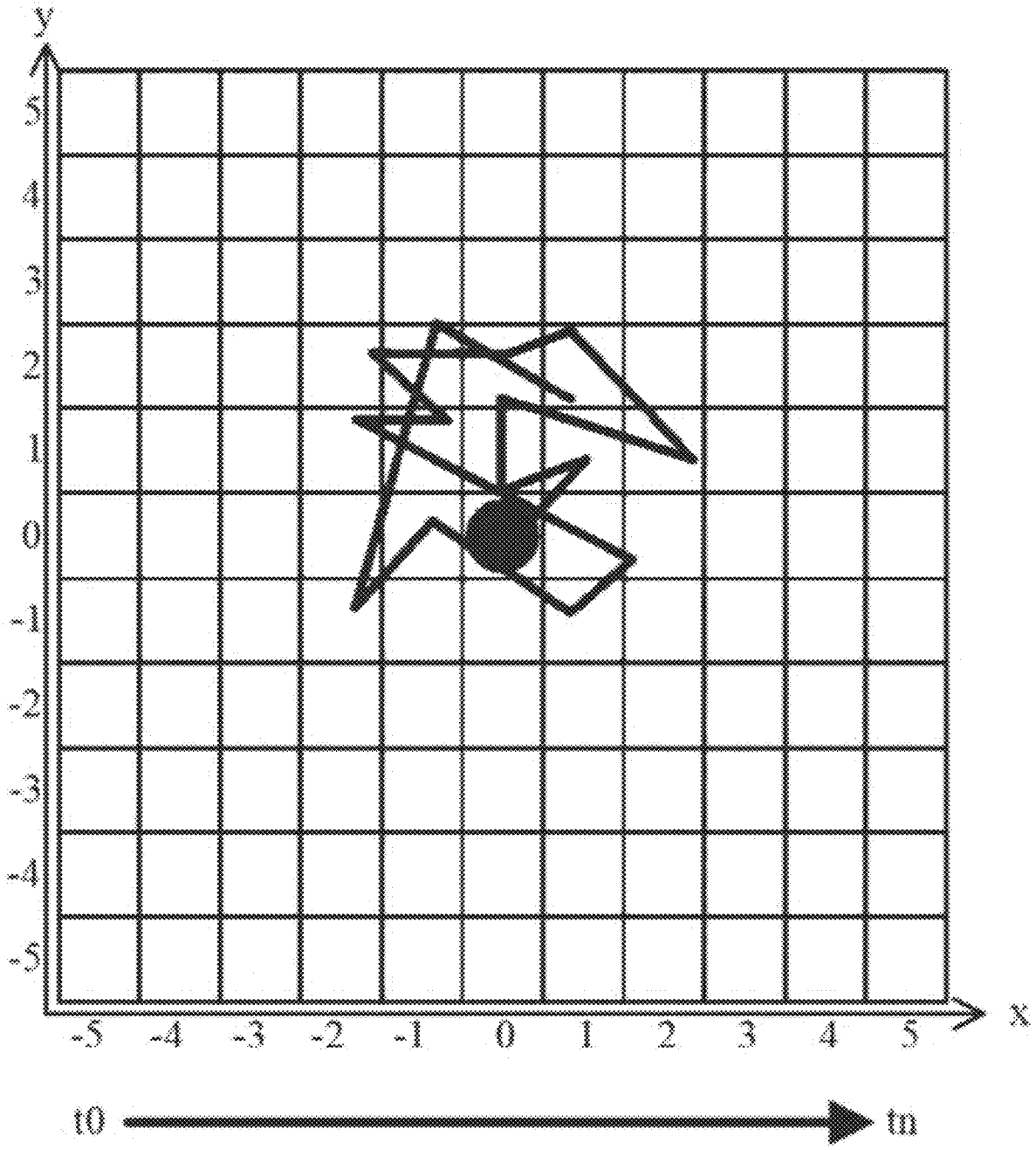
Figure 7D:
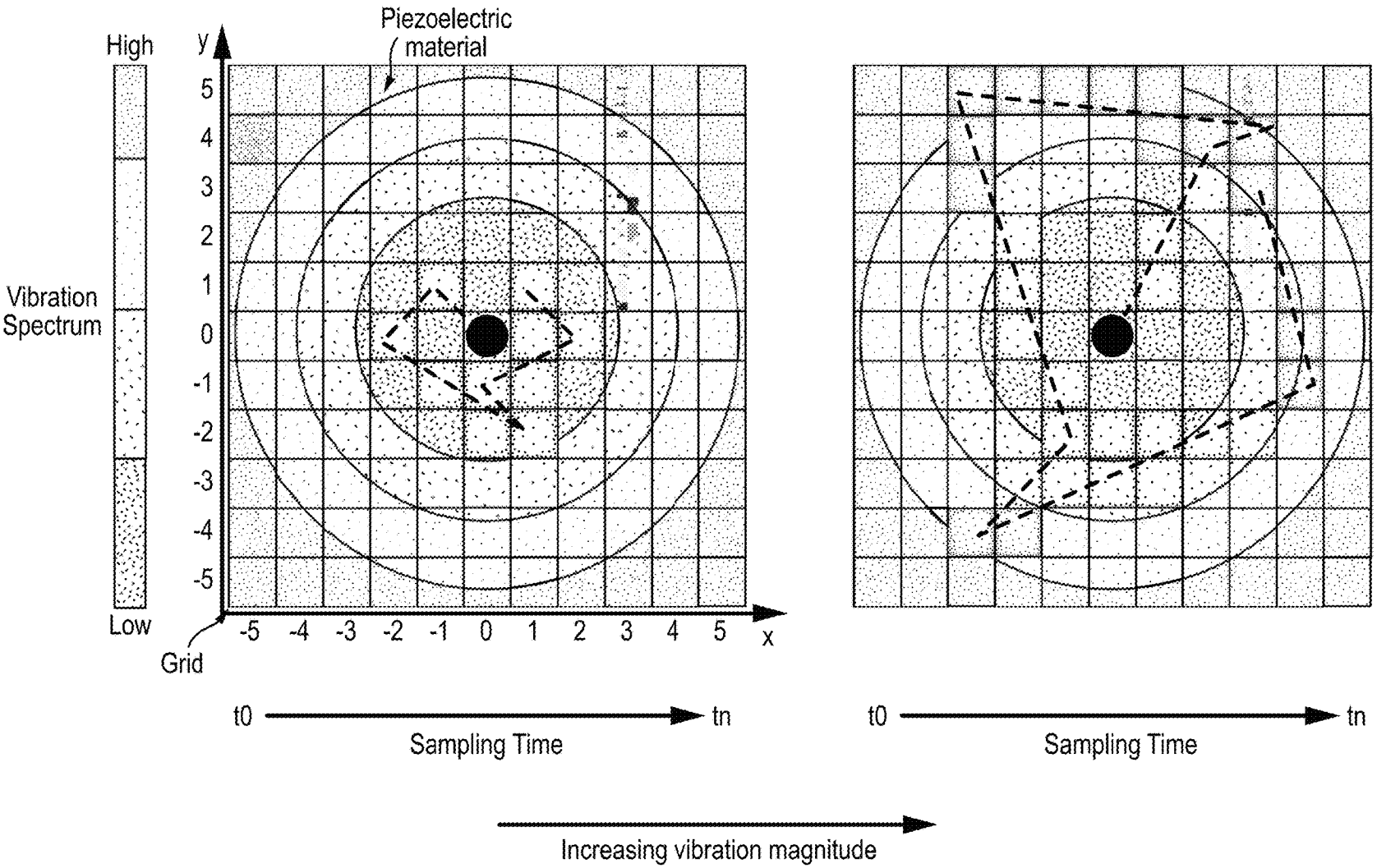
Figure 7E:
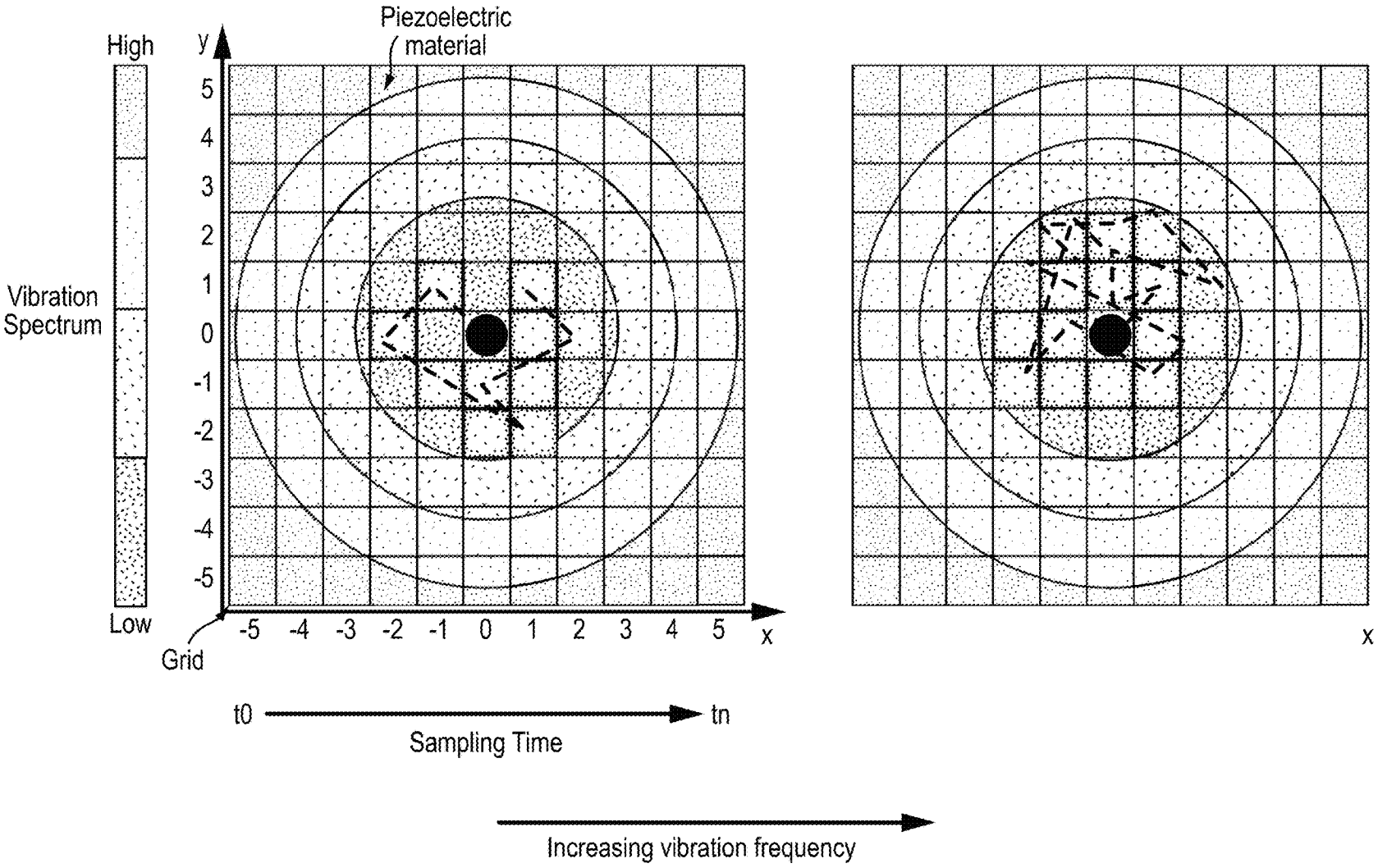
Figure 7F:
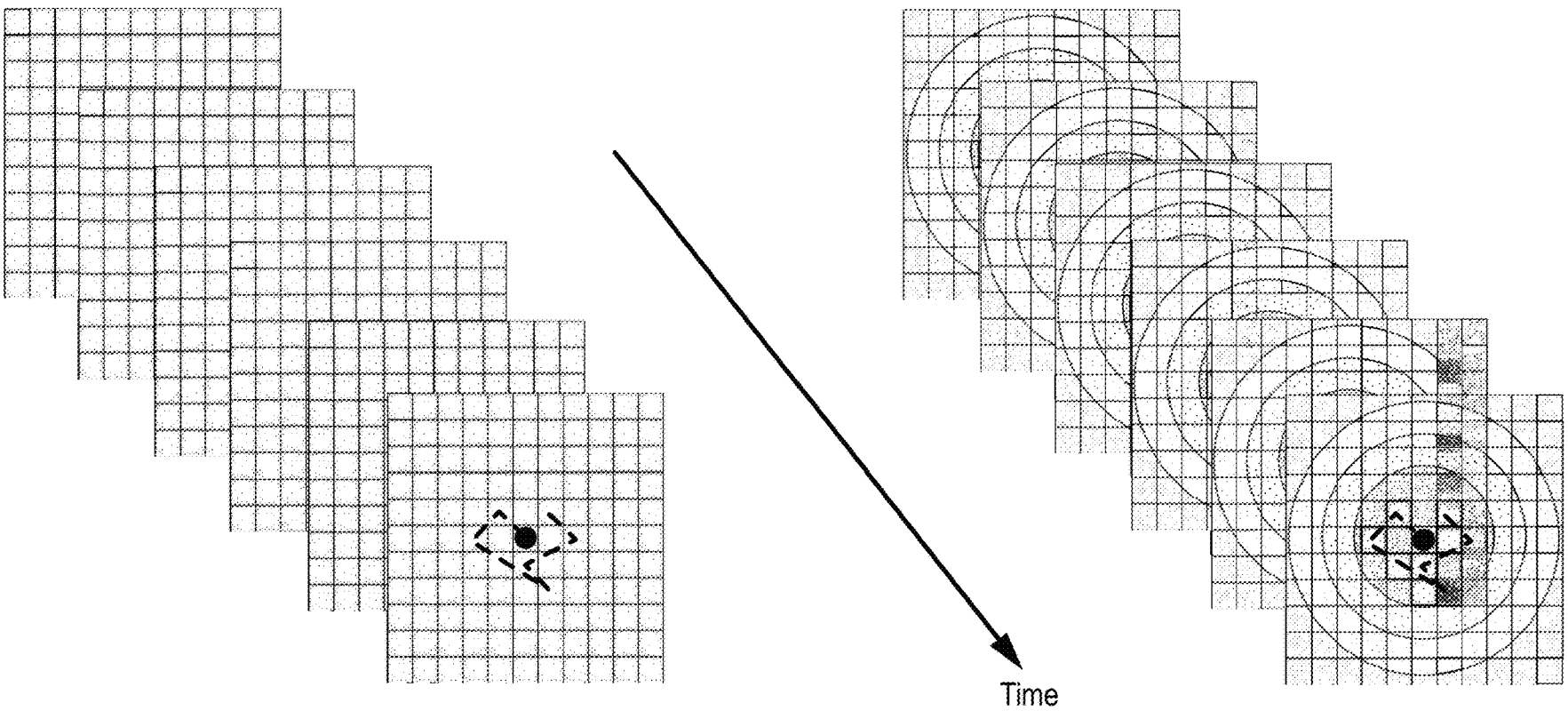
Figure 7G:
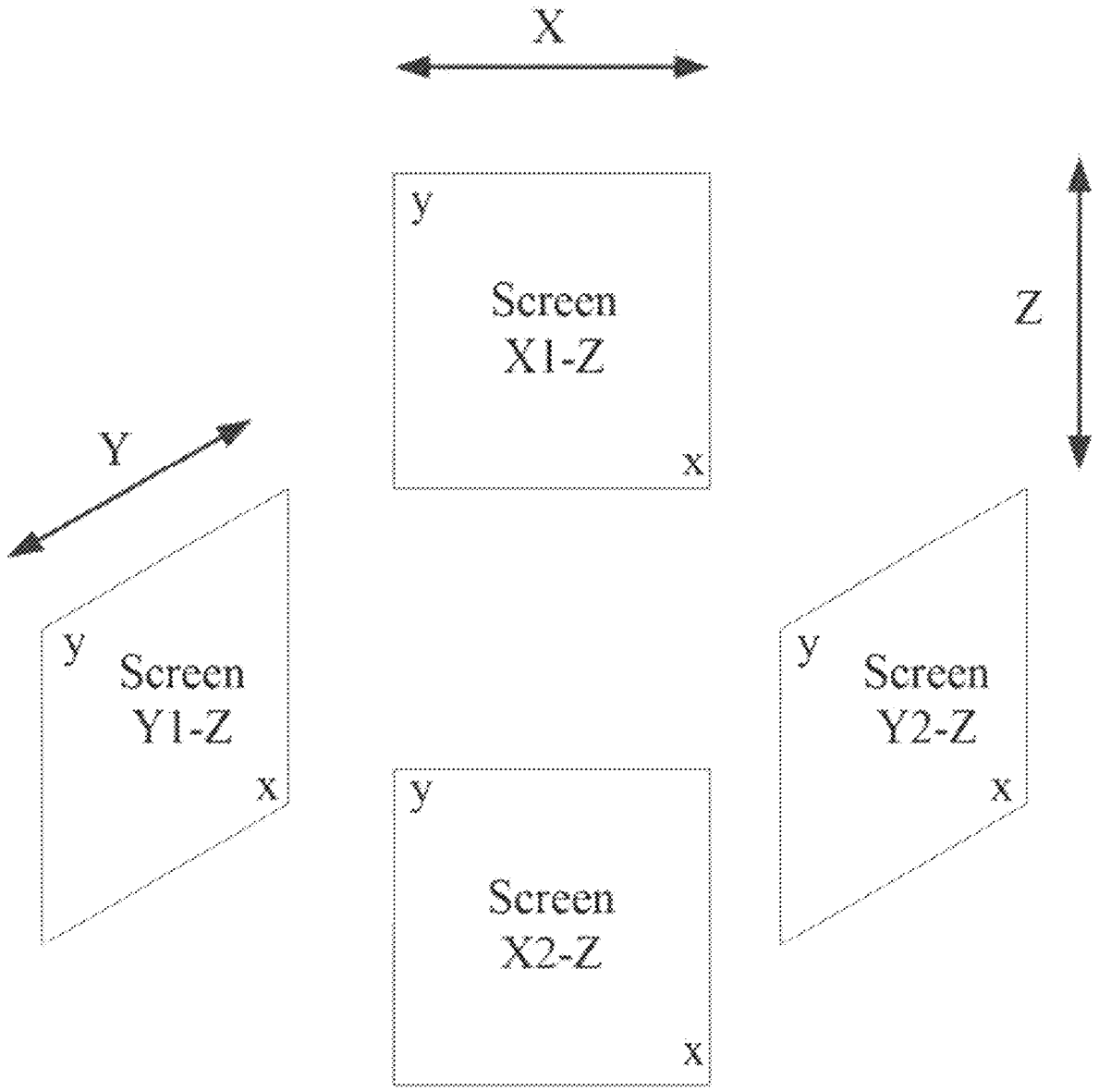
Figure 8:
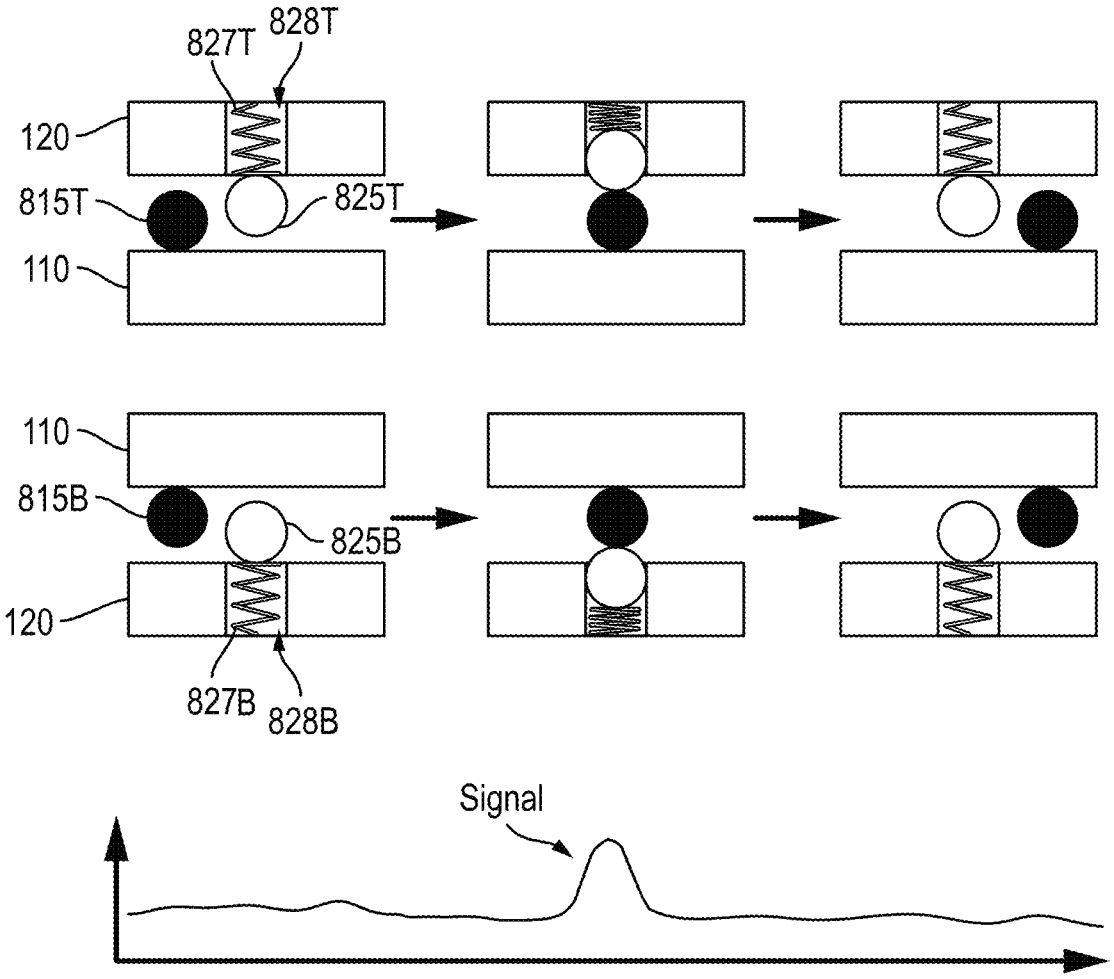
Figure 9A:
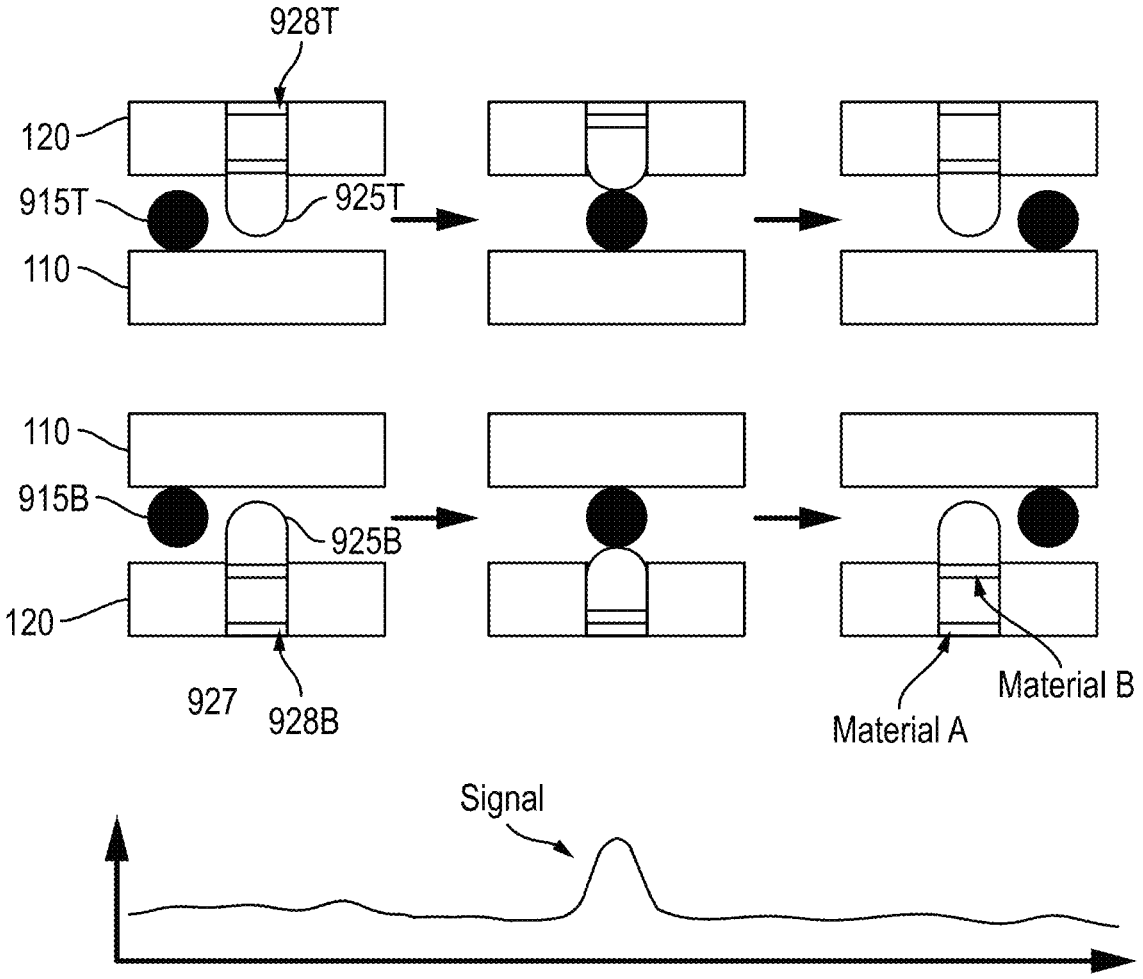
Figure 9B:
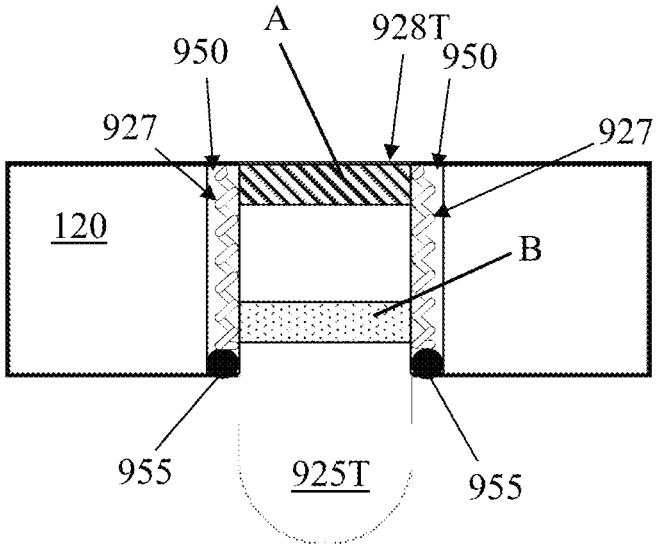
Figure 10A:
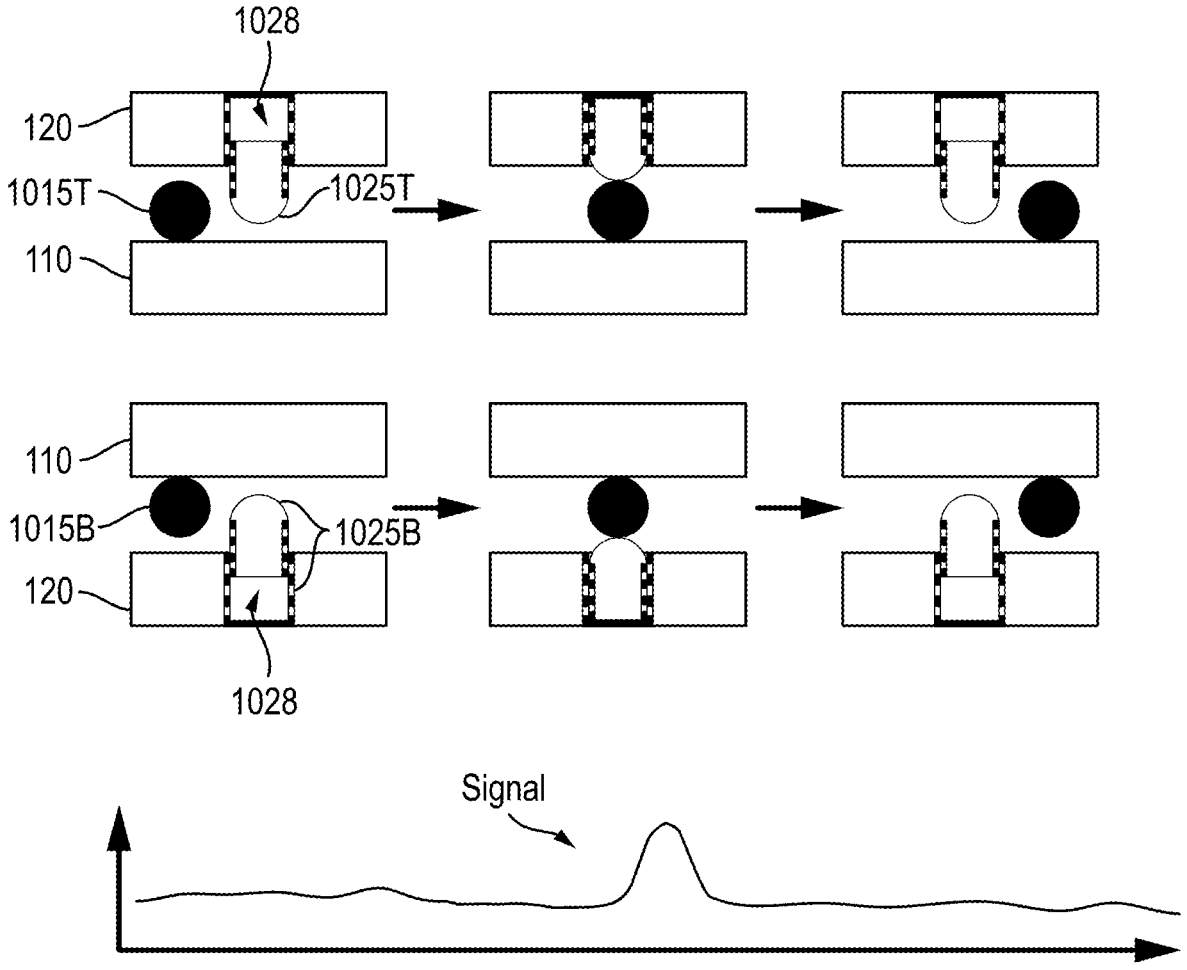
Figure 10B:
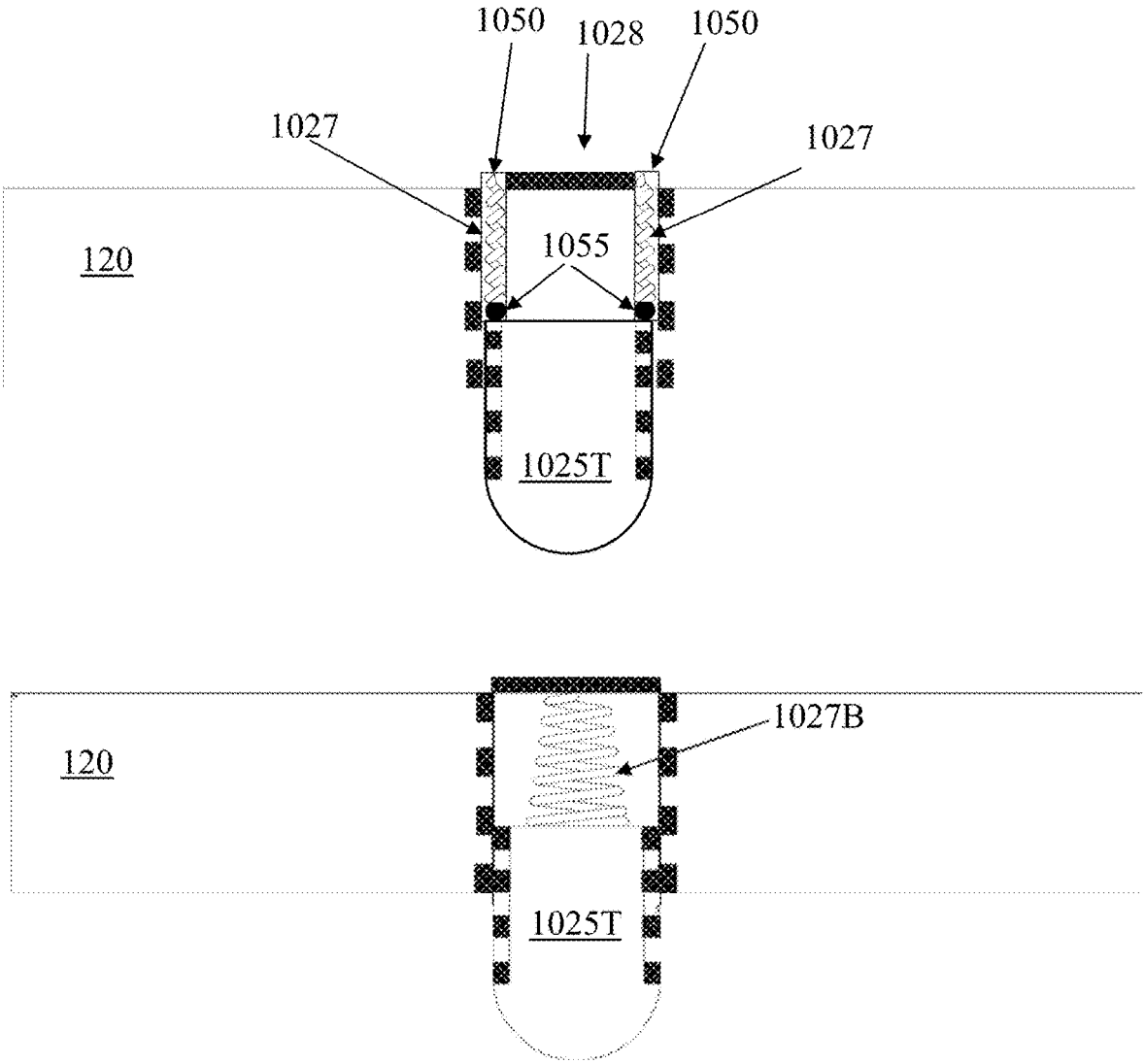
Figure 11A:
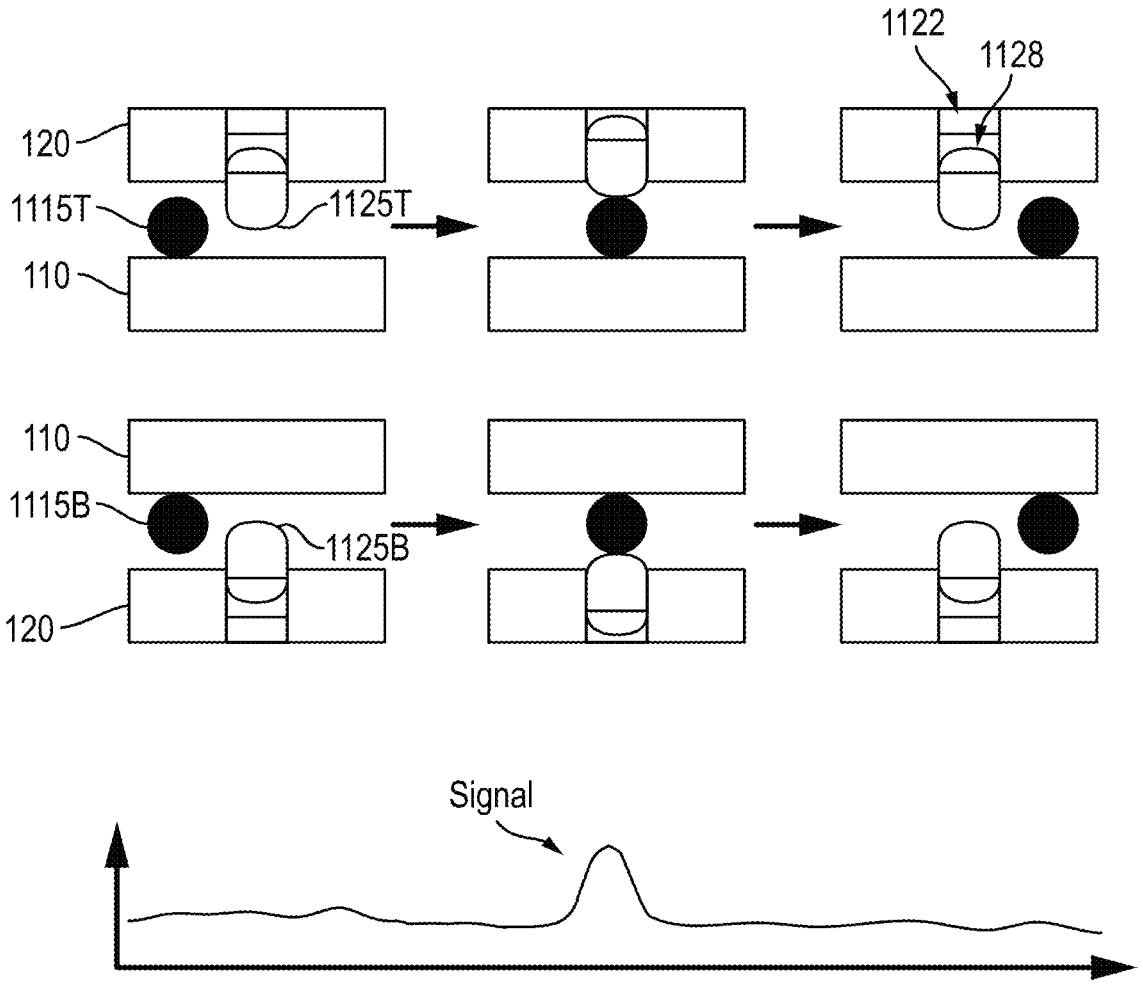
Figure 11B:
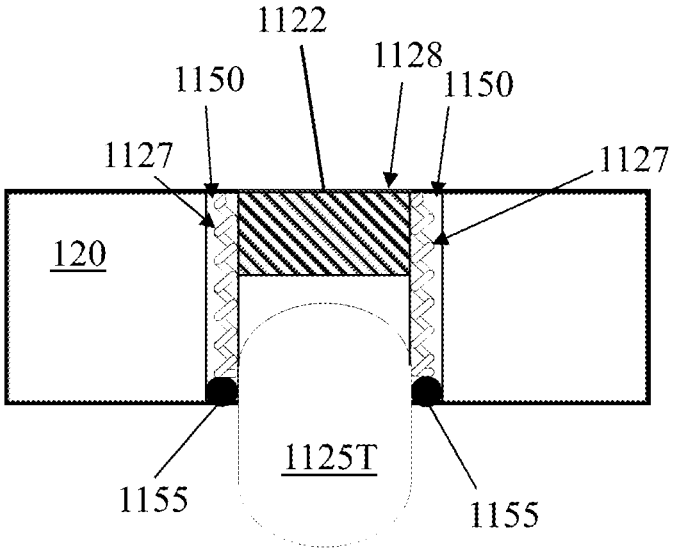
Figure 12:
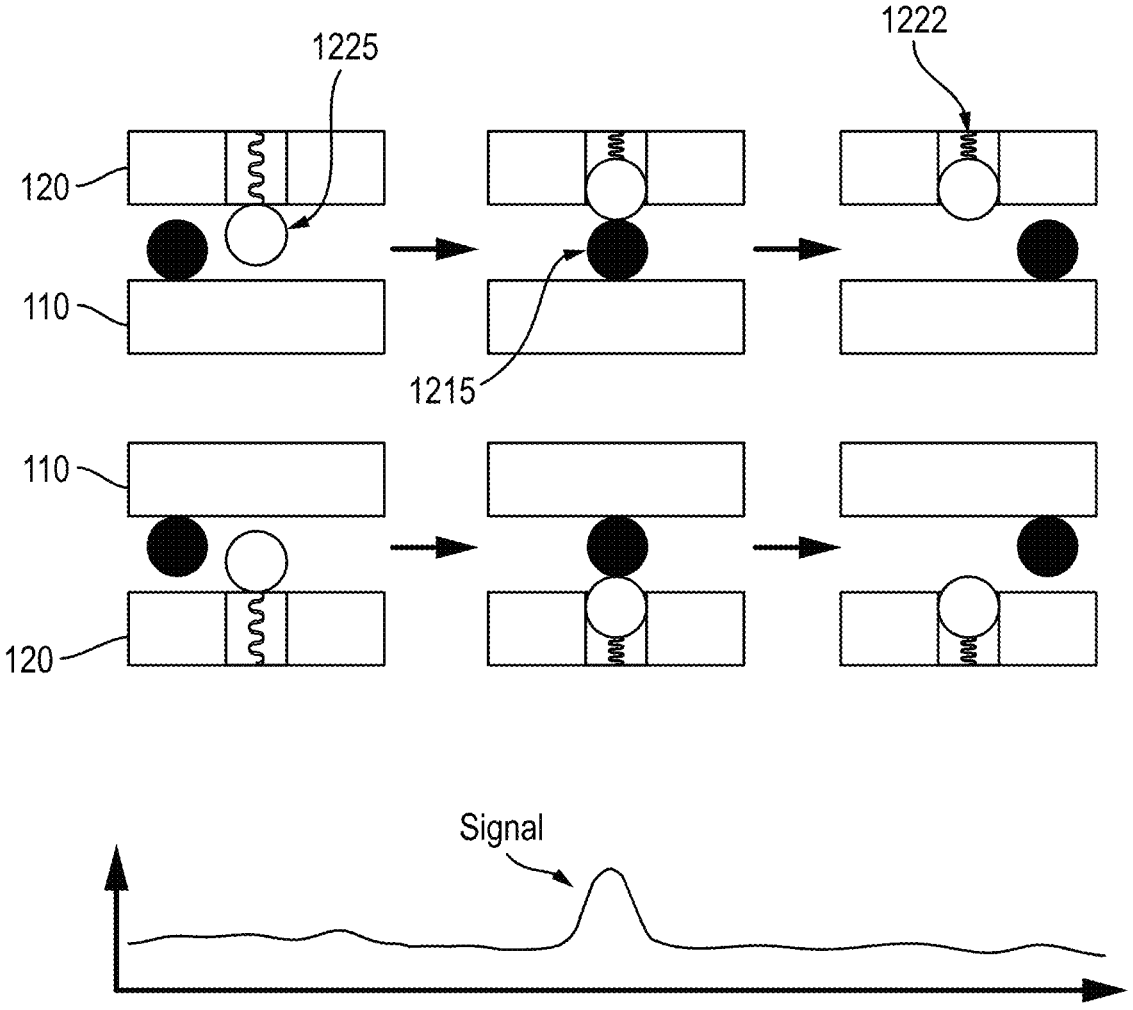
Figure 13A:
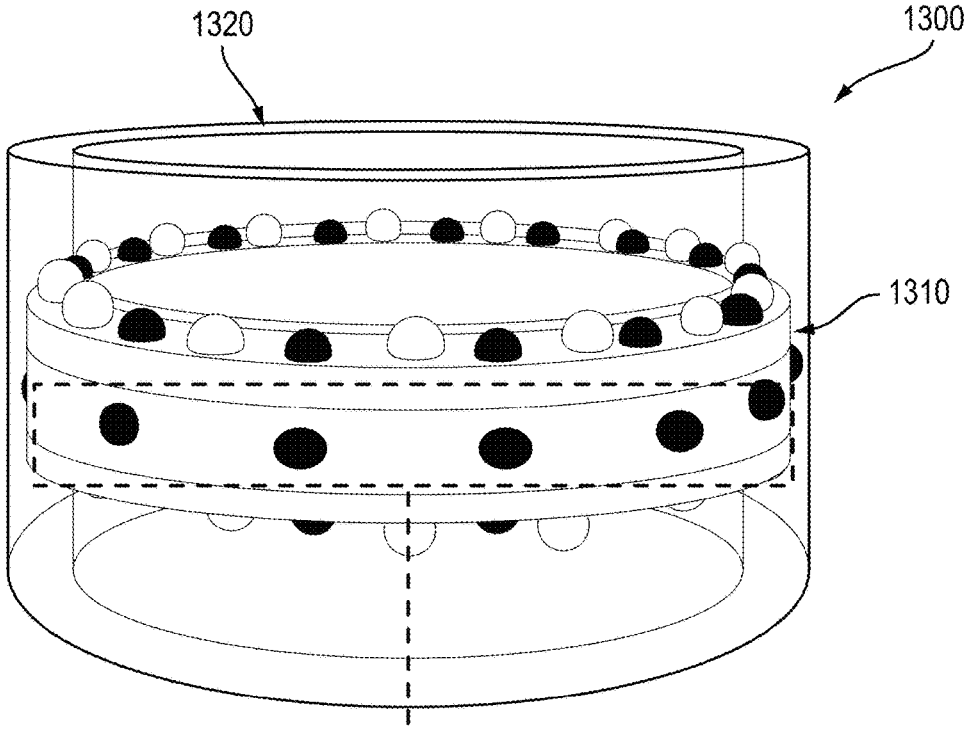
Figure 13B:
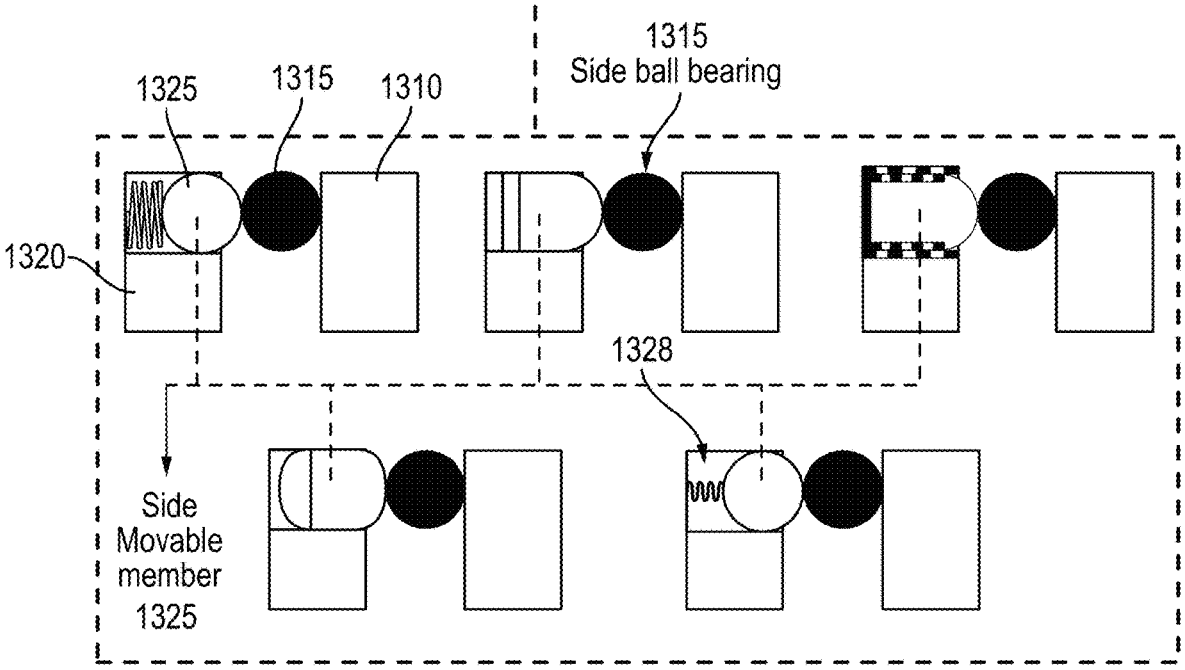
Figure 14A:
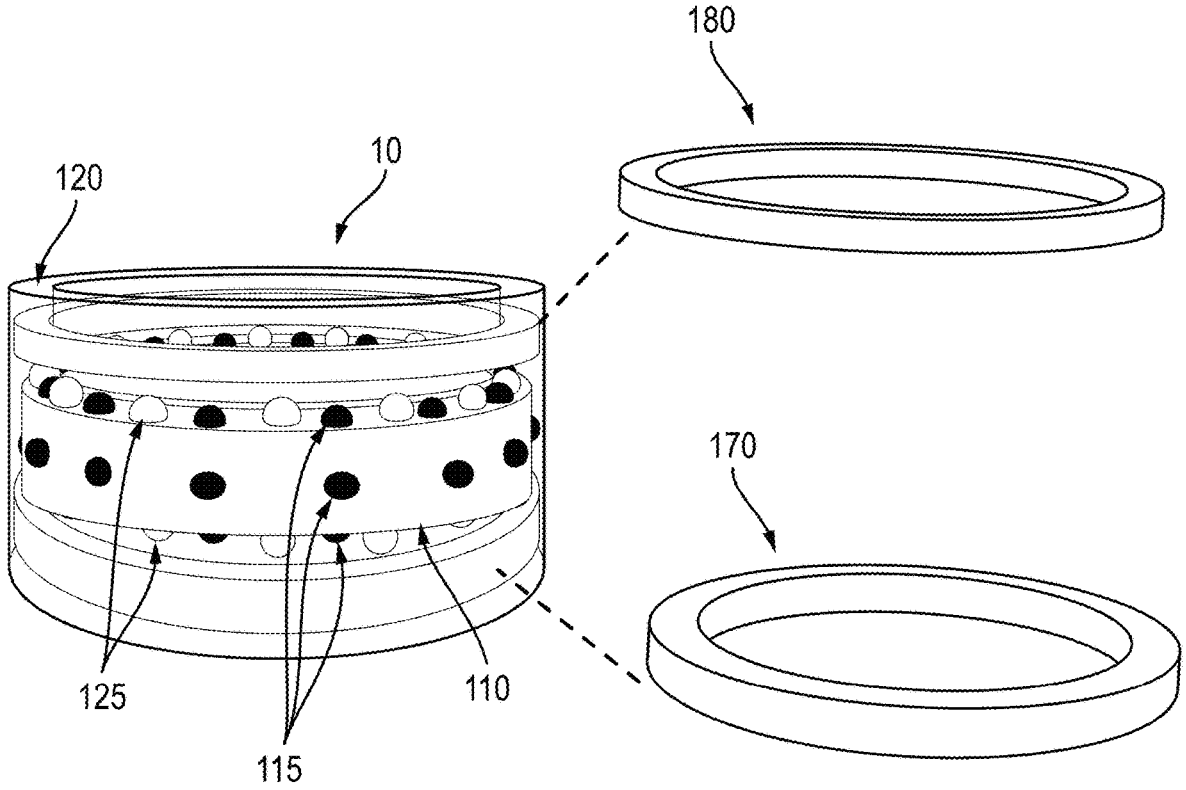
Figure 14B:
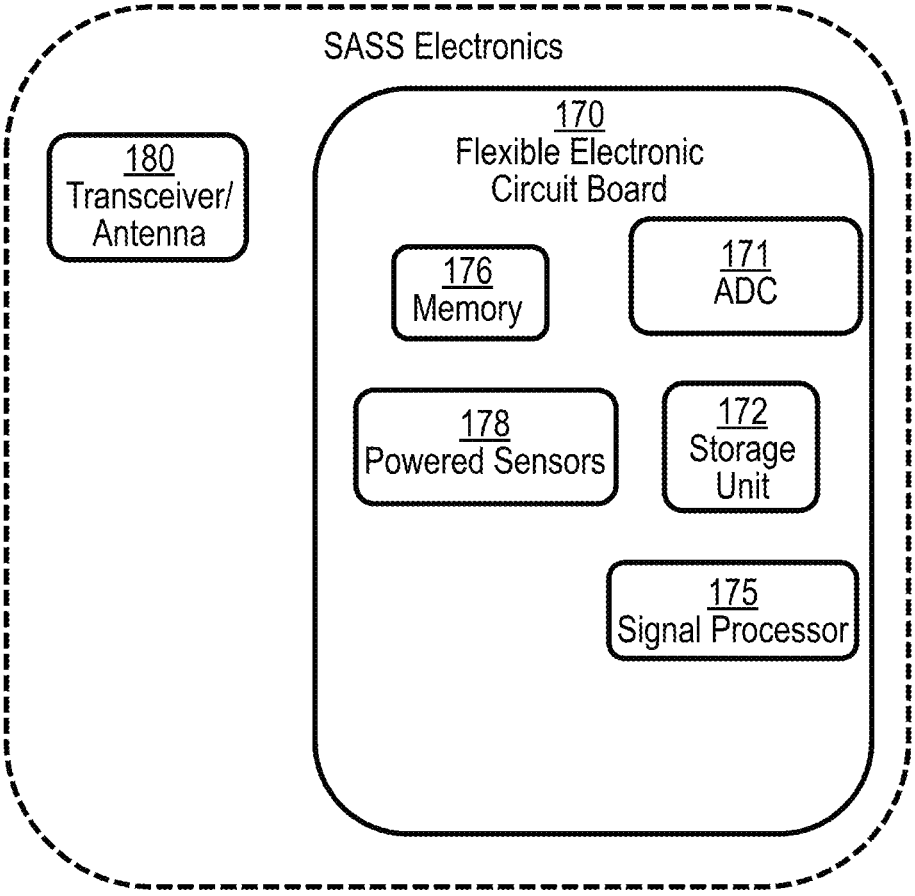
Figure 14C:
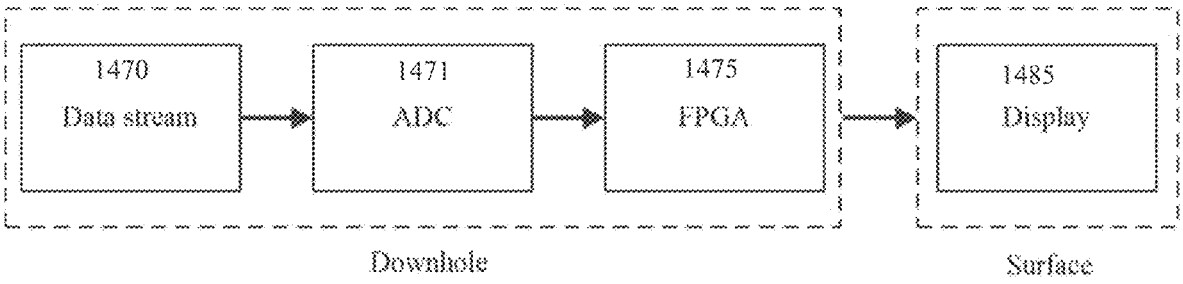
Figure 14D:
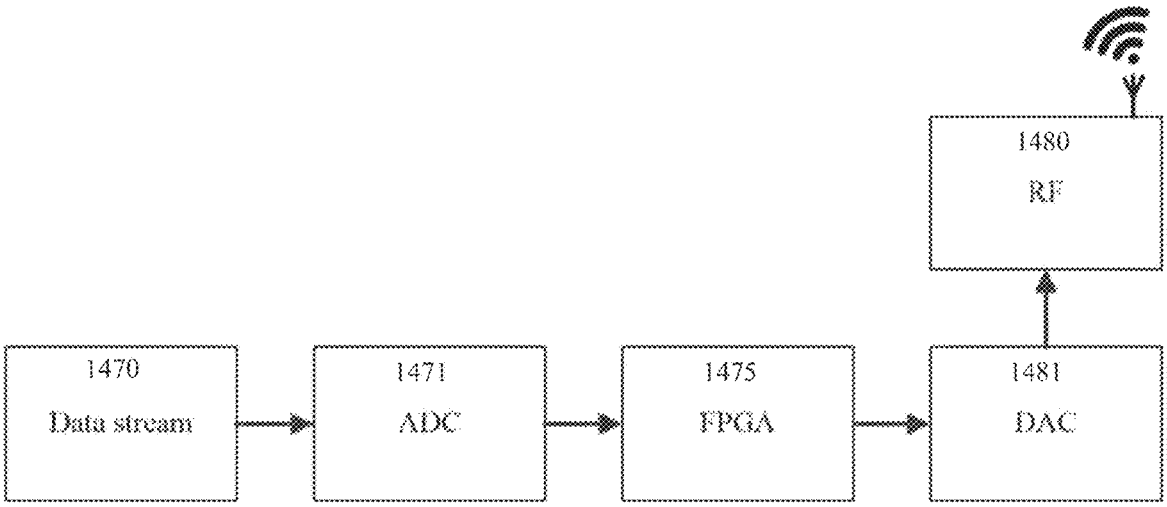
Figure 14E:
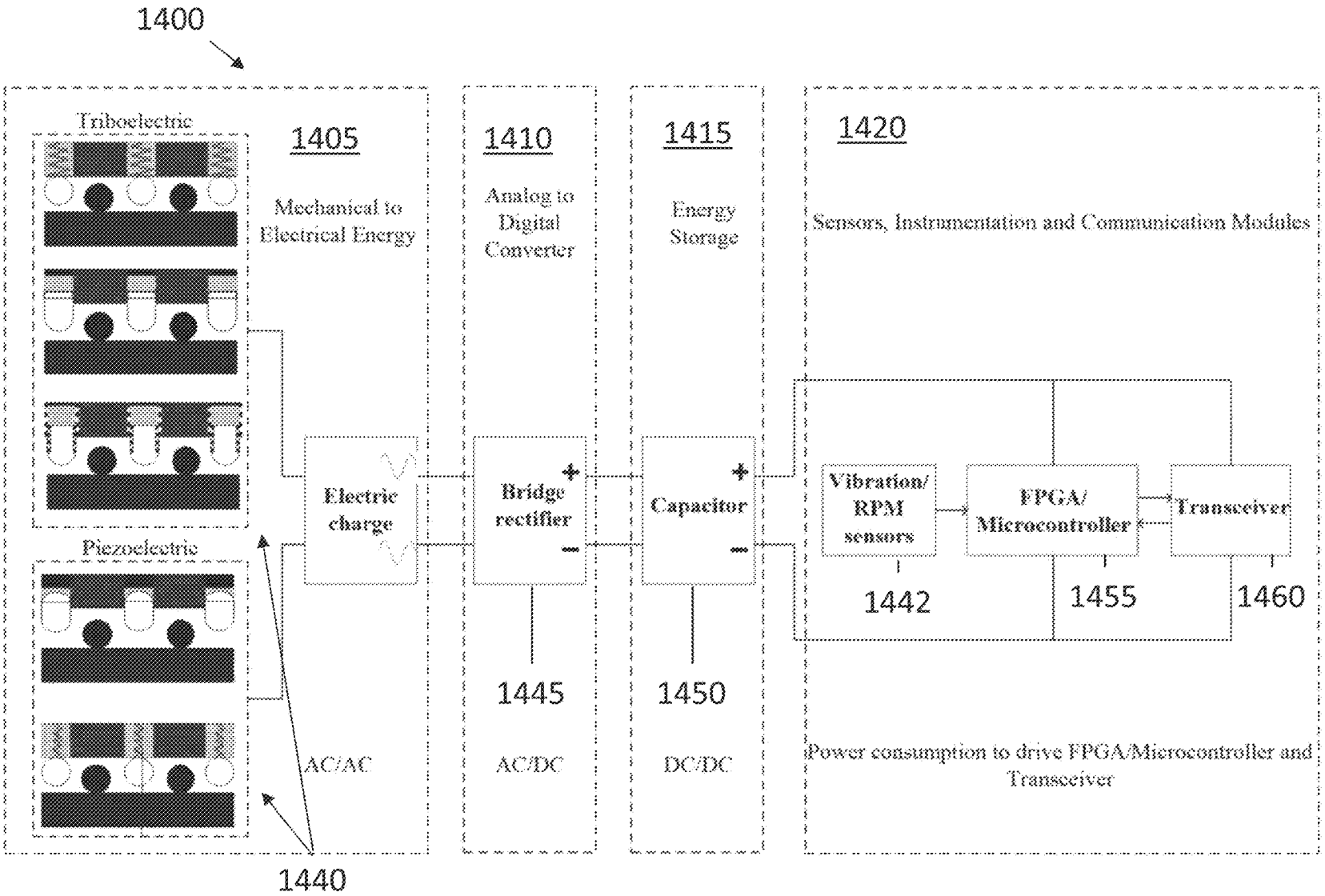
Figure 15A:
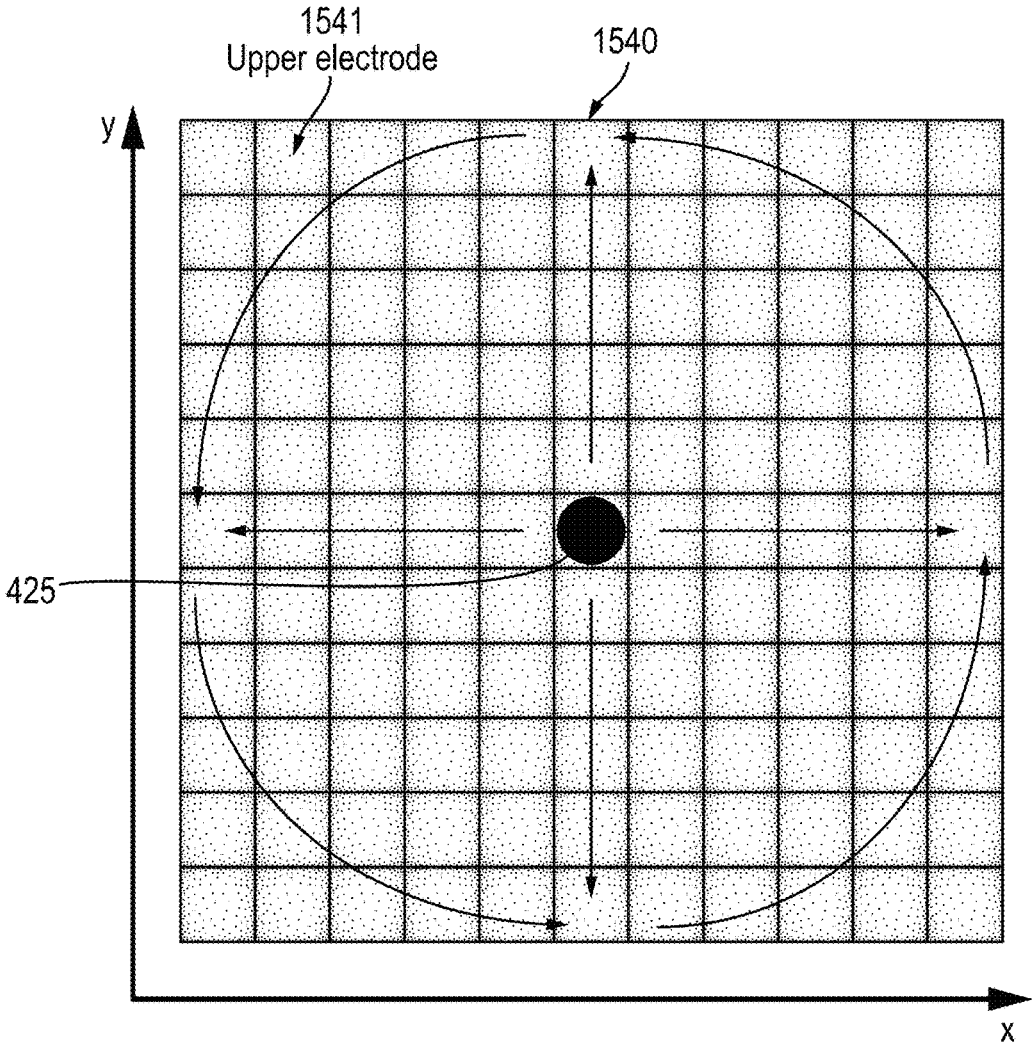
Figure 15B:
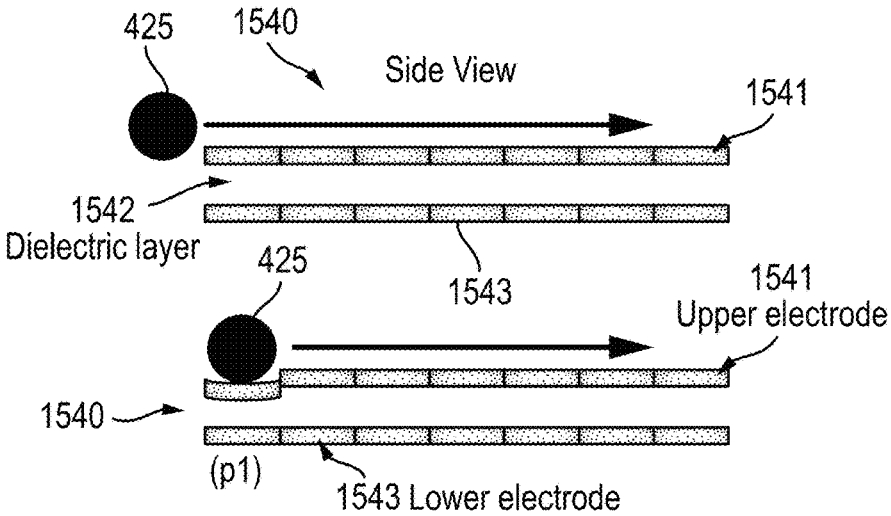
Figure 16:
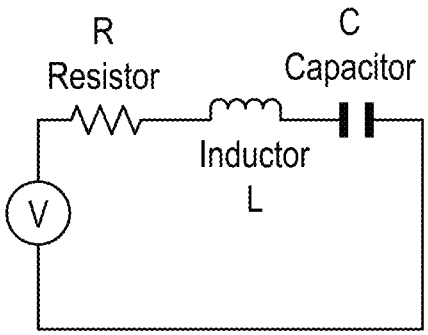
Figure 17A:
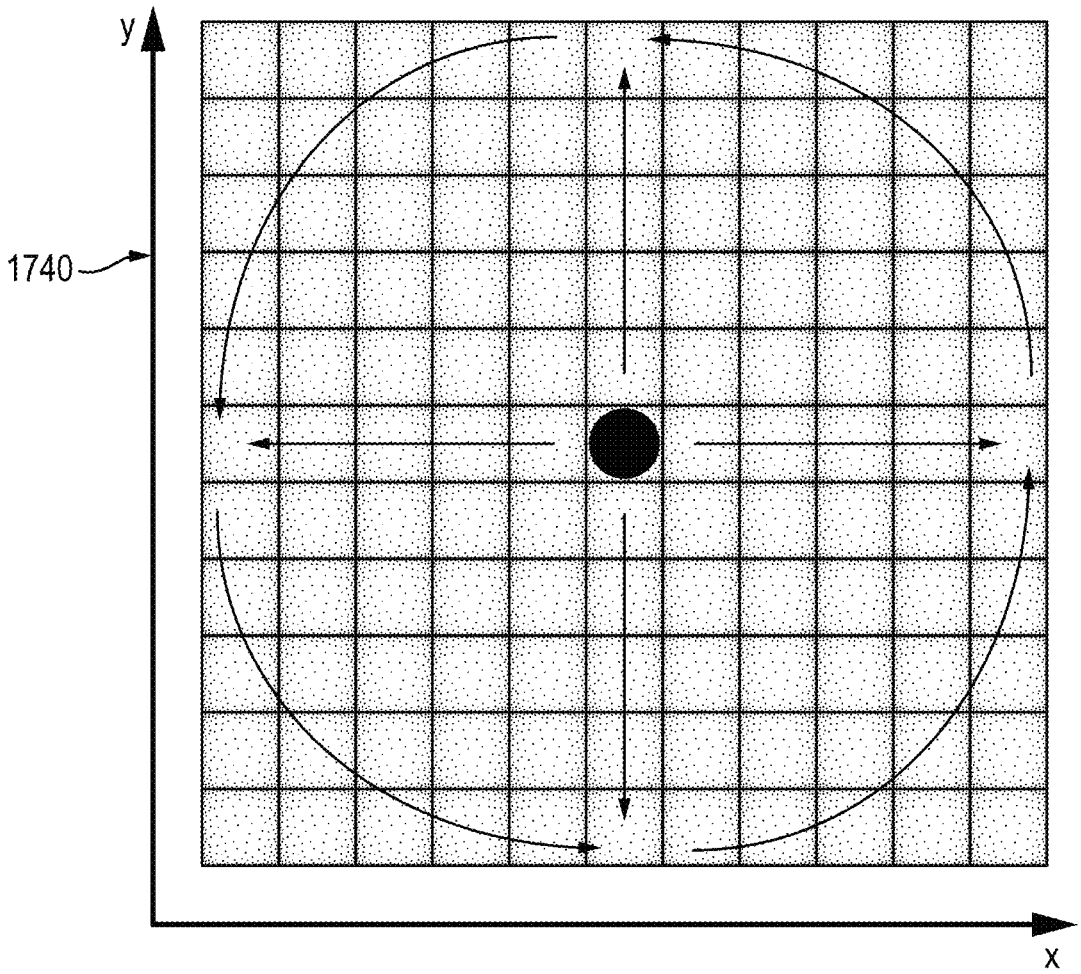
Figure 17B:
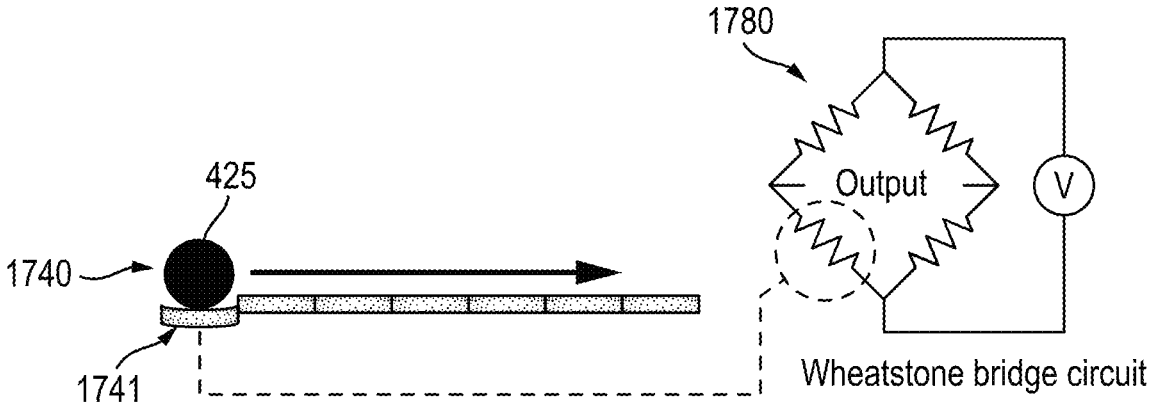
Figure 18:
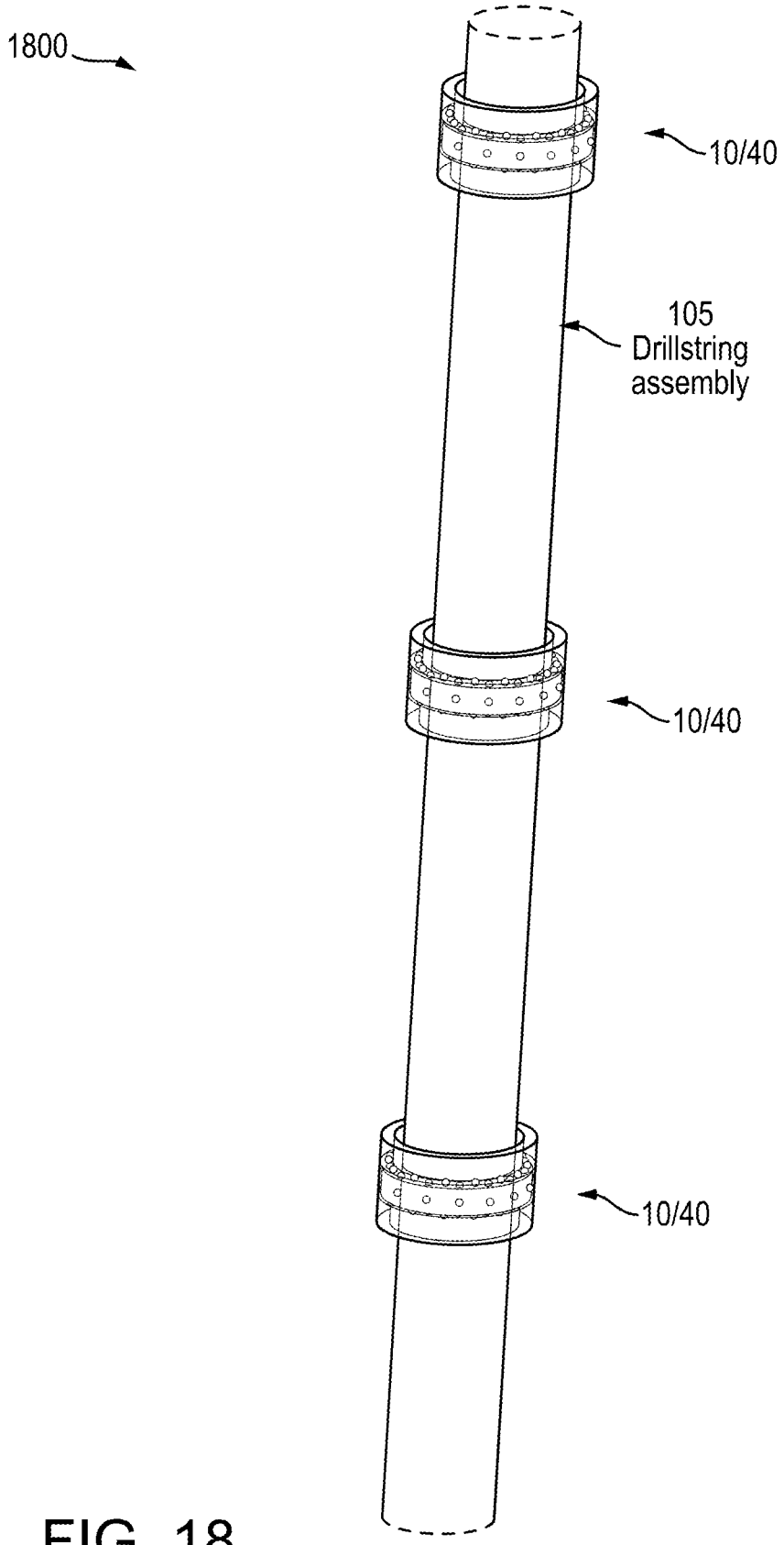
Figure 19:
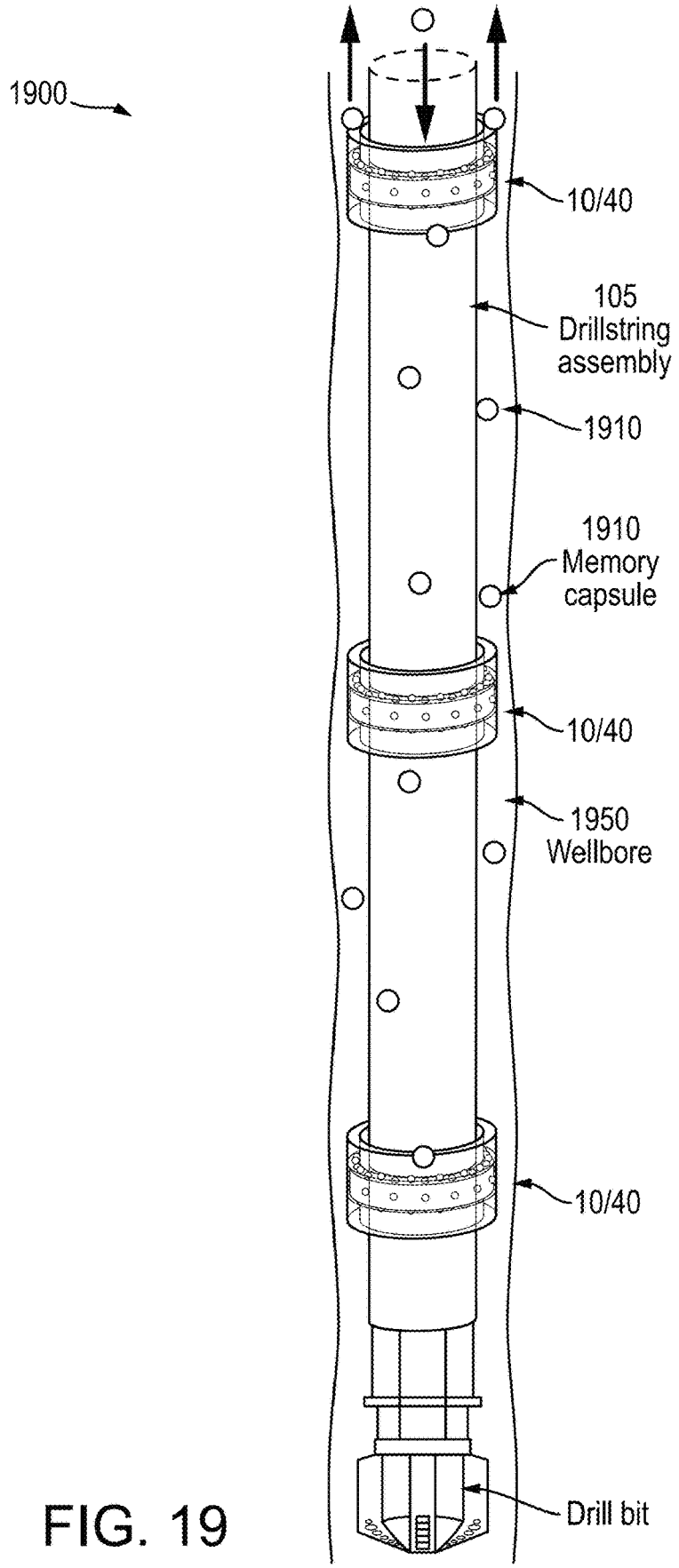
Figure 20:
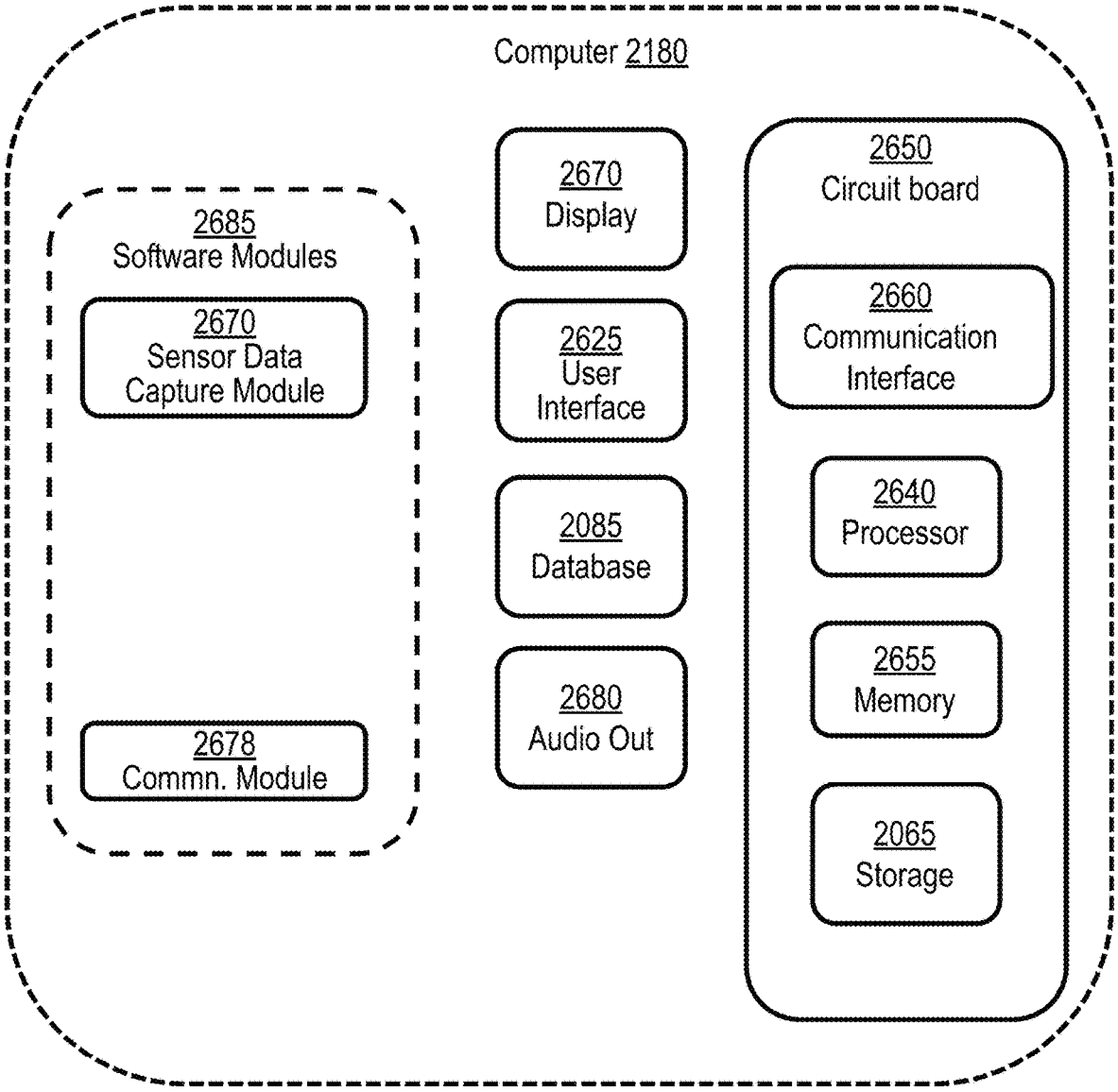

FIG. 2B includes a perspective side-view of the speed sensor of FIG. 2A provided on a drill string in accordance with one or more disclosed embodiments;

FIG. 2C includes a perspective top view of the speed sensor of FIG. 2A-2B in accordance with one or more disclosed embodiments;

FIG. 3 includes a cross-sectional side-view of the exemplary speed sensor of FIG. 1A-2C provided on a crossover sub of a drill string and a close-up side-view of the exemplary speed sensor on different crossover sub types in accordance with one or more disclosed embodiments;

FIG. 4A is side-view diagram of an exemplary vibration sensor incorporated into a self-powered active sensing system (SASS) in accordance with one or more disclosed embodiments;

FIG. 4B is an isolated top perspective view of a ring component of the vibration sensor of FIG. 4A in accordance with one or more disclosed embodiments;

FIG. 4C is a close-up perspective view of a portion of the vibration sensor of FIG. 4A-4B in accordance with one or more disclosed embodiments;

FIG. 4D is a cross-sectional view of the portion of the vibration sensor shown in FIG. 4C in accordance with one or more disclosed embodiments;

FIG. 5A is a side-view diagram of the vibration sensor shown in FIG. 4A including a screen component and includes a close-up isolated front-plan view and side-view of the screen and spherical bearing of the vibration sensor in accordance with one or more disclosed embodiments;

FIG. 5B is a side-view diagram of a cross-section of a vibration sensor including a rotating ring structure for mounting the outer housing of the vibration sensor to a drill string in accordance with one or more disclosed embodiments;

FIG. 5C is a side-view diagram of a cross-section of a vibration sensor including a rotating ring structure for mounting the outer housing of the vibration sensor to a drill string in accordance with one or more disclosed embodiments;

FIG. 6A includes an isolated front-plan view of an exemplary screen and stylus configuration of the vibration sensor of FIG. 4A-5 in accordance with one or more disclosed embodiments;

FIG. 6B is a close-up side-view of a stylus tip moving along the screen of FIG. 6A and further illustrates a corresponding electrical signal output by the vibration sensor in accordance with one or more disclosed embodiments;

FIG. 6C includes an isolated front-plan view of another exemplary screen and stylus configuration of the vibration sensor of FIG. 4A-5 in accordance with one or more disclosed embodiments;

FIG. 6D is a close-up side-view of a stylus tip moving along a portion of the screen of FIG. 7A and further illustrates a corresponding electrical signal output by the vibration sensor in accordance with one or more disclosed embodiments;

FIG. 7A is a conceptual illustration of a vibration sensor screen and a trace illustrating the vibration-induced movement of a stylus tip over a period of time in accordance with one or more disclosed embodiments;

FIG. 7B is a conceptual illustration of a vibration sensor screen and a trace illustrating the vibration-induced movement of a stylus tip over a period of time in accordance with one or more disclosed embodiments;

FIG. 7C is a conceptual illustration of a vibration sensor screen and a trace illustrating the vibration-induced movement of a stylus tip over a period of time in accordance with one or more disclosed embodiments;

FIG. 7D is an exemplary heat/contour map visualization of a vibration sensor screen and tracing the vibration-induced movement of a stylus tip over a period of time in accordance with one or more disclosed embodiments;

FIG. 7E is an exemplary heat/contour map visualization of a vibration sensor screen and tracing the vibration-induced movement of a stylus tip over a period of time in accordance with one or more disclosed embodiments;

FIG. 7F is a temporal sequence of grid images and heat/contour maps including a respective vibration trace generated using vibration sensor data in accordance with one or more disclosed embodiments;

FIG. 7G is a conceptual diagram illustrating the placement of four screens shown in FIG. 5A about the circumference of a vibration sensor in accordance with one or more disclosed embodiments;

FIG. 8 is a close-up, cross-sectional side view of an isolated set of top and bottom moveable members and top and bottom bearings in an exemplary configuration of the speed sensor shown in FIGS. 1A-3 in accordance with one or more disclosed embodiments;

FIG. 9A is a close-up, cross-sectional side view of an isolated set of top and bottom moveable members and top and bottom bearings in another exemplary configuration of the speed sensor shown in FIGS. 1A-3 in accordance with one or more disclosed embodiments;

FIG. 9B provides a close-up isolated view of an exemplary assembly configured to maintain a moveable member in position as it is moving within the channel provided in the second structure in accordance with one or more disclosed embodiments;

FIG. 10A is a close-up, cross-sectional side view of an isolated set of top and bottom moveable members and top and bottom bearings in another exemplary configuration of the speed sensor shown in FIGS. 1A-3 in accordance with one or more disclosed embodiments;

FIG. 10B provides a close-up isolated view of two exemplary assemblies configured to maintain a moveable member in position as it is moving within the channel provided in the second structure in accordance with one or more disclosed embodiments;

FIG. 11A is a close-up, cross-sectional side view of an isolated set of top and bottom moveable members and top and bottom bearings in another exemplary configuration of the speed sensor shown in FIGS. 1A-3 in accordance with one or more disclosed embodiments;

FIG. 11B provides a close-up isolated view of an exemplary assembly configured to maintain a moveable member in position as it is moving within the channel provided in the second structure in accordance with one or more disclosed embodiments;

FIG. 12 is a close-up, cross-sectional side view of an isolated set of top and bottom moveable members and top and bottom bearings in another exemplary configuration of the speed sensor shown in FIGS. 1A-3 in accordance with one or more disclosed embodiments;

FIG. 13A includes an assembled side view of an isolated side-mounted moveable member and side-mounted bearings for use in a speed sensor shown in multiple possible configurations in accordance with one or more disclosed embodiments;

FIG. 13B includes cross-sectional side views of the structure of FIG. 13A;

FIG. 14A shows a side-view of an exemplary SASS comprising a ring-shaped flexible electronics circuits and an antenna-transceiver in accordance with one or more disclosed embodiments;

FIG. 14B is a conceptual diagram of exemplary electronics for use in a SASS in accordance with one or more disclosed embodiments;

FIG. 14C is a conceptual block diagram illustrating an exemplary configuration of electronic components of a SASS in accordance with one or more embodiments;

FIG. 14D is a conceptual block diagram illustrating an exemplary configuration of electronic components of a SASS in accordance with one or more embodiments;

FIG. 14E is a conceptual block diagram illustrating an exemplary configuration of electronic processing components of a SASS in accordance with one or more embodiments; FIG. 15A includes an isolated front-plan view of another exemplary screen and stylus configuration of a vibration sensor in accordance with one or more disclosed embodiments;

FIG. 15B is a close-up side-view of a stylus tip moving along a portion of the screen of FIG. 15A and further illustrates a corresponding electrical signal output by the vibration sensor in accordance with one or more disclosed embodiments;

FIG. 16 is a circuit diagram for a resistor capacitor inductor circuit for translating an electrical parameter of the screen of FIGS. 15A-15B into a resonance frequency signal in accordance with one or more disclosed embodiments;

FIG. 17A includes an isolated front-plan view of another exemplary screen and stylus configuration of a vibration sensor in accordance with one or more disclosed embodiments;

FIG. 17B is a close-up side-view of a stylus tip moving along a portion of the screen of FIG. 17A and further illustrates a circuit diagram for measuring a signal representing vibration in accordance with one or more disclosed embodiments;

FIG. 18 is a perspective side-view of an exemplary sensor system comprising a plurality of SASSs in accordance with one or more disclosed embodiments;

FIG. 19 is a perspective side-view of an exemplary sensor system comprising a plurality of SASSs in accordance with one or more disclosed embodiments; and FIG. 20 is a conceptual diagram of an exemplary control computing device for use with the SASS system in accordance with one or more disclosed embodiments.

DESCRIPTION OF CERTAIN EMBODIMENTS OF THE DISCLOSURE

By way of overview and introduction, the systems and methods disclosed herein concern a self-powered active sensing system (SASS) for use in downhole drilling environments. In accordance with one or more embodiments, sensor devices are disclosed including a self-powered rotational speed sensor and a self-powered three-axis vibration sensor. Furthermore, a SASS system comprising one or more of the vibration sensor and speed sensor devices disposed along a drill string assembly is disclosed. Additionally, in accordance with one or more embodiments a sensor system comprising a network of SASS sensors provided along a drill string assembly and systems and methods for intercommunication and transmission of measurement data from within the wellbore to the surface are disclosed.

A drilling assembly utilized to drill hydrocarbon wells consists of hollow steel drill pipes with a drill bit at the bottom. The drill bit is a cutting tool that rotates and penetrates through rock formations below the surface to reach a hydrocarbon reservoir thousands of feet below the ground safely and quickly as possible. Three drill pipes connected together, say, 90 feet in length (referred to as "a stand"), are rotated and lowered into the wellbore to penetrate into the rock formations. This process is repeated until the target well depth is reached. Surveying and logging tools, such as wireline and measurement while drilling, logging-while drilling (MWD/LWD) tools, play a critical role during the drilling process since drillers are unable to see the trajectory of the well being drilled and the downhole environment. Wireline and MWD/LWD tools acquire accurate data that deliver a precise representation of the downhole condition of the well so that drillers can make effective and timely decisions.

In wireline operations, the power to the wireline sensors and instrumentation are provided by a wired power line that extends from the power source at the surface all the way down to the well depth. However, since the drilling assembly has to be pulled out of the wellbore first before running the wireline tool, downhole logging data cannot be obtained while drilling. MWD/LWD tools obtain real-time data while drilling and transmit this data by a technique called mud-pulse telemetry to the surface. The power to the MWD/LWD tools is commonly provided by non-rechargeable, one-time use and disposable lithium thionyl chloride battery packs. However, if these batteries are exposed to temperatures in excess of 180° C., the lithium metal in the battery melts, which may cause a violent, accelerated reaction and an explosion with a force large enough to create a hole through the pressure housing and resultant damage the tool. Batteries are also expensive and discharge over time. This process accelerates at high temperatures, requires maintenance or replacement, and is associated with the added cost of safe disposal due to the chemicals they contain. Turbines/alternators, which harness the kinetic energy of a fluid flow to generate electricity, are utilized to provide electricity to the most power consuming parts of LWD/MWD tools, to the data acquisition and to the transmission of this data to the surface. However, the generated power is proportional to the flow rate of the drilling fluid and heavy drilling fluids, and lost circulation material in a drill string, for example, can significantly reduce the speed of flow in a drill string and might even block the pathway through the turbines/alternators.

In accordance with one or more of the disclosed embodiments, the exemplary SASS for downhole drilling environments comprise a rotational speed sensor, a 3-axis vibration sensor, or both. The sensors are referred to as "active" sensors since they configured to generate and transmit an output signal themselves without obtaining electrical power from an external power source. Each of the rotation speed sensor and the vibration sensor outputs a signal corresponding to the rotation and the vibration of the drill string assembly. Specifically, the signal produced by the rotation speed sensor can be utilized to determine a rotational speed of the drill string (e.g., RPM). The signal produced by the vibration sensor can be translated into one or more vibration measurements including, for example and without limitation, magnitude, duration, and frequency of the vibration of the drill string.

The SASS comprising both sensors can thus provide real-time, dynamic vibration analysis and revolutions per minute (RPM) data usable by the drilling control systems to optimize drilling parameters and to maintain efficient drilling. By measuring the magnitude, duration, and frequency of vibration the SASS can help to reduce damage to the drill bit and other tools in the drill string assembly. For example, the real-time rotational speed and 3-dimensional vibration data, both magnitude and imaging, can be utilized to analyze common drilling problems such as axial/lateral vibrations and stick/slip. Moreover, measuring RPM along with vibration provides an excellent understanding of the influence vibration has on the drill bit life. This information can be utilized to predict bit wear and tear downhole as well as the integrity of downhole tools. More generally, the data obtained by these sensors can be utilized by the driller to make changes to the drilling parameters to mitigate potential downhole problems and optimize drilling operations.

As noted, the vibration and RPM sensors are, in one or more exemplary embodiments, designed to be active so they do not need batteries for operation and will always function when the drill string assembly is drilling a well. Rather than utilize an external electrical power source, the SASS, and more particularly the vibration and RPM sensors, exploit the rotation of the drill string assembly during drilling a hydrocarbon well and harvest the resulting energies to generate an electrical signal representing vibration and speed and concomitantly generate electricity to power other downhole sensors and instrumentation of the SASS. Therefore, the SASS is able to acquire information about the surrounding geological formations as well as directional data of a wellbore during drilling.

The SASS can provide clear advantages over current downhole power generation methods such as batteries and turbines with respect to size, cost, mobility, temperature/pressure tolerance and potential downhole applications. Moreover, the SASS addresses current limitations/challenges of automation/digitalization in drilling and the fourth industrial revolution (4IR) since, for example, batteries cannot power the Industrial internet-of-things (IoT) at scale. Because the SASSs are self-powered, they can be placed all along the drill string assembly for distributed sensing of downhole parameters while drilling. This addresses a critical automation/digitalization gap in drilling as data obtained by the LWD/MWD data might not stay constant and may change over time due drilling and other operations performed inside a wellbore. For example, logging data measured by LWD/MWD sensors at certain depths along a wellbore may change over time as they are influenced by drilling fluid characteristics such as salinity, density, solids concentrations etc., together with temperature, pressure, size and rugosity of the wellbore, tool alignment, logging speed, as well as the lithology, pore size, type of fluid in the pores and the geologic structure and geometry of the rock formation. Therefore, it is not possible to obtain real-time information of these parameters at these depths unless the LWD/MWD sensors are run again at these depths again, which is very costly and not feasible. By deploying a system comprising multiple SASSs all along the drill string, a real-time profile of the wellbore can be obtained during the drilling process. Such real-time data profiles enable drilling operations to take advantage of emerging technologies aligned with the 4IR, including, by way of example and not limitation, big data analytics and artificial intelligence to transform this data to high-value, actionable insights.

Self-Powered Rotation Speed Sensor

In one or more embodiments, a self-powered rotational speed sensor is disclosed. Although the exemplary speed sensor described herein comprises part of a SASS that is also configured to includes a 3-axis vibrational sensor, it should be understood that the rotational speed sensor can form a standalone sensor unit.

FIG. 1A is perspective, exploded diagram of an exemplary rotational speed sensor 100. The speed sensor 100 is exploded to illustrate a first structure 110 shown separate from the second structure 120. FIG. 1B is a perspective view of the assembled first and second structures.

The first structure 110 is configured to be attached to a drill string 105 (not shown) such that it extends circumferentially about a portion of the drill string, like a ring or collar. Accordingly, the first structure is generally ring shaped, for instance, a cylinder having a hollow central opening of a diameter that corresponds to the outer diameter of the drill string. The first structure 110 thus rotates with the drill string about its central axis during drilling.

The outer housing, also referred to as the second structure 120, is disposed about the first structure 110. As shown in FIG. 1A-1B, the second structure 120 can be generally shaped like a cylinder with a hollow central opening of a sufficient diameter for the drill string to pass through the center of the second structure. The second structure also is configured to at least partially house the ring-like first structure. In addition, the interior surface of the second structure, which is the surface that defines the central opening, can be is shaped to include an annular groove 122. The first structure and the groove have complementary sizes and shapes such that at least an outer portion of the ring is located within the annular groove. Although the second structure's outer walls are cylindrical in shape, housings of other shapes can be used provided the housing has a central opening that allows the drill string to extend therethrough and rotate freely within the opening.

In use, the first structure 110 rotates within the annular groove about a central axis shared by the first structure, the drill string and the second structure. The second structure 120 also is disposed about the drill string but is configured to remain stationary while the drill string and first structure rotates within the central opening of the second structure.

The first structure 110 has top and bottom ball bearings 115T and 115B (collectively ball bearings 115) that are respectively provided on a top and bottom surface of the first structure 110 and spaced apart circumferentially. The bearings can guide the rotation of the first structure within the groove of the second structure 120, thereby maintaining the relative position of the ring and second structure.

The second structure comprises top and bottom movable members 125T and 125B (collectively moveable members 125). As shown in FIG. 1A-1B, the top and bottom moveable members respectively extend from top and bottom surfaces of the annular groove 122 that oppose the top and bottom surfaces of the first structure. The top and bottom moveable members are spaced part circumferentially about the annular groove. The first structure can also include ball bearings 115S extending from an outer side surface.

In the exemplary embodiment of the speed sensors shown and described herein, the bearings are assumed to have negligible friction thereby allowing the second structure to remain stationary while the first structure and drill string rotates therein. However, the second structure can be provided with one or more external engagement features that are configured to ensure the second structure remains static while the first structure rotates. For example, in the event turbulent or irregular flow of fluid causes the second structure to rotate in a vertical well, modifications to the second structure, such as, flutes or teeth provided on the outer body of the second structure can be included to negate this effect. It should be further understood that, while various bearings for guiding rotation of the first structure relative to the second structure are referred to herein as ball bearings, other suitable types of bearings can be used, for instance, roller bearings, needle bearings and the like.

The bearings 115 and moveable members 125 are arranged such that, during the rotation of the drill string assembly, the bearings 115 make contact with movable members 125 and displace the moveable members up or down in the longitudinal direction. As further described herein in connection with FIGS. 8-13, the movable members are constructed such that their contact with the bearings, and/or their movement from contact with the ball bearings, generates a series of electrical pulses representative of the rotational speed of the drill string assembly. The output of the moveable members can be connected such that they collectively output a single pulse per cycle. The output of the moveable members can also be wired such that the signal comprises separate pulses from all the movable members, respectively. Additionally, according to a salient aspect, the electrical pulses generated by the speed sensor can be stored to power other components of the SASS, such as signal processors, instrumentation, communications devices, powered sensors, and other such powered devices on-board the SASS. Thus, the sensors are referred to as "active" and the system is "self-powered."

The spacing of the bearings can be independent of the spacing of the movable members. For example, there can be more bearings than movable members or more movable members than bearings. The spacing between the movable members does not have to be consistent but the spacing between the bearings is preferably the same due to the stability of the system. While the number of moveable members and bearings can vary, the number of bearings and movable members can depend on the available space around the SASS. Additionally, in some exemplary configurations in which the spacing between the movable members are not the same, the generated pulse sequences when the drillstring assembly is rotating in anticlockwise and clockwise directions can differ and the sequence is thus usable to uniquely identify the direction of the drillstring rotation.

The first and second structures 110 and 120 can be made from any low friction, metallic/non-metallic material or composite materials that can operate at high temperatures (e.g., >150° C.) and high pressures (e.g., >5000 psi) that also preferably has an abrasion and wear resistance which enable operation in the intended environment. FIG. 2A-2C shows a SASS 10 comprising the speed sensor 100 mounted to the outside of a drill string assembly 105 having a drill bit 107 for drilling of a well. FIG. 2A includes a cross sectional side-view of the speed sensor 100. FIG. 2B includes a perspective side-view of the speed sensor on the drill string 105. FIG. 2C includes a perspective top view of the speed sensor 100. As shown, the first structure 110 is attached to the drill string 105, while the second structure 120 is not. As can be seen from FIG. 2A, the ball bearings including the top and bottom bearings 115T and 115B and side ball bearings 115S maintain the second and first structures in alignment. The ball bearings 115 preferably have negligible friction so that the second structure 120 remains stationary while the first structure 110 rotates with the drill string assembly. In accordance with one or more embodiments, the exemplary configuration of the SASS comprising a speed sensor 100 is arranged in a way so that it allows maximum drilling fluid bypass.

In addition, or alternatively to providing the SASS including a speed sensor 100 system on a drill pipe of drill string 105, the sensor 100 can be mounted to a drill string assembly via a crossover sub 300, as is shown in FIG. 3. FIG. 3 includes a side view of the drill string 105 including a crossover sub 300 on which the exemplary SASS 10 with speed sensor 100 is provided. FIG. 3 also includes a close-up view of the sensor 100 provided on a crossover sub 300 having a pin-box, pin-pin or box-box type that are well known in the field of well drilling.

As an alternative to providing the SASS including a speed sensor on the outside of a drill string, the first and second structures can be provided within the hollow space within the drill string 105. In such a configuration, the first structure 110 can be connected to the inside wall of the drill string assembly and configured to rotate about a central second structure. The first structure is connected to a drill pipe in the drill string assembly. In such a configuration, the ring-like first structure similarly comprises top and bottom ball bearings and side-ball bearings, which protrude from an inner side wall of the ring-shaped first structure. The second structure similarly comprises a cylindrical structure having an annular groove that is complementary in size and shape to the first structure and includes top and bottom moveable members extending into the groove. However, the annular groove is provided on an outer surface of the second structure in such a configuration. Accordingly, during drilling a well, the first structure will rotate with the drill string assembly and the ring's bearings riding within the annular groove extending around the outside of the central second structure.

Three-Axis Vibration Sensor

In one or more embodiments, a three-axis vibration sensor is disclosed. Although the exemplary SASS 40 comprising a vibration sensor 400 described herein includes the components of SASS 10 including the speed sensor 100 described above, it should be understood that the vibration sensor 400 can form a standalone sensor unit.

FIG. 4A is side-view diagram of an exemplary SASS 40. The SASS 40 is the same as SASS 10 comprising the rotational speed sensor 100 (omitted for simplicity) of FIG. 1A-FIG. 2C, but further comprises a vibration sensor 400. FIG. 4B is an isolated, top perspective view of a ring 420 component of the vibration sensor 400. Whereas FIG. 4A illustrates the SASS 40 in an assembled state, FIG. 4C is a close-up perspective view of a portion of the vibration sensor 400 within the dotted rectangle shown in FIG. 4A. FIG. 4D is a cross-sectional view of the vibration sensor 400.

As shown in FIG. 4B, the 3-axis vibration sensor 400 comprises a ring-shaped structure 420 (hereinafter "vibration ring"). For example, the vibration ring is generally cylindrical in shape with a relatively large hollow central opening. Mounted at least partially within the vibration ring are ball bearings 425 that are spaced apart circumferentially and supported by the ring such that they at least partially protrude from an outer side surface of the vibration ring. In the exemplary vibration sensor 400, four evenly spaced apart bearings 425 are provided. The ball bearings 425 is are also referred to as a spherical tip or stylus.

The vibration ring is configured to be enclosed within the cylindrical second structure 120 both of which extend entirely about the drill string. In particular, the vibration ring is located in a cylindrical cavity 430 extending circumferentially through the cross section of the generally cylindrical second structure 120. The vibration ring is supported at a plurality of circumferential locations by a set of springs 415. In the exemplary configuration shown in FIGS. 4A, 4C and 4D, a set of three springs 415 are provided at each circumferential location, one spring extending from a top bounding wall of the cavity to a top wall of the vibration ring, one extending from a bottom bounding wall of the cylindrical cavity to a bottom wall of the ring and one extending from an inner bounding wall of the cavity to an inner wall of the vibration ring. As such, the spring-supported vibration ring is "floating" within the cylindrical cavity of the second structure such that it can move within the cavity in response to forces acting on the second structure including movement, vibrations, and the like.

The bearings 425 are configured to act as a spherical tip or stylus that contacts a screen 440 provided on an opposing surface of the second structure 120. One or more screens 440 are provided on the outer bounding wall of the cylindrical cavity that faces the outer surface of the vibration ring 420. FIG. 5A shows the same side-view of the SASS 40 shown in FIG. 4A, but also shows certain components of the speed sensor 100 housed within the second structure 120 that also serve the purpose of mounting the second structure 120 to the drillstring in a way that is capable of translating vibration forces from the drillstring to the vibration sensor 400.

FIG. 5A also shows a screen 440 provided for each of the four spherical bearings 425. As shown, a respective screen 440 can be provided opposite each spherical tip and can be sized, shaped, and positioned relative to the bearing so that the tip contacts the screen throughout the entire range of motion of the spherical tip. The spherical tip 425 and screen 440 provided at a circumferential location about the sensor 400 is referred to as a vibration sensor sub-unit.

The screen 440 comprises a sensor grid covering the area that spherical tip contacts. The vibration ring includes bearings that are positioned relative to the screen such that displacement of the vibration ring due to vibration moves the stylus tips over the grid in at least the vertical direction 402 and lateral 404 directions. FIG. 5A also includes a close-up isolated front-plan view and side-view of the spherical bearing 425 and screen 440. As shown, the spherical bearing preferably contacts the screen near its center-point when at rest and can move along the screen in both the vertical direction 402 and lateral direction 404 and preferably maintains contact with the surface of the screen throughout its range of motion. The screen is arranged such that movement of the stylus tip over the screen generates a series of electrical pulses that are representative of the vibration of the drill string assembly. The electrical pulses generated from the vibration sensor 400 can also be stored to power the signal processing instrumentation of the SASS. Moreover, the vibration sensor is 'active' and the system is 'self-powered'.

While FIG. 4A shows the vibration sensor 400 provided inside the top half of the second structure 120, above the speed sensor 100 (not shown), the vibration sensor 400 can similarly be provided in the bottom half of the second structure 120. As noted, the vibration sensor 400 can also be provided as a stand-alone sensor device.

Preferably, the second structure is mounted about the drill string in a manner such that the second structure remains relatively stationary while the drill string rotates within the central opening of the second structure. However, the second structure is coupled to the drill string such that vibrational forces of the drill string are transferred to the second structure enabling measurement of those forces using the vibration sensor. For example, FIGS. 5B and 5C illustrate two exemplary configurations for mounting the second structure 120 to the drill string using the rotating ring structure 110 and bearings 115 of the speed sensor 100. In particular, FIG. 5B shows a cross-section of an rotating ring structure 110 mounted to a drill string and disposed within an annular groove in the inner wall of the second structure. As shown, the side and top and bottom ball bearings are arranged to move within respective movement tracks formed in the second structure 120. Specifically, the top, side, and bottom ball bearings, 115T, 115S and 115B are arranged to move respectively within top, side and bottom movement tracks 555T, 555S and 555B. Movement tracks are essentially grooves formed in the top side and bottom surfaces of the annular groove formed in the inner wall of the second structure 120. The tracks guide the movement of the ball bearings as the rotating ring 110 rotates within the annular groove. FIG. 5C illustrates a slightly different configuration in which multiple side movement tracks 555S' are provided in the side-wall of the annular groove and configured to receive multiple rows of side ball bearings 115S' protruding from the side wall of the first structure 110. Thus, it can be appreciated that the first and second structure are mechanically coupled by the ball bearings extending through the side and the top/bottom surfaces of the rotating ring within the annular groove.

During drilling a well structure the inner rotating ring 110 will rotate with the drillstring assembly. The ball bearings preferably have negligible friction so that outer second structure remains stationary while the rotating ring rotates with the drillstring assembly. Any vibration of the drillstring assembly will be the same for the first structure and will be transferred to the outer second structure 120 via the ball bearings.

Multiple different screen and spherical tip configurations can be used in the vibration sensor 400 in accordance with one or more of the disclosed embodiments. FIGS. 6A-7B illustrate two exemplary configurations of a vibration sensing sub-unit of the vibration sensor 400. In either configuration, preferably, the spherical tip is designed in a way so that it can move along the screen in contact with the screen. The outer layer of the screen, which contacts the tip, is flexible to be sensitive to the movement of the spherical tip while a rigid inner layer connected to the inner surface of the second structure 120 provides mechanical stability to the screen.

FIG. 6A includes an isolated front-plan view of an exemplary configuration of a vibration sensor sub-unit in accordance with an embodiment. The sub-unit comprises a stylus 425 and a screen 640 having a grid-like structure resembling a checkerboard with alternating squares (shown black and white for illustration). Each square of the grid can be connected to a signal analysis circuit in a manner such that signals from respective squares are distinguishable and the square generating an electrical signal can be uniquely identified (e.g., by its coordinate in the array). The squares can be any size, however, the size of the individual segments can be defined according to the desired sensitivity of the sensor. Alternatively, the screen can comprise a repeating pattern of other shapes including repeating rectangles, diamonds, circles, ellipses, and polygons of any size. In the exemplary arrangement shown in FIG. 6A, the black and white squares represent segments made from materials A and B, respectively, and the spherical tip is made from material A.

During drilling, the drill bit at the bottom of the drill string assembly penetrates through downhole rock formations, which results in the vibration of the drill string assembly. During vibration, the vibration ring inside the SASS 40 will move according to the direction of the vibration. Since multiple vibration sensor sub-units including a screen 640 and spherical tip 425 can be positioned circumferentially around the SASS, the vibration can be detected by the sensor 400 in all three axes, x, y, and z. The external mechanical stimuli, vibration magnitude and frequency, can be detected by the position of the spherical tip moving along the grid and the change in position of the tip over time. The movement of the spherical tip across segments of the array results in the contact and separation between material A and material B. Material A and material B are of opposite polarity or polarities as distant as possible to each other. For example and without limitation, materials A and B can be made of materials such as, Polyamide, Polytetrafluoroethylene (PTFE), Polyethylene terephthalate (PET), Polydimethylacrylamide (PDMA), Polydimethylsiloxane (PDMS), Polyimide, Carbon Nanotubes, Copper, Silver, Aluminum, Lead, Elastomer, Teflon, Kapton, Nylon or Polyester.

Generating an electrical pulse by friction is based on the principle that an object becomes electrically charged after it contacts another material through friction. When two materials, e.g., Materials A and B contact, charges move from one material to the other. Some materials have a tendency to gain electrons and some to lose electrons. If material A has a higher polarity than material B, then electrons are injected from material B into material A. This results in oppositely charged surfaces. When these two materials are separated there is a current flow, when a load is connected between the materials, due to the imbalance in charges between the two materials.

In practice, as the spherical tip 425 moves along the surface of the checkered grid 640 due to vibration of the drill string assembly, it moves over and along the black and white squares comprising materials A and B, respectively, generating an electrical signal at specific coordinates of the grid. Each of the squares can be connected to a signal analysis circuit, which can include a voltage and/or current meter, in a manner such that signals output by respective squares are uniquely identifiable (e.g., by grid coordinates) and distinguishable. Based on the measured signal, and the known grid coordinate associated with the square(s) outputting the signal, the location of the stylus on the grid at the point in time the signal is sampled can be determined. The relative displacement of the spherical tip from its stationary, centered position (e.g., in any one or more of the directions shown by the directional arrows), can thus be determined allowing for the vibration imaging/mapping of the drill string assembly. Therefore, highly selective real-time profiles of vibration can be visualized through the distribution of the electrical signal on the grid area over time. FIG. 6B is a side-view of the stylus tip 425 moving along the surface of the grid 640 in the direction of arrow 645 between grid position p1 and p7 and the corresponding electrical signal 650 generated as a result of the stylus 425 contacting and interacting with the alternating materials that comprise the checkered screen 640.

FIG. 6C shows another exemplary embodiment of a screen and stylus that can be utilized in the vibration sensor 400. In this configuration, the screen comprises a grid 740, wherein the squares of the grid are discrete segments and made of a piezoelectric material such as quartz, langasite, lithium niobate, titanium oxide, lead zirconate titanate, or any other material exhibiting piezoelectricity. As the spherical tip 425 moves along the grid (e.g., in one or more of the directions shown by the directional arrows) due to vibration of the drill string assembly, it applies pressure on the piezoelectric material. The mechanical stresses experienced by the piezoelectric materials due to this contact results in the generation of electric charges which can be measured from leads connected to respective units. The piezoelectric material goes through the motions of being stressed and released and thus generates electrical pulses due to the movement of the spherical tip relative to the vibration of the drill string assembly. FIG. 6D is a side-view of the stylus tip 425 moving along the surface of the grid 740 in the direction of arrow 745 and the corresponding pulses that are generated as a result of the stylus 425 contacting and pressing against the individual sections of the grid at position p1 and p2.

As noted, the stylus tip moving along the respective screen provide signals representing magnitude and frequency of vibration. An exemplary approach to visualize and analyze this data in a meaningful way is shown in FIGS. 7A-7F. In FIG. 7A, the screen comprises a plurality of sensor elements (e.g., squares 775) arranged in a two-dimensional 2D grid 740 with x and y coordinates. To explain the method for locating the measured vibration signals and identifying respective grid squares, numbers are included on the x-y grid axis. During operation, the stylus tip scrolls/rolls along the piezoelectric squares/buttons of the screen. The piezoelectric materials are not limited to squares but can be any size, shape, pattern and pitch depending on requirements and optimal signal generation.

The distribution of the 2D spatial navigation of the stylus tip over the screen according to the vibration can be reconstructed in several ways. The signal generated every time the stylus tip contacts and separates from the piezoelectric square/button can be stored in the memory with the specific coordinates on the screen. Note that the signal appears during the contact and separation and is repeatable and reconfigurable so multiple signals can be generated on the same coordinates over a given sampling frequency/frame. The sequence of movement of the stylus tip over a given sampling frequency/frame can be traced as illustrated by the trace overlaid the screen in FIG. 7A. It should be understood that the traces might not be in straight lines and can follow smoother movements along the screen. In FIG. 7A, for example, the stylus tip moves from squares having coordinates (0,0), (−1,1), (−2,0), (−1,−1), (0,−1), (0, −2), (1,−2), (0,−1), (1,−1), (1,0), (2,0) to (1,1), thereby creating a spatial and temporal traced image with visual coherence of the vibration. For example, the further the distribution of traces on the screen over a given sampling frequency/frame, the higher the magnitude of the vibration. For example, FIG. 7B illustrates an exemplary trace representing a higher vibration magnitude than FIG. 7A. Also, the higher the number of traces over a given sampling frequency/frame, the higher the frequency of vibration. For example, FIG. 7C illustrates an exemplary trace representing a higher frequency of vibration than FIG. 7A.

From the sequences the data can also reconstructed as a heat/contour map. FIG. 7D and FIG. 7E illustrate exemplary heat/contour map visualizations generated from the vibration sensor output. Note that the distribution of traces on the screen in FIG. 7E are the same on both the screen shown to the left and the screen shown to the right, revealing similar magnitudes of vibration, but the number of traces change, revealing different frequencies of vibration. In the exemplary visualizations shown in FIG. 7D, the grid can have contours for the response variable, vibration, and the sequence of the traces shows the magnitude of the vibration. The squares/buttons on each contour with traces related to the vibration are highlighted in the given contour. Similarly, as shown in FIG. 7E, squares/buttons that have had multiple traces over a given time can be represented with a darker color or shading.

FIGS. 7C-7E can also be visualized as frames over time, where time can be correlated to depth of drilled formation as well as drilling dynamics, hydraulics, and rheology to gain insight and optimize drilling parameters to increase drilling efficiency. For example, to the left side of FIG. 7F a sequence of grid images including a respective vibration trace is shown. To the right of FIG. 7F, a sequence of heat/contour maps are shown along with a vibration trace. Moreover, several frames can also be overlaid on top of each other for different formations for example to better understand vibration of the drillstring assembly and optimize drilling parameters to reduce vibration.

Vibration can also be obtained in all three dimensions as shown in FIG. 7G. The screens are visualized in 2D, as shown in FIGS. 7B-7F for example. However, screens are located around the self-powered active sensing system to acquire vibration data in all three axes. For example FIG. 7G conceptually illustrates the placement of the four screens shown in FIG. 5A as being equally spaced about the circumference of the vibration sensor 400 and thereby enabling the vibration sensor to measure vibration in three dimensions. A simple explanation with reference to FIG. 7G is that if there is high vibration primarily in the X-axis, this would be shown in screens X1-Z and X2-Z. If there is high vibration primarily in the X-Z axis, this would be shown in screens X1-Z and X2-Z. If there is high vibration primarily in the Y-axis, this would be shown in screens Y1-Z and Y2-Z. If there is high vibration primarily in the Y-Z axis, this would be shown in screens Y1-Z and Y2-Z. If there is high vibration primarily in the Z-axis, this would be shown in screens X1-Z, X2-Z, Y1-Z and Y2-Z. In practice, vibration can be in all three dimensions and visualizing the data from the screens can be utilized to obtain a clear picture of vibration. Also, the number of screens are not limited to four but can be as many as that would fit around the SASS.

Exemplary Speed Sensor Configurations

Exemplary configurations of the speed sensor 100, as shown and described above with reference to FIGS. 1A-2C, are further described herein with reference to FIGS. 8-13 and with continued reference to FIGS. 1A-2C. Multiple different ball bearing 115 and moveable member 125 configurations can be used in the speed sensor 100 in accordance with one or more of the disclosed embodiments. FIG. 8 shows an exemplary configuration of a speed sensor, e.g., speed sensor 100 for measuring revolutions per minute (RPM) during the drilling process. As discussed above, the speed sensor can comprise plural sets of opposing top and bottom moveable members spaced circumferentially about a groove within the second structure 120 and a rotating ring-like first structure 110 having top and bottom bearings configured to displace the top and bottom moveable members as the first structure rotates within the second structure. FIG. 8 provides a close-up, cross-sectional side view of an isolated set of top and bottom moveable members and top and bottom bearings in accordance with an embodiment. In particular, each set of moveable members comprise a top moveable member 825T and a bottom moveable member 825B. Also shown is a segment of the first structure 110 comprising a top ball bearing 815T and bottom ball bearing 815B that protrude from the top and bottom surfaces of the first structure 120. FIG. 8 illustrates the position of the moveable members 825T and 825B as the ball bearings 815T and 815B move across the moveable members in the direction shown by arrow 845 in three stages, namely, prior to contact, during contact/fully compressed, and after contact.

As shown in FIG. 8 the top and bottom movable members 825T and 825B are connected to the second structure 120 by springs 827T and 827B, respectively, and can move up and down within respective openings or "channels" 828T and 828B provided in the walls of the second structure 120 that bound the annular groove. As the first structure 110 rotates with the drill string assembly, the top and bottom bearings 815T and 815B respectively make contact with the top and bottom movable members 825T and 825B. The springs 827 are configured to urge the moveable members in the direction of the first structure to ensure maximum contact with the opposing bearings and compress and expand multiple times over the course of a drilling operation.

In the exemplary arrangement shown in FIG. 8, the top and bottom ball bearings 815T and 815B are made of or coated with material A and the movable members 825T and 825B of the second structure 120 are made of material B, wherein material A and material B have opposite polarity or have polarities that are as distant as possible to each other. Generating electricity by friction is based on the principle that an object becomes electrically charged after it contacts another material through friction. When they contact, charges move from one material to the other. Some materials have a tendency to gain electrons and some to lose electrons. If material A has a higher polarity than material B, then electrons are injected from material B into material A. This results in oppositely charged surfaces. When these two materials are separated there is a current flow, when a load is connected between the materials, due to the imbalance in charges between the two materials. The current flow continues until both the materials are at the same potential. When the materials move towards each other again there will be a current flow but in the opposite direction. Therefore, this contact and separation motion of the bearings and moveable members comprising materials A and B can be used to generate an electrical signal. FIG. 8 (bottom) shows a generated signal from the relative movement of the bearings and moveable members corresponding to the three stages shown in the FIG. 8. The time between electrical signals can be utilized to deduce the RPM of the drill string assembly. Materials A and B can be made of materials such as, Polyamide, Polytetrafluoroethylene (PTFE), Polyethylene terephthalate (PET), Polydimethylacrylamide (PDMA), Polydimethylsiloxane (PDMS), Polyimide, Carbon Nanotubes, Copper, Silver, Aluminum, Lead, Elastomer, Teflon, Kapton, Nylon or Polyester.

FIG. 9A provides a close-up, cross-sectional side view of an isolated set of moveable members and bearings in accordance with another exemplary embodiment of a speed sensor such as speed sensor 100. In particular, each set of moveable members comprise a top moveable member 925T and a bottom moveable member 925B. Also shown is a segment of the first structure 110 comprising a top ball bearing 915T and bottom ball bearing 915B that protrude from the top and bottom surfaces of the first structure 110. FIG. 9 illustrates the position of the moveable members 925T and 925B in three stages as the ball bearings 915T and 915B move across the moveable members in the direction shown by the arrow, namely, pre-compression, compression, and post-compression.

Although not shown in FIG. 9A, the top and bottom movable members are connected to the second structure 120 by springs, and can controllably guide movement of the moveable members up and down within respective channels provided in the second structure 120.

In accordance with one or more embodiments, each the movable member has a coating of material B on its proximal end surface, and the interior end of the channel enclosing the members are coated with material A. As the drill string assembly rotates, the top and bottom ball bearings 915T/B of the first structure 110, made from steel for example, contact the movable members 925T/B of the second structure 120. The moveable members can be made from any material that is able to operate at high temperatures (>150° C.) and high pressures (>5000 psi), has an abrasion and wear resistance suitable for the intended environment. This contact (and the opposing force of the spring) propels the movable members upwards/downwards and downwards/upwards within the channel. This results in contact between material A and B and therefore, the generation of an electric signal. FIG. 9A (bottom) shows a generated signal from the movement of the moveable members corresponding to the three stages, pre-compression, compression, and post-compression.

FIG. 9B provides a close-up isolated view of an exemplary assembly configured to maintain a moveable member, for instance, 925T, in position as it is moving within the channel 928T provided in the second structure 120. As shown in FIG. 9B, two movement tracks 950, each containing a spring 927 and ball bearing 955 or other suitable bearing device, are arranged to ensure that the movable member returns to an extended position after it retracts into the enclosing channel 928T and also does not fall out of the enclosing channel.

The ball bearing 955 can be mounted to the movement track 950 and in contact with the moveable member 925T (or vice versa) so as to guide the movement of the moveable member. The spring 927 can be connected between the second structure and the moveable member. The spring ensures that the movable member retracts and extends and is configured to ensure the impact of material B and material B occurs in a controlled manner. The stiffness of the springs can be optimized to maximize the contact and separation motion and can be any size and shape to move and constrain material A only in the direction of material B. The springs are preferably configured in such a way to minimize motion retardation and experience compression and extension at the same time. The springs also contribute to the momentum of material A contacting material B therefore, increasing the charge transfer between the two materials. Generally, springs obey Hook's law and produce restorative forces directly proportional to their displacement. They store mechanical energy in the form of potential energy and release it as the restorative force, resulting in a constant spring coefficient. Springs can also be tuned to produce restorative forces that are not proportional to their displacement. Preferably, springs 927 are not governed by Hook's law so they can be made to provide restorative forces as required by the application. The springs 927 may be used can be compression, extension, torsion, Belville springs or any other system made from elastic materials.

FIG. 10A provides a close-up, cross-sectional side view of an isolated set of moveable members and bearings in accordance with another exemplary embodiment of a speed sensor such as speed sensor 100. FIG. 10A shows the surface of the movable members 1025T/B, particularly the portion that is moveable within the second structure 120, and the surface of the enclosing channels 1028 coated with materials A and B in an alternating fashion. The alternating sections of materials A and B are shown by the alternating black and white segments on the sides of the channels and sides of the moveable members.

In such a configuration, as the drill string assembly rotates the top and bottom ball bearings 1015T and 1015B of the first structure 110 makes contacts with the top and bottom movable members 1025T and 1025B of the second structure 120 propelling the movable members into their respective channels. The sliding motion of the moveable members triggers contact between materials A and B provided on both the movable members and the channels resulting in the generation of an electric signal. FIG. 10A illustrates the position of the moveable members in three stages as the ball bearings move across the moveable members in the direction shown by the arrows, namely, pre-compression, compression, and post-compression. FIG. 10A (bottom) shows a generated signal from the movement of the moveable members throughout the three stages.

Although not shown in FIG. 10A, the moveable members can be spring biased as well resulting in the repeating upward/downward movement of the moveable members. FIG. 10B provides a close-up isolated view of exemplary assemblies configured to maintain a moveable member, for instance, 1025T, in position as it is moving within the channel 1028 provided in the second structure 120. In one exemplary arrangement shown in FIG. 10B (a, top), similar to the configuration shown in FIG. 9B, two movement tracks 1050 that each contain a spring 1027 and ball bearing 1055 or other suitable bearing device, are arranged to ensure that the movable member returns to an extended position after it retracts into the enclosing channel 1028 and also does not fall out of the enclosing channel. In FIG. 10B (b, bottom), an another exemplary arrangement is shown in which a single spring 1027B extends between the base of the moveable member and the structure 120 and is arranged to ensure that the movable member returns to an extended position after it retracts into the enclosing channel 1028 and also does not fall out of the enclosing channel.

FIG. 11A provides a close-up, cross-sectional side view of an isolated set of moveable members and bearings in accordance with another exemplary embodiment of a speed sensor such as speed sensor 100. In FIG. 11A the movable members 1125T and 1125B in the second structure 120 have a curved surface at both distal/external and proximal/internal ends. Also provided within the channels 1128 enclosing the moveable members toward an interior end is a piezoelectric material 1122 such as quartz, langasite, lithium niobate, titanium oxide, lead zirconate titanate, or any other material exhibiting piezoelectricity. As the drill string assembly rotates the top and bottom ball bearings of the first structure 110 makes contacts with the movable members of the second structure 120 propelling the movable members into respective channels. This movement results in contact of the internal end of the movable members with the piezoelectric material 1122. The mechanical stresses experienced by the piezoelectric material due to this contact results in the generation of electric charges. Although not shown, expansion of a spring or the piezoelectric material within the channels urges the moveable members outward in the direction of the first structure in the absence of contact with the bearings. The repeating motion due to the constant rotation of the drill string assembly while drilling enables the piezoelectric material to go through the cycles of being stressed and released and, as a result, generate an electric signal. FIG. 11A illustrates the position of the moveable members in three stages as the ball bearings move across the moveable members in the direction shown by the arrows, namely, pre-compression, compression, and post-compression. FIG. 11A (bottom) shows a generated signal from the movement of the moveable members throughout the three stages.

Although not shown in FIG. 11A, the moveable members can be spring biased resulting in the repeating upward/downward movement of the moveable members. FIG. 11B provides a close-up isolated view of an exemplary assembly configured to maintain a moveable member, for instance, 1125T, in position as it is moving within the channel 1128 provided in the second structure 120. In one exemplary arrangement shown in FIG. 11B, similar to the configuration of FIG. 9B, two movement tracks 1150, each containing a spring 1127 and ball bearing 1155 or other suitable bearing device, are arranged to ensure that the movable member returns to an extended position after it retracts into the enclosing channel 1128 and also does not fall out of the enclosing channel.

FIG. 12 provides a close-up, cross-sectional side view of an isolated set of moveable members and bearings in accordance with another exemplary embodiment of a speed sensor such as speed sensor 100. FIG. 12 shows the movable members 1225 are connected to the second structure 120 by piezoelectric ribbons 1222. These ribbons can be for example ceramic nanoribbons, such as lead zirconate titanate, which generates electricity when flexed and stressed. The nanoribbons can also be encased in a flexible elastomer. As the first structure 110 rotates with the rotation of the drill string assembly the top and bottom bearings rotate around and make contact with the movable members of the second structure 120. This contact results in the up and down/down and up movement of the members, which generates an electrical signal by flexing/stressing the piezoelectric ribbons. FIG. 12 illustrates the position of the moveable members in three stages as the ball bearings move across the moveable members in the direction shown by the arrows, namely, pre-compression, compression, and post-compression. FIG. 12 (bottom) shows a generated signal from the movement of the moveable members and piezoelectric ribbon throughout the three stages.

The various exemplary sensor configurations that generate electrical signals described in FIGS. 6-12 can also be utilized to harvest energy to power other sensors and instrumentation. Moreover, the various movable member configurations described in FIGS. 8-12 can, in addition or alternatively, be provided on the inner side surface of the second structure 120, as shown in FIG. 13.

FIG. 13A is an assembled side-view of an exemplary configuration of a speed sensor 1300 for measuring revolutions per minute (RPM) during the drilling process. The speed sensor can comprise a second structure 1300 having a similar configuration as second structure 120. Moveable members 1325 (omitted from FIG. 13A) are provided on the side-wall of an annular groove within the second structure 1320 and are spaced apart circumferentially. The moveable members extend from within channels 1328 formed in the side-wall of the second structure in the direction of the middle of the second structure 1300. The sensor 1300 also includes a rotating ring-like first structure 1310 having side-mounted bearings 1315 configured to displace the moveable members as the first structure rotates within the second structure. FIG. 13B provides a close-up, cross-sectional side view of an isolated side-mounted moveable member 1325 and side-mounted bearing 1315 in various possible configurations, namely, the exemplary configurations shown and described in connection with FIGS. 8-12. In each such configuration, during the rotation of the drill string assembly electricity is generated when the ball bearings on the outer side surface of the first structure 110 roll along the inner side surface of the second structure 120, triggering all the movable member actions described in connection with FIGS. 8-12.

Exemplary SASS Electronics

FIG. 14A shows a side-view of an exemplary SASS, for example, SASS 10, including a ring-shaped flexible electronics circuit 170 and a radio frequency (RF) communications module referred to as the antenna-transceiver 180. The left side of FIG. 14A shows the assembled SASS with the circuit 170 and antenna-transceiver 180 located inside the second structure 120 whereas the right side of FIG. 14A is an isolated perspective view of the flexible circuit 170 and antenna-transceiver 180. Sensors and instrumentation other than the vibration and speed sensors and signal processors of the SASS that require power to operate, can be fabricated on a flexible substrate. The resulting flexible electronics circuit(s) 170 can be made up of metal-polymer conductors, organic polymers, printable polymers, metal foils, transparent thin film materials, glass, 2D materials such as graphene and MXene, silicon or fractal metal dendrites. The antenna-transceiver 180 can comprise an RF communications module in electronic communication with the flexible circuit 170, particularly a processor. The antenna-transceiver 180 can also include compact antenna that can also be provided on a flexible substrate and is used to transmit and receive sensor information.

Although FIG. 14A shows the electronics circuit 170 and antenna-transceiver 180 incorporated into the exemplary configuration of the SASS 10 which includes a speed sensor 100 and does not include a vibration sensor, it should be understood an electronics circuit 170 and antenna transceiver 180 could similarly be included in SASS 40, which comprises both a vibration sensor 400 and a speed sensor 100. Similarly, an electronics circuit 170 and antenna transceiver 180 could similarly be included in the exemplary configuration of a SASS that comprises a vibration sensor 400 and does not include a speed sensor 100.

FIG. 14B is a conceptual diagram of an exemplary arrangement electronic components that can be provided on the flexible circuit 170 or as part of the antenna-transceiver 180 of a SASS. In accordance with one or more embodiments, the generated analog electric signals obtained by energy harvesting using one or more of the vibration sensor and speed sensor can be converted to digital signals by an analog-to-digital converter 171 (ADC) provided on the flexible circuit 170. The signals can be stored in an analog power storage unit 172 provided on the flexible circuit 170, such as a regular di-electric capacitor de-rated for use at high temperatures, a ceramic, an electrolytic or a super capacitor. By storing the energy in a storage unit, power can be provided continuously to one or more powered sensors 178, instrumentation and communication devices e.g., the antenna-transceiver 180. Powered sensors 178 that can be communicatively coupled to the SASS electronics can be, for example, low power temperature, pressure, strain, magnetic field, or electric field sensors.

Returning now to FIG. 14B, as noted the storage unit 172 provided on the flexible circuit 170 can be configured to supply power to the low power signal processing circuitry 175. The low power signal processing circuitry 175 can be configured to condition the data, store it in local memory 176 and perform power management by interfacing with the energy source (e.g., active speed sensor 100 and/or active vibration sensor 400) and storage unit 172 to deliver the appropriate system voltages and load currents to the circuit blocks of the flexible circuit 170 in an efficient manner. The low power signal processing circuitry 175 can be CMOS-based, microcontroller-based, digital signal processor (DSP)-based, field programmable gate array (FPGA)-based, application-specific integrated circuit (ASIC)-based, complex programmable logic device (CPLD) or system-on-chip (SoC).

The SASS 10 also has an RF communications module comprising an antenna and transceiver 180, which is also referred to as a communication module. The communication module is in electronic communication with the flexible circuit 170. The antenna could be polymer-based, paper-based, PET-based, textile-based, carbon nanotube (CNT)-based, artificial magnetic conductor-based, kapton-based or nickel-based metamaterial. The transceiver can be configured to employ low power wireless communication technologies such as low-power WI-Fi, Bluetooth, Bluetooth Low Energy, ZigBee, etc. Higher frequencies allow a better signal and a longer transmission distance. However, the system is preferably optimized since attenuation and power requirements are also higher at higher frequencies. The antennas can be directional, omni-directional and point-to-point. They can also be planar antennas such as monopole, dipole, inverted, ring, spiral, meander and patch antennas. Power management is a crucial component of the communication module. For example, the communication module does not have to be active continuously nor does it have to operate simultaneously. The communication module can have an 'active' mode, a 'stand by' mode and a 'sleep' mode. The 'active' mode is short since the communication module generally only has one short task in the whole system, transmitting or receiving data, followed by a relatively longer 'stand by' time and a longer 'sleep' time. The energy saved in the 'stand by' and 'sleep' times can be used to drive the communication module in the 'active' mode.

FIGS. 14C and 14D are conceptual block diagrams illustrating an exemplary configuration of the signal processing components of a SASS including a vibration sensor and, in addition or alternatively, a speed sensor. FIGS. 14C and 14D also illustrate the flow of sensor data from sensors producing a raw sensor data stream 1470, through the signal processing circuitry of the SASS electronics and up to the surface where the processed sensor data can be further processed and/or output. The low power signal processing circuitry, which can be used to store the sensor data with coordinates and create the images shown in FIGS. 7B-7F for example, can be CMOS-based, microcontroller-based, digital signal processor (DSP)-based, field programmable gate array (FPGA)-based, application-specific integrated circuit (ASIC)-based, complex programmable logic device (CPLD) or system-on-chip (SoC).

The exemplary configuration of the SASS shown in FIGS. 14C and 14D uses an FPGA 1475, however, any suitable low-power signal processing circuits can be configured and utilized for image reconstruction such as the low power signal processing circuits mentioned above. FPGA circuits do not require layouts, masks, or other manufacturing steps, has a simpler design cycle, a more predictable project cycle and field reprogrammability. FPGAs can be re-used and are cheaper than ASICs. Since the FPGA can be reprogrammed easily, a design can be loaded into the part, tried at-speed in the system and debugged when required. This is ideal for board-level testing where the FPGA can be configured to verify the board or the components on the board. After the testing is finished the FPGA is reconfigured with the application logic. FPGAs have logic cells/blocks, programmable interconnects, embedded block memory and input/output blocks to design a reconfigurable digital circuit. Accordingly, the electrical signals generated by the vibration sensor screen first have to be changed from an alternating/oscillating form to a direct current, which can be performed by an analog-to-digital converter 1471, as shown in FIG. 14C. Raw analog speed sensor signal data stream can similarly be converted.

The data collected through the ADC 1471 allows a large number of channel signals to be sampled simultaneously. The data is then sent to the FPGA 1475, where various signal processing algorithms can be implemented to manipulate and store the data in memory (not shown). The memory can be static random access memory (SRAM), dynamic random access memory (DRAM) or electrically erasable programmable read-only memory (EEPROM)/Flash memory, depending on requirements. The data is preferably stored in a way so that it can easily be recovered at the surface to reconstruct and visually display the data including, for example, virtualized screen images shown in FIGS. 7B-7F to analyze vibration data.

The piezoelectric squares of the vibration sensors can also be connected in series or parallel and the FPGA(s) can be configured to correlate the variation of piezoelectric signal to the specific location where the contact and separation occurred on the screen. FPGA is central to the system which controls the data acquisition system, storage and subsequent data read back. The data can also be processed by a graphics processing unit (GPU) so that vibration analysis screens can be visualized directly from the input. GPUs have high computation density, high computations per memory access and can perform many parallel operations, which results in high throughput and latency tolerance. GPUs can also be integrated with a microcontroller or a digital signal processor (DSP).

There are multiple ways to obtain the measured data at the surface. The first method is to download the data once the drillstring assembly is pulled out of a wellbore after a drilling run. For instance, the data can be downloaded from the SASS processing unit FPGA 1475 to a display device 1485 by a data communications interface such as Ethernet, universal serial bus (USB), secure digital (SD) card, I2C and universal asynchronous receiver transmitter (UART). The display device 1485 can be a liquid crystal display (LCD), organic light-emitting diode (OLED) or any display device that can show, for example, the vibration data screens.

An additional or alternative approach shown in FIG. 14D the SASS can be configured to convert the signals output by the FPGA 1475 back to analog form by a digital-to-analog converter 1481 (DAC) and send them to a radio frequency (RF) module 1480 and transfer the data wirelessly by an antenna to a display (not shown). Another way to provide measured data to the surface is to utilize the distributed sensing system and communication method shown and described herein in connection with FIG. 18 wherein data can be transmitted along the drillstring wirelessly, moving along the SASS data units as in a relay from the bottom to the surface and from the surface to the bottom. Additionally, data-carrying capsules shown and described in connection with FIG. 19 can be used to carry data from the SASS units to the surface.

In accordance with one or more embodiments of the disclosure, the memory for storing the vibration and/or RPM signals generated by a speed sensing device of the SASS can be provided within the FPGA. In addition or alternatively, the memory can also be an external storage device shared by both an FPGA and microcontroller, as shown in FIG. 14E. FIG. 14E is a conceptual circuit diagram showing an exemplary arrangement of SASS components and the process for harvesting energy and power storage for powering the FPGA/microcontroller and communications circuitry.

As shown in FIG. 14E, in a first stage 1405, power usable to power the SASS electronics can be generated by an active speed sensor, such as speed sensor 400. A collection of exemplary triboelectric and piezoelectric speed sensors 1440 (e.g., as previously shown and discussed in connection with FIG. 13B) are shown as generating an electric charge signal usable to determine both speed and power the SASS electronics. Note that no power is consumed to generate the sensor vibration/RPM signals as they are active sensors. Power is only required for signal conditioning, processing and storage by the FPGA and microcontroller, and wireless transmission by the RF module.

Both triboelectric and piezoelectric energy harvesting methods require an external force to be applied and removed for the generation of electric charges. The external force can result in, a material being stressed, deformed, and released back to its original shape, as is the case in piezoelectric energy harvesting. In the case of triboelectric energy harvesting, the external force can result in two materials contacting each other either by directly impacting and separating, or by sliding and separating, against each other. In all these cases, one cycle of stress (short circuit)/release (open circuit) or contact (short circuit)/separation (open circuit) results in charges flowing in one direction and then in the opposite direction, leading to a positive and a negative voltage waveform. The generation of charges and the continuity of the waveform depend on the rate of rotation of the drillstring assembly. The charges can directly be utilized to power the flexible electronics but a more feasible way to optimize this generated electricity is to store the electrical energy so that it can be used as a regulated power source for the flexible electronics even when there is no drillstring rotation.

Accordingly, in the arrangement of the exemplary SASS 1400 shown in FIG. 14E, the generated electrical signal first has to be changed from an analog signal to a digital signal, at stage 1410. This can be achieved by a bridge rectifier circuit 1445, employing diodes for example. The output of the ADC can be connected to an energy storage device 1450 for storage at stage 1415. The storage device can be either a regular di-electric capacitor de-rated for use at high temperatures, a ceramic, an electrolytic or a super capacitor. By storing the energy in a capacitor, in stage 1420, power can be provided continuously to the sensors 1442, processing instrumentation (e.g., FPGA/microcontrollers) and communication modules 1460. Compared to batteries, capacitors are easier to integrate into a circuit, are generally cheaper, can be bought off the shelf and are easier to dispose of.

As explained above and shown in FIG. 14E, the flexible electronics circuit is arranged such that the vibration and speed sensors 1442 are connected to a FPGA/microcontroller 1455 for receiving sensor data, and a transceiver 1460 is also communicatively coupled to the FPGA/microcontroller for receiving and transmitting sensor data. Sensors 1442 can include vibration and speed sensors including the speed sensors 1440, even though speed sensors 1440 are also shown separately in FIG. 14E.

The storage unit 1450 provides power to the FPGA/microcontroller, which performs the power management and control and logic functions of the SASS device 1400, including to the sensors and transceiver 1460. The transceiver utilizes low power wireless technologies such as low-power Wi-Fi, Bluetooth, Bluetooth Low Energy, ZigBee, etc. The antennas can be directional, omni-directional and point-to-point. They can also be planar antennas such as monopole, dipole, inverted, ring, spiral, meander and patch antennas.

The power consumption of the SASS electronics 1400 is preferably minimized and therefore, power consumption should be carefully controlled. The processor (e.g., FPGA/microcontroller 1455) interprets and processes information stored in the memory. The processor, memory and the transceivers and antenna each have its own level of power usage. The sensors do not require power to operate and so, have no power consumption. Therefore, the sensors are able to continuously obtain data and they are 'active' continuously.

The FPGA/microcontroller 1455 is preferably configured to obtain data at a high sample rate and the transceiver 1460 is designed to transmit and receive data at pre-determined times or when triggered by an external signal. Moreover, since transceivers require more energy than FPGA/microcontroller unit to transmit/receive data, only a sample of data after analysis by the FPGA/microcontroller, rather than all the sensed data, could be transmitted/received to save power downhole. For example, all the components in the transceiver module 1460 do not have to be active continuously nor do they have to operate simultaneously. Each component can have an 'active' mode, a 'stand by' mode and a 'sleep' mode. The 'active' mode is short since each component generally only have one short task in the whole system, followed by a relatively longer 'stand by' time and a longer 'sleep' time. The energy saved in the 'stand by' and 'sleep' times can be used to drive a component in the 'active' mode.

As shown in FIG. 14E and described above, the sensor data signals are processed and stored in storage 1450. In addition or alternatively, sensor signals can be conditioned, processed, and stored by an FPGA, for example, in a digital memory. In addition or alternatively, the exemplary configuration shown in FIG. 14E can be adapted such that, instead of connecting the output of the bridge rectifier to the capacitor storage device, the output can be sent directly to the FPGA/microcontroller for processing and storage in a memory accessible to the FPGA.

Powered Vibration Sensor Configurations

While the vibration sensor 400 comprises a screen 440 that is self-powered in accordance with the exemplary embodiments shown and described in connection with FIGS. 4-7, in one or more embodiments, the vibration sensors can incorporate a powered screen for sensing a position and movement of the stylus thereon. More specifically, FIG. 15A-15B shows an exemplary powered configuration of the screen used in a vibration sensor of a SASS. FIG. 15A is a front-plan view of the screen comprising a grid 1540 and FIG. 15B provides a cross-sectional side view of a portion of the grid 1540. As shown, the screen comprises a grid 1540 of discrete squares each having an upper electrode 1541 and an opposing lower electrode 1543 separated by a dielectric layer 1542 and thereby forming a capacitor. Each of the squares/capacitors can be individually connected to a signal analysis circuit in a manner such that the signals generated by the squares/capacitors are uniquely identifiable (e.g., by grid coordinates) and distinguishable. When the spherical tip 425 moves along the screen 1540, say, in the direction indicated by the arrow shown in FIG. 15B, it presses on the top electrode 1541 toward the bottom electrode 1543 and changing the distance between the top and the bottom electrodes. This results in the change in the electric field and hence, the capacitance of the capacitor. Based on the capacitance change, which can be measured using any suitable capacitance meter, and the known grid coordinates of respective squares/capacitors, the location of the stylus on the grid can be determined and vibration measured accordingly.

In yet a further arrangement, each individual capacitor defined by the upper electrode square, bottom electrode square and dielectric layer therebetween can define a capacitor in a respective RLC (resistor, capacitor, inductor) circuit, for example, as shown in the circuit diagram of FIG. 16. Each of the RLC circuits can be individually connected to a signal analysis circuit, which can include a resonance frequency meter, in a manner such that the RLCs are uniquely identifiable (e.g., by grid coordinates) and distinguishable. The change in capacitance due to the spherical tip pressing down on the top electrode results in the shift of the resonance frequency of the RLC circuit. Based on the resonance frequency shift, and the known grid coordinate associated with a respective RLC circuit, the location of the stylus on the grid can be determined and vibration measured accordingly.

FIG. 17A-17B shows another exemplary powered configuration of a screen and stylus that can be utilized in a powered variant of the vibration sensor 400 of a SASS. FIG. 17A is a top-plan view of the vibration sensor grid 1740 and FIG. 17B provides a cross-sectional side view of a portion of the grid 1740 and a diagram of a circuit connected thereto. As shown, the screen comprises a grid 1740 of discrete squares made of a piezoresistive material such as silicon, carbon nanotube/polymer composites, silicon carbide, graphene, samarium monosulfide or Heusler compounds. Each of the piezoresistive squares forms part of a Wheatstone bridge circuit 1780 that is connected to a signal analysis circuit, which can include a voltage meter, in a manner such that the signals generated by a respective square is uniquely identifiable (e.g., by grid coordinates) and distinguishable. For example, piezoresistive element/square 1741 is shown in the circuit diagram in FIG. 17B as a resistor of the Wheatstone bridge circuit 1780. When the spherical tip 425 moves along the screen 1740, say, in the direction indicated by the arrow shown in FIG. 17B, it presses on one or more of the piezoresistive elements e.g., element 1741. The mechanical strain experienced by the piezoresistive element results in a change to its electrical resistance, which can be detected by the change in the output voltage V of the Wheatstone bridge circuit 1780.

It should be understood that the image reconstructions of vibration signals shown in FIGS. 7A-7F above are examples providing a simplified explanation on how the movement of the stylus tip over the screen can be measured to obtain information about the magnitude and frequency of vibration of the drillstring. The principle of operation can be utilized to obtain sequences for any vibration magnitude and frequency. The principle of operation also can be implemented with other vibration configurations shown in FIGS. 6A, 7A, and 15A-17B. For instance, the piezoelectric screen described in connection with FIGS. 7A-7F can be replaced by the screen configuration comprising materials A/B shown in FIG. 6A, a screen comprising an upper/lower electrode shown in FIG. 15A and the piezoresistive screen configuration shown in FIG. 17A. In embodiments shown in FIGS. 6A and 7A, the signal generated due to the contact and separation is utilized, whereas in the embodiments shown in FIGS. 15A and 16 the alteration of the capacitance due to the variation in the electromagnetic field is utilized, to log data for specific coordinates. In FIG. 6A, since the stylus tip is made of the same material as one of the squares (black, in this case), the signal changes from a positive signal or a pulse (same material contact) to a negative signal or pulse (materials with opposite polarity) when the stylus tip moves from a black to a white square. As explained before, each of square on the screen has a coordinate so each signal generated is linked to a coordinate, which is utilized when reconstructing the vibration images. Generating electric pulses/waveforms by friction is based on the principle that an object becomes electrically charged after it contacts another material through friction. When they contact, charges move from one material to the other. Some materials have a tendency to gain electrons and some to lose electrons. If material A has a higher polarity than material B, then electrons are injected from material B into material A. This results in oppositely charged surfaces. When these two materials are separated there is a current flow, when a load is connected between the materials, due to the imbalance in charges between the two materials. The current flow continues until both the materials are at the same potential. When the materials move towards each other again there will be a current flow but in the opposite direction. Therefore, this contact and separation motion of materials can be used to generate electric pulses shown at FIG. 6A (bottom). In the vibration sensor configuration of FIG. 17A, the contact and separation results in the change of resistance in a Wheatstone bridge circuit, which is utilized to log data for specific coordinates.

Additionally, in any of the exemplary vibration sensor configurations, the number of screens, sequences and sampling frequencies/frames can be optimized when designing a system. It should also be understood that vibration information of interest that can be measured using the SASS can include the relative changes in the vibration of the drillstring assembly and does not necessarily need to include the absolute values. At least the relative changes in vibration over time is of interest as it can be compared with other available drilling dynamics, hydraulics, and rheology data to gain insights about the drilling process and optimize operations.

SASS-Based System for Distributed Monitoring of Downhole Parameters

In accordance with one or more embodiments, a sensor system is provided comprising a plurality of SASS devices positioned along a drill string. FIG. 18 is a perspective side-view of an exemplary SASS-based self-powered system for real-time distributed monitoring of a downhole drilling environment 1800 comprising a plurality of SASSs that define a sensor array. As shown, the SASSs can be of the type that include one or more of the vibration sensor 400 and a speed sensor 100 among other sensors that can be powered by the power storage unit (not shown) of the individual SASSs. The SASSs, e.g., SASS 10 and/or SASS 40, can be placed all along the drill string assembly 105 at chosen intervals to, for example, obtain real-time distributed data.

In the exemplary sensor system 1800, data can be transmitted along the drill string wirelessly, moving along the data units between the SASS units as in a relay from the bottom to the surface and from the surface to the bottom. The sensor systems can be placed inside or outside of the drill string assembly at a distance from one another that can be defined based on the maximum distance data can electromagnetically transmit from one SASS to another. This method of transmitting data along the drill string using SASSs is totally independent of drilling fluid flow, is faster than mud pulse telemetry.

This method of transmitting data along the drill string using SASSs can be very useful in a lost circulation scenario, for example when the bottom hole temperature is required for designing thermosetting lost circulation material (LCM) such as resin material to cure the losses. More specifically, the success of a thermosetting LCM resin depends on how accurately the hardening temperature of the viscous LCM is matched to the bottomhole temperature. Inaccurate bottomhole temperatures can result in the resin LCM setting inside the drill string or not setting at all downhole and only existing in a gel-like state in the lost circulation zone thereby not being able to plug fractured formations. Another very important application of having real time well data is in the real-time evaluation of kicks in fracture zones. Drilling in deep reservoirs with partial/severe loss circulation is tremendously expensive since the driller is drilling 'blind' as there is no real-time data on where the mud is being lost to the formation. Therefore, it is impossible to know the amount and the density of mud that needs to be added into the drill string and the annular to control the well, keep drilling and ensuring that kicks do not travel to the surface. Therefore, sensor systems placed all along a drill string assembly gives real time distributed sensing data, which can be used to effectively monitor the well and respond immediately if there is a problem.

FIG. 19 is a perspective side-view of an exemplary SASS-based self-powered system for real-time distributed monitoring of a downhole drilling environment 1900 shown inside a wellbore 1950. Like the system of FIG. 18, the system 1900 comprises a distributed array of SASS sensors and further comprising memory transmission capsules 1910. As noted, the individual SASS sensors (e.g., SASS 10 and/or 40) can be used as data storage units along the drill string assembly 105. Accordingly, the memory transmission capsules comprise electronics including a processor, a communications transceiver and antenna and a non-transitory computer readable storage medium within a sealed capsule housing that is suitable for being circulated downhole within the drilling fluid and withstanding the harsh downhole environment.

The data storage units (e.g., non-transitory memory) of respective SASS devices collect and/or process information measured using the on-board sensors and store it in local memory. Memory gathering mobile capsules 1910 are injected into the well from the surface, as shown in FIG. 19. The data stored in the storage units can then be transferred to the capsules via the wireless antenna of the SASSs as the capsules flow past the units. The capsules circulate with the drilling fluid and are recovered at the surface where the data can be downloaded by wired or wireless means to a computing device for further analysis of the captured information, say, using control computing device discussed in connection with FIG. 20. The memory of the capsules can be erased before they go inside the well again so that there is sufficient space to store data in the next circulating cycle.

The capsules wirelessly obtain data stored in the memory of the SASSs. In this sense, the capsules wirelessly interface with the SASSs on the drillstring assembly and lay the platform for downhole Internet-of-Things (IoT), opening up a variety of new ways to map and visualize the downhole environment. Moreover, the capsules require low power circuitry as they only contain a transceiver, microcontroller, and a power source such as a rechargeable battery, making them suitable for downhole IoT platforms. The battery can be recharged using energies harvested by the capsule flowing with the drilling fluid. The capsules have very low power requirements for both active and standby modes.

One of the most effective methods to combine different modules in the capsule can be to segment and stack the modules and interconnect them with short signal paths known as through-chip vias or through-silicon vias (TSVs). Therefore, no compromise has to be made with respect to material selection, and the same chip area can be used for all the different modules, resulting in seamless interlayer communication for interoperability of diverse components. Such heterogeneous 3D integration results in a significant reduction in the overall size of the capsule and consequently their cost can be reduced. The capsules also have a protective shell to protect the modules from the harsh downhole environment. These shells can be chemical coatings such as polymers and/or epoxy, resin-based materials, or any material that can withstand continuous exposure to the harsh downhole environment.

In accordance with one or more embodiments, the SASS electronics provided on the flexible circuit board 170 can utilize processing-in-memory (PIM) architecture. In PIM, large volumes of data is computed, analyzed, and turned into information and real-time insights by bringing computation closer to the data, instead of moving the data across to a CPU. This way, the data needed to be transferred from a SASS to a capsule or another SASS unit along with the required power for data transmission can be optimized. For instance, with respect to vibration data, the stored data in the SASS from the different screens can be stored in memory separated by unique headers to identify the different screens data was obtained from. It should be understood that not all vibration screen data has to be transferred, instead specific information such as maximum, minimum, average vibration values or anomalies can still provide valuable data to the driller at the surface.

The data in the capsules can be stored in static random-access memory, where the data will remain as long as the capsules are powered. They can be integrated on-chip as random access memory (RAM) or cache memory in microcontrollers, Application Specific Integrated Circuits (ASICS), Field Programmable Gate Arrays (FPGAs) and Complex programmable logic devices (CPLDs).

The transceiver in the SASSs (e.g., antenna-transceiver 180 shown in FIGS. 14A-14B) also preferably supports short-range wireless data transfer with ultra-low latency and ultra-low power requirements. Some methods include ultra-wideband (UWB) communication with short pulses rather than carrier frequencies. The electric and/or magnetic diploe antennas can also be optimized for ultra-low latency and ultra-low power data transfer. Examples include, wide-band microstrip, wide-band monopole antenna over a plate, wide-slot UWB antenna, stacked patch UWB antenna, taper slot (TSA) UWB antenna, elliptical printed monopole UWB antenna, metamaterial (MTM) structure UWB antennas, and dielectric resonator antennas (DRAs).

In accordance with one or more embodiments, prior to data transfer, a command can be sent wirelessly from the surface to change antennas in the SASS array into transmit mode to transfer data to capsules released from the surface and flowing inside a well with the drilling fluid. In addition or alternatively, a set of capsules configured to instruct antennas to enter data transfer mode can be deployed ahead of the memory capsules. Then, the data from SASS array is transferred to the memory capsules following the initial, leading capsules. In one or more configurations, specific capsules for each SASS in the array can be configured to communicate with and/or capture data only from a specific SASS. Additional data capture approaches can also include configuring the SASS devices and capsules for ultra-fast wake up and data transfer times so a capsule can send a signal to a SASS to change the transceiver status to 'active' from a 'sleep' status and obtain data. The capsules are configured to 'listen' to the data transmission to receive and store it in their internal memories and travel back to the surface.

As would be understood, the SASS devices and/or memory capsules 1910 can be in communication with a control computing system configured to receive and analyze the measured sensor data and, optionally, transmit information to the SASS devices such as control commands. FIG. 20 is a block diagram illustrating an exemplary configuration of a computing system for processing the sensor information received from the SASSs according to an embodiment of the present invention. As shown, the computing device can be arranged with various hardware and software components that serve to enable operation of the exemplary sensor and SASS system configurations. It should be understood that other computing and electronics devices used in the various embodiments of the disclosure can have similar hardware and software components as shown and described in FIG. 20.

Components of the computer 2180 include a processor 2640 that is shown in FIG. 20 as being disposed on a circuit board 2650. The circuit board can include a memory 2655, a communication interface 2660 and a computer readable storage medium 2065 that are accessible by the processor 2640. The circuit board 2650 can also include or be coupled to a power source (not shown) source for powering the computing device.

The processor 2640 and/or the circuit board 22650 can also be coupled to a display 2670, for visually outputting information to an operator (user), a user interface 2675 for receiving operator inputs, and an audio output 2680 for providing audio feedback as would be understood by those in the art. As an example, the processor 2640 could emit a visual signal from the display 2670, for instance, a visualization representing the real-time measured rotational speed and vibration signals measured by one or more SASS devices 10 and/or 40 provided along the drill string 105. Although the various components are depicted either independent from, or part of the circuit board 2650, it can be appreciated that the components can be arranged in various configurations.

The processor 2640 serves to execute software instructions that can be loaded into the memory 2655. The processor 2640 can be implemented using multiple processors, a multi-processor core, or some other type of processor. The memory 2655 is accessible by the processor 2640, thereby enabling the processor 2640 to receive and execute instructions stored on the memory 2655 and/or on the computer readable storage medium 2065. Memory 2655 can be implemented using, for example, a random access memory (RAM) or any other suitable volatile or non-volatile computer readable storage medium. In addition, memory 2655 can be fixed or removable.

The computer readable storage medium 2065 can also take various forms, depending on the particular implementation. For example, the computer readable storage medium 2665 can contain one or more components or devices such as a hard drive, a flash memory, a rewritable optical disk, a rewritable magnetic tape, or some combination of the above. The computer readable storage medium also can be fixed or removable or remote such as cloud-based data storage systems (remote memory or storage configuration not shown). The computer readable storage medium, for example, can be used to maintain a database 2085, which stores information relating to the capture of measurement data, the captured measurement data for respective sensors on board the SASS devices and/or data used or generated while carrying out operations and implementing aspects of the systems and methods disclosed herein.

One or more software modules 2688 are encoded in the memory 2655 and/or the computer readable storage medium 2665. The software modules 2688 can comprise one or more software programs or applications having computer program code or a set of instructions executed by the processor 2640. Such computer program code or instructions for carrying out operations and implementing aspects of the systems and methods disclosed herein can be written in any combination of one or more programming languages. While the software modules 2688 are stored locally in computer readable storage medium 2065 or memory 2655 and execute locally in the processor 2640, the processor 2640 can interact with remotely computing devices and even downhole SASS devices via communication interface 2660, and via a local or wide area network to perform calculations, analysis, control, and/or any other operations described herein.

During execution of the software modules 2685, the processor 2640 is configured to perform the various operations described herein, including without limitation, analyzing sensor data, controlling the SASS devices, and operating the drill string in view of the measured sensor data. The software modules 2688 can include code for implementing the aforementioned steps and other steps and actions described herein, for example and without limitation: a sensor data capture module 2670, which configures the computing device 2150 to capture and analyze sensor data measured using, inter alia, the vibration sensor 400, speed sensor 100 and any other sensor devices on-board the SASSs; and a communication module 2678, which configures the processor 2640 to communicate with remote devices (e.g., the SASSs provided on the drill string and the memory capsules 1910) over a communication connection such as a communication network or any wired or wireless electronic communication connection.

The program code of the software modules 2685 and one or more of the non-transitory computer readable storage devices (such as the memory 2655 and/or the computer readable storage medium 2665) can form a computer program product that can be manufactured and/or distributed in accordance with the present disclosure.

It should be understood that various combination, alternatives and modifications of the disclosure could be devised by those skilled in the art. The disclosure is intended to embrace all such alternatives, modifications and variances that fall within the scope of the appended claims.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A self-powered active sensing system for use in a downhole drilling environment, the system comprising:

a speed sensor for measuring rotational speed of a drill string, the speed sensor having:

a ring shaped first structure configured to be attached around a portion of the drill string, wherein the first structure extends circumferentially about the drill string and rotates about a rotational axis of the drill string, the first structure including:

a bearing extending from an outer surface of the first structure;

a housing disposed about the first structure and the portion of the drill string, wherein the housing includes:

an interior wall that defines a hollow central opening of a sufficient diameter for the drill string to extend therethrough, wherein the interior wall is shaped to define an annular groove extending circumferentially about the central opening, wherein the ring is housed at least partially within the annular groove and rotatable relative to the housing, and a moveable member housed within a recess formed in the interior wall and that extends into the annular groove, wherein the moveable member opposes the bearing, wherein upon rotation of the first structure relative to the housing, the bearing is configured to contact the moveable member and wherein the moveable member is configured to translate into the recess as a result of the contact with the bearing; and wherein the moveable member is configured to generate an analog electrical signal representative of the rotational speed of the drill string (analog speed signal) as a function of contact between the bearing and the moveable member.

2. The system of claim 1, further comprising:

a plurality of bearings extending from the outer surface of the first structure, wherein the bearings are spaced apart circumferentially about the first structure; and a plurality of moveable members extending from an inner surface of the housing that faces the outer surface of the first structure, wherein the moveable members are spaced apart circumferentially.

3. The system of claim 1, wherein the moveable member is configured to generate the electrical signal representing the rotational speed of the drill string without external power.

4. The system of claim 1, wherein at least a distal end of the moveable member comprises a first material and the bearing comprises a second material, wherein the first material and the second material have one or more of opposite polarities and distant polarities.

5. The system of claim 1, wherein the moveable member comprises a first material and wherein a portion of the interior wall defining the recess comprises a second material, wherein the first material and the second material have one or more of opposite polarities and distant polarities.

6. The system of claim 1, wherein at least a proximal end of the moveable member comprises alternating materials including a first material and a second material, and wherein a portion of the interior wall defining the recess comprises alternating materials including the first material and the second material, wherein the first material and the second material have one or more of opposite polarities and distant polarities.

7. The system of claim 1, further comprising: a piezoelectric material provided within the recess and configured to generate an electrical charge upon being contacted by a proximal end of the moveable member, and wherein the electrical circuit is coupled to the piezoelectric material.

8. The system of claim 1, further comprising a spring provided within the recess, wherein the spring urges the moveable member in a direction toward the bearing.

9. A self-powered active sensing system for use in a downhole drilling environment, comprising:

a vibration sensor for measuring vibration of a drill string, the vibration sensor including:

a housing shaped to extend circumferentially about the drill string thereby allowing the drill string to rotate within a central opening of the cavity, wherein the housing includes:

an internal wall within the housing shaped to define an annular cavity extending circumferentially through the housing, and a screen provided on a surface of the internal wall defining the annular cavity;

a ring structure that is generally ring shaped, wherein the ring structure is mounted within the annular cavity and coaxial with the annular cavity, the ring structure including:

a spherical bearing extending from an outer surface of the ring structure that faces the screen, wherein the spherical bearing is configured to contact the screen, and a plurality of springs supporting the ring within the annular cavity of the housing wherein the springs are configured to maintain the spherical bearing in contact with the screen and enable the spherical bearing to move across the screen in one or more directions as a function of vibration forces acting upon the housing; and wherein the screen is configured to generate an analog electrical signal (analog vibration signal) as a function of the movement of the spherical bearing across the screen in one or more directions, and wherein the analog vibration signal is representative of a position of the spherical bearing on the screen and thereby representative of the vibration of the drill string.

10. The system of claim 9, wherein the screen comprises at two-dimensional array of discrete segments having a first material and discrete segments comprising a second material arranged in an alternating fashion, wherein the first material and the second material have one or more of opposite polarities and distant polarities and wherein the spherical bearing comprises the first material.

11. The system of claim 9, wherein the screen comprises:

an outer surface defined by discrete segments comprising a piezoelectric material arranged in a two-dimensional array, wherein each segment in the array is part of an electrical circuit configured to generate an electrical charge upon being contacted by the spherical bearing.

12. The system of claim 11, further comprising: one or more Wheatstone bridge circuits, wherein each of the discrete segments defines a resistor within a Wheatstone bridge circuit among the one or more Wheatstone bridge circuits.

13. The system of claim 9, wherein the screen comprises:

a two-dimensional array of capacitor segments each having:

an outer surface layer defined by an upper electrode, a lower electrode, and a dielectric layer separating the upper and lower electrodes, wherein the outer surface is configured to move toward the lower electrode when contacted by the spherical bearing thereby changing a capacitance; and wherein an electrical circuit is electrically coupled to the capacitor segments and wherein the electrical circuit configured to measure a change in capacitance of the segments and generate a signal indicating a position of the spherical bearing on the array and representative of vibration of the drill string.

14. The system of claim 9, wherein the screen is self-powered and configured to generate the electrical signal without receiving electrical power from an external power source.

15. A self-powered active sensing system, comprising:

a housing, disposed circumferentially about a portion of a drill string, wherein the housing includes:

an interior wall that defines a hollow central opening of a sufficient diameter for the drill string to extend therethrough, wherein the interior wall of the housing is shaped to define an annular groove extending circumferentially about the central opening, and an internal wall within the housing shaped to define an annular cavity extending circumferentially through the housing, and wherein the housing is further configured to house a speed sensor for measuring rotational speed of the drill string and a vibration sensor for measuring vibration of the drill string;

the speed sensor for measuring rotational speed of the drill string, the speed sensor having:

a ring shaped first structure configured to be attached around the portion of the drill string, wherein the first structure extends circumferentially about the drill string and rotates about a rotational axis of the drill string, the first structure including:

a bearing extending from an outer surface of the first structure, and wherein the ring is housed at least partially within the annular groove defined by the interior wall of the housing and is rotatable relative to the housing; and a moveable member housed within a recess formed in the interior wall of the housing and that extends into the annular groove, wherein the moveable member opposes the bearing, wherein upon rotation of the first structure relative to the housing, the bearing is configured to contact the moveable member and the moveable member is configured to translate into the recess as a result of the contact with the bearing, and wherein the moveable member is configured to generate an analog electrical signal representative of the rotational speed of the drill string (analog speed signal) as a function of contact between the bearing and the moveable member; and the vibration sensor for measuring vibration of a drill string, the vibration sensor including:

a screen provided on a surface of the internal wall defining the annular cavity within the housing;

a ring structure that is generally ring shaped, wherein the ring structure is mounted within the annular cavity and coaxial with the annular cavity, the ring structure including:

a spherical bearing extending from an outer surface of the ring structure that faces the screen, wherein the spherical bearing is configured to contact the screen, a plurality of springs supporting the ring within the annular cavity of the housing wherein the springs are configured to maintain the spherical bearing in contact with the screen and enable the spherical bearing to move across the screen in one or more directions as a function of vibration forces acting upon the housing, and wherein the screen is configured to generate an analog electrical signal (analog vibration signal) as a function of the movement of the spherical bearing across the screen in one or more directions, and wherein the analog vibration signal is representative of a position of the spherical bearing on the screen and thereby representative of the vibration of the drill string.

16. The self-powered active sensing system of claim 15, further comprising:

an electronics circuit provided within the housing and electrically connected to the vibration sensor and the speed sensor, wherein the electronics circuit comprises:

a power storage device, wherein the analog vibration signal and analog speed signal are stored on the power storage device; and a communications transceiver and antenna provided within the housing and communicatively connected to the electronics circuit.

17. The self-powered active sensing system of claim 16, wherein the electronics circuit further comprises:

an analog to digital signal converter configured to convert the analog speed signal and the analog vibration signal into respective digital signals; and a non-transitory computer readable storage medium configured to store the digital speed signal and digital vibration signal.

18. The self-powered active sensing system of claim 16, wherein the power storage device is one or more of a dielectric capacitor, a ceramic capacitor, an electrolytic capacitor, a super capacitor.

19. The self-powered active sensing system of claim 16, further comprising a powered sensor communicatively coupled to the electronic circuit wherein the powered sensor is configured to measure a parameter of one or more of the downhole environment and the drill string, wherein the electronic circuit is configured to provide energy stored in the power storage device to the powered sensor.

20. The self-powered active sensing system of claim 16, wherein the powered sensors are one or more of a low power temperature sensor, pressure sensor, strain sensor, magnetic field sensor and electric field sensor.

21. A self-powered system for real-time distributed monitoring of a downhole drilling environment, the system comprising:

a plurality of self-powered active sensing systems (SASS) of claim 16, wherein the plurality of self-powered active sensing systems are distributed along a length of the drill string.

22. The system of claim 21, wherein the electronics circuit provided in each SASS among the plurality of SASSs further comprises a communication module, wherein the communication module is configured to wirelessly transmit information relating to the stored digital speed signal and stored digital vibration signal to a proximate SASS device among the SASSs using the transceiver and antenna.

23. The system of claim 21 further comprising:

a plurality of memory transmission capsules configured to be circulated down through the bore hole and back to a surface, wherein each memory transmission capsule comprises a sealed outer housing, and internal electronics including a non-transitory computer readable storage medium and a wireless transceiver and antenna and wherein each memory transmission capsule is configured to receive measurement data transmitted wirelessly from one or more of the SASSs and store received data in its non-transitory computer readable storage medium; and wherein the electronics circuit provided in each SASS among the plurality of SASSs further comprises a communication module, wherein the communication module is configured to wirelessly transmit stored measurement data to any proximate memory transmission capsules using the communications transceiver and antenna.

* * * * *